US011635231B2

(12) United States Patent
Sommerauer

(10) Patent No.: US 11,635,231 B2
(45) Date of Patent: Apr. 25, 2023

(54) ROTATING GRATE WITH A CLEANING DEVICE FOR A BIOMASS HEATING SYSTEM

(71) Applicant: SL-TECHNIK GMBH, St. Pantaleon (AT)

(72) Inventor: Thilo Sommerauer, Gilgenberg am Weilhart (AT)

(73) Assignee: SL-TECHNIK GMBH, St. Pantaleon (AT)

( * ) Notice: Subject to any disclaimer, the term of this patent is extended or adjusted under 35 U.S.C. 154(b) by 0 days.

(21) Appl. No.: 17/753,433

(22) PCT Filed: Sep. 3, 2020

(86) PCT No.: PCT/EP2020/074587
§ 371 (c)(1),
(2) Date: Mar. 2, 2022

(87) PCT Pub. No.: WO2021/043898
PCT Pub. Date: Mar. 11, 2021

(65) Prior Publication Data

US 2022/0333770 A1 Oct. 20, 2022

(30) Foreign Application Priority Data

Sep. 3, 2019 (EP) ..... 19195118
Nov. 19, 2019 (EP) ..... 19210080
Nov. 20, 2019 (EP) ..... 19210444

(51) Int. Cl.
*F24H 1/00* (2022.01)
*F23B 30/00* (2006.01)
(Continued)

(52) U.S. Cl.
CPC ..... *F24H 1/0063* (2013.01); *B03C 3/10* (2013.01); *B03C 3/76* (2013.01); *F23B 1/24* (2013.01);
(Continued)

(58) Field of Classification Search
CPC ..... F23H 9/02; F23H 15/00
See application file for complete search history.

(56) References Cited

U.S. PATENT DOCUMENTS 36,055 A 7/1862 March
422,472 A 3/1890 Wadsworth
(Continued)

FOREIGN PATENT DOCUMENTS

AT 408846 B 3/2002
AT 5587 U1 8/2002
(Continued)

OTHER PUBLICATIONS

Oswald et al., "Advanced control with economic—ecological optimization for biomass-fired boilers", Proceedings of the 15th International Carpathian Control Conference, 2014, pp. 407-412.
(Continued)

*Primary Examiner* — David J Laux
(74) *Attorney, Agent, or Firm* — Chiesa, Shahinian & Giantomasi PC

(57) ABSTRACT

A rotating grate for a biomass heating system is disclosed, the grate comprising: at least one rotating grate element; at least one bearing axle, by means of which the rotating grate element is rotatably mounted; at least one cleaning device attached to one of the rotating grate elements, wherein the cleaning device comprises a mass element movable relative to the rotating grate element; wherein the cleaning device is arranged in such a way that, upon rotation of the rotating grate element, an acceleration movement of the mass ele-
(Continued)

ment is initiated so that the cleaning device exerts a knocking effect on the rotating grate element in order to clean the rotating grate element.

21 Claims, 28 Drawing Sheets

(51) Int. Cl.

| | |
|---|---|
| ***F23B 10/02*** | (2011.01) |
| ***F23L 1/00*** | (2006.01) |
| ***F23L 3/00*** | (2006.01) |
| ***F23L 9/00*** | (2006.01) |
| ***F23B 30/02*** | (2006.01) |
| ***F23H 9/00*** | (2021.01) |
| ***F23H 15/00*** | (2006.01) |
| ***F24H 15/104*** | (2022.01) |
| ***F24H 9/28*** | (2022.01) |
| ***F24H 1/18*** | (2022.01) |
| ***B03C 3/10*** | (2006.01) |
| ***B03C 3/76*** | (2006.01) |
| ***F23B 60/02*** | (2006.01) |
| ***F23J 3/02*** | (2006.01) |
| ***F23J 15/02*** | (2006.01) |
| ***F24H 9/00*** | (2022.01) |
| ***F24H 9/20*** | (2022.01) |
| ***F24H 15/281*** | (2022.01) |

(52) U.S. Cl.

CPC ..... *F23B 5/04* (2013.01); *F23B 7/007* (2013.01); *F23B 10/02* (2013.01); *F23B 30/02* (2013.01); *F23B 60/02* (2013.01); *F23H 9/00* (2013.01); *F23H 15/00* (2013.01); *F23J 3/023* (2013.01); *F23J 15/025* (2013.01); *F23L 1/00* (2013.01); *F23L 3/00* (2013.01); *F23L 9/00* (2013.01); *F24H 1/187* (2013.01); *F24H 9/0031* (2013.01); *F24H 9/2057* (2013.01); *F24H 9/28* (2022.01); *F24H 15/104* (2022.01); *F23B 2700/018* (2013.01); *F23G 2202/103* (2013.01); *F23J 2217/102* (2013.01); *F23M 2700/0053* (2013.01); *F24H 15/281* (2022.01)

(56) References Cited

U.S. PATENT DOCUMENTS

| | | | |
|---|---|---|---|
| 1,371,995 | A | 3/1921 | Nesbit |
| 1,393,712 | A | 10/1921 | Steere et al. |
| 2,233,066 | A | 2/1941 | Watson |
| 2,933,057 | A | 4/1960 | Wilson |
| 3,010,450 | A | 11/1961 | James |
| 4,092,134 | A | 5/1978 | Kikuchi |
| 4,254,715 | A | 3/1981 | Lahaye et al. |
| 4,258,692 | A | 3/1981 | Mackey |
| 4,319,555 | A | 3/1982 | Melvin |
| 4,675,029 | A | 6/1987 | Norman et al. |
| 4,962,912 | A | 10/1990 | Stoll |
| 5,241,916 | A | 9/1993 | Martin |
| 5,497,824 | A | 3/1996 | Rouf |
| 5,823,122 | A | 10/1998 | Chronowski et al. |
| 5,937,772 | A | 8/1999 | Khinkis et al. |
| 6,004,376 | A | 12/1999 | Frank |
| 6,158,302 | A | 12/2000 | Becker et al. |
| 6,485,296 | B1 | 11/2002 | Bender et al. |
| 6,545,462 | B2 | 4/2003 | Schott et al. |
| 6,820,511 | B2 | 11/2004 | Mutschler et al. |
| 7,758,675 | B2 | 7/2010 | Naito et al. |
| 8,901,921 | B2 | 12/2014 | Sterling |
| 10,875,634 | B2 | 12/2020 | De Dreuille De Longeville et al. |
| 2004/0044423 | A1 | 3/2004 | Wintrich |
| 2006/0112955 | A1 | 6/2006 | Reaves |
| 2008/0223266 | A1 | 9/2008 | Brazier et al. |
| 2009/0013985 | A1 | 1/2009 | Little et al. |
| 2009/0105852 | A1 | 4/2009 | Wintrich et al. |
| 2009/0199747 | A1 | 8/2009 | Laskowski et al. |
| 2010/0251973 | A1 | 10/2010 | Dongo et al. |
| 2011/0209647 | A1 | 9/2011 | Mitchell et al. |
| 2013/0133560 | A1 | 5/2013 | Laskowski et al. |
| 2015/0094865 | A1 | 4/2015 | Choi et al. |
| 2016/0341437 | A1 | 11/2016 | Matsuoka |
| 2019/0170345 | A1 | 6/2019 | Ozbey et al. |
| 2020/0191380 | A1 | 6/2020 | Park et al. |

FOREIGN PATENT DOCUMENTS

| | | | | | |
|---|---|---|---|---|---|
| AT | 6972 | U1 | | 6/2004 | |
| AT | 503043 | A4 | | 7/2007 | |
| AT | 505295 | B1 | | 12/2008 | |
| AT | 506411 | A4 | | 9/2009 | |
| AT | 506615 | A1 | | 10/2009 | |
| AT | 506970 | A4 | | 1/2010 | |
| AT | 509487 | B1 | | 9/2011 | |
| AT | 13782 | U1 | | 8/2014 | |
| AT | 13825 | U1 | | 9/2014 | |
| CH | 40299 | A | | 6/1908 | |
| CH | 394645 | A5 | | 5/2005 | |
| CN | 202109645 | U | | 1/2012 | |
| CN | 203442792 | U | | 2/2014 | |
| CN | 206904963 | U | | 1/2018 | |
| CN | 207091367 | U | | 3/2018 | |
| CN | 108506924 | A | | 9/2018 | |
| CN | 108662581 | A | | 10/2018 | |
| CN | 108826310 | A | | 11/2018 | |
| CN | 109915816 | A | | 6/2019 | |
| DE | 277440 | C | | 8/1914 | |
| DE | 557091 | C | | 8/1932 | |
| DE | 1056052 | B | | 4/1959 | |
| DE | 1094912 | B | | 12/1960 | |
| DE | 2206056 | A1 | | 8/1973 | |
| DE | 2755059 | A1 | | 6/1979 | |
| DE | 3136195 | A1 | | 3/1983 | |
| DE | 3200727 | A1 | | 7/1983 | |
| DE | 3410546 | A | | 10/1985 | |
| DE | 3500431 | A1 | | 7/1986 | |
| DE | 3842811 | A1 | | 6/1990 | |
| DE | 19528422 | C1 | | 4/1997 | |
| DE | 19706067 | A1 | | 8/1998 | |
| DE | 19825442 | A1 | | 10/1999 | |
| DE | 19650585 | C2 | | 11/2001 | |
| DE | 20210190 | U1 | | 11/2003 | |
| DE | 10219251 | B3 | | 1/2004 | |
| DE | 102007010973 | A1 | | 9/2008 | |
| DE | 102010061861 | A1 | | 9/2011 | |
| EP | 0156363 | A2 | | 10/1985 | |
| EP | 0433152 | A1 | | 6/1991 | |
| EP | 0677416 | A1 | | 10/1995 | |
| EP | 0950833 | A2 | | 10/1999 | |
| EP | 0885113 | B1 | | 4/2000 | |
| EP | 1353150 | B1 | | 9/2006 | |
| EP | 1830130 | A2 | | 9/2007 | |
| EP | 1884712 | A2 | | 2/2008 | |
| EP | 1967273 | A2 | | 9/2008 | |
| EP | 1182461 | B1 | | 4/2010 | |
| EP | 2198124 | A1 | | 6/2010 | |
| EP | 2587150 | A2 | | 5/2013 | |
| EP | 2662539 | A1 | | 11/2013 | |
| EP | 2770255 | A2 | | 8/2014 | |
| EP | 2787279 | A1 | | 10/2014 | |
| EP | 2966349 | A1 | | 1/2016 | |
| EP | 3064276 | A2 | | 9/2016 | |
| EP | 3414158 | A1 | | 12/2018 | |
| EP | 3628851 | A1 | | 4/2020 | |
| EP | 3789671 | A1 | | 3/2021 | |
| EP | 3789676 | B1 | | 6/2021 | |
| GB | 273032 | A | * | 6/1927 | ..... F23H 15/00 |
| GB | 323186 | A | | 12/1929 | |
| GB | 371779 | A | * | 4/1932 | ..... F23H 15/00 |
| GB | 376143 | A | * | 7/1932 | ..... F23H 15/00 |
| GB | 671597 | A | | 5/1952 | |

(56) References Cited

FOREIGN PATENT DOCUMENTS

| | | | |
|---|---|---|---|
| GB | 1588057 | A | 4/1981 |
| GB | 2542678 | A | 3/2017 |
| JP | 2007255821 | A | 4/2007 |
| JP | 2008002782 | A | 1/2008 |
| JP | 2012137250 | A | 7/2012 |
| JP | 2016223758 | A | 12/2016 |
| KR | 101149359 | B1 | 5/2012 |
| KR | 20180076519 | A | 7/2018 |
| RU | 2066816 | C1 | 9/1996 |
| RU | 2518772 | C1 | 6/2014 |
| RU | 2015141253 | A | 4/2017 |
| SE | 443798 | B | 3/1986 |
| SU | 1755005 | A1 | 8/1992 |
| WO | 8603141 | A1 | 6/1986 |
| WO | 2005105315 | A1 | 11/2005 |
| WO | 2009050126 | A1 | 4/2009 |
| WO | 2017205884 | A2 | 12/2017 |
| WO | 2019145854 | A1 | 8/2019 |

OTHER PUBLICATIONS

European Search Report dated Aug. 1, 2022, in connection with European Patent Application No. 21218435.2, 14 pgs. (including translation).

Notification of Grant and Search Report dated Jul. 26, 2022, in connection with Russian Patent Application No. 2022105851/12, 22 pgs (including translation).

Notification of Reasons for Rejection dated Jul. 26, 2022 in connection with Japanese Patent Application No. 2022-528202, 11 pgs. (including translation).

Notification of Reasons for Rejection dated Jul. 26, 2022 in connection with Japanese Patent Application No. 2022-528203, 10 pgs (including translation).

Notification of Reasons for Rejection dated Nov. 1, 2022 in connection with Japanese Patent Application No. 2022-528202, 12 pgs. (including translation).

International Search Report and Written Opinion dated Nov. 27, 2020, in connection with International Patent Application No. PCT/EP2020/074596, filed Sep. 3, 2020, 15 pgs. (including translation).

Excerpt of German dictionary "Duden", 7th edition to "Einheit" ("unit"), 3 pgs. (Translation unavailable at this time).

First folder of ETA Heiztechnik GmbH, "ETA Hack 20 bis 200 kW" (The benchmark for safe fuel delivery), www.eta.co.at, 20 pgs. (translation not available at this time).

Second folder of ETA Heiztechnik GmbH, "ETA Hack 20 bis 200 kW" (The benchmark for safe fuel delivery), www.eta.co.at, 20 pgs. (translation not available at this time).

International Search Report and Written Opinion dated Dec. 2, 2020, in connection with International Patent Application No. PCT/EP2020/074584, filed Sep. 3, 2020, 10 pgs. (including translation).

International Search Report and Written Opinion dated Dec. 2, 2020, in connection with International Patent Application No. PCT/EP2020/074583, filed Sep. 3, 2020, 12 pgs. (including translation).

International Search Report and Written Opinion dated Dec. 2, 2020, in connection with International Patent Application No. PCT/EP2020/074587, filed Sep. 3, 2020, 12 pgs. (including translation).

English translation of First folder of ETA Heiztechnik GmbH, "ETA Hack bis 200 kW" (The benchmark for safe fuel delivery), www.eta.co.at, 20 pgs, previously disclosed in Information Disclosure Statement filed Mar. 2, 2022.

English translation of Second folder of ETA Heiztechnik GmbH, "ETA Hack bis 200 kW" (The benchmark for safe fuel delivery), www.eta.co.at, 20 pgs, previously disclosed in Information Disclosure Statement filed Mar. 2, 2022.

English translation of Excerpt of German dictionary "Duden", 7th edition to "Einheit" ("unit"), 3 pgs, previously disclosed in Information Disclosure Statement filed Mar. 2, 2022.

European Search Report dated Jun. 2, 2022 in connection with European Patent Application No. 21218434.5, 4 pgs (including translation).

Non-Final Office Action dated Oct. 6, 2022 in connection with U.S. Appl. No. 17/753,398, filed Mar. 2, 2022, 43 pgs.

Non-Final Office Action dated Oct. 26, 2022 in connection with U.S. Appl. No. 17/753,397, filed Mar. 2, 2022, 46 pgs.

First Office Action dated Sep. 30, 2022 in connection with Chinese Patent Application No. 2020800746538, 10 pgs. (including translation).

Office Action dated Oct. 17, 2022 in connection with Russian Patent Application No. 2022105850, filed Sep. 3, 2020, 10 pgs. (including translation).

European Search Report dated Apr. 24, 2020, in connection with European Patent Application No. 19195118.5, filed Sep. 2, 2019, 8 pgs (including translation).

European Search Report dated Apr. 22, 2020, in connection with European Patent Application No. 19210080.8, filed Nov. 19, 2019, 8 pgs (including translation).

European Search Report dated Jun. 23, 2020, in connection with European Patent Application No. 19210444.6, filed Nov. 20, 2019, 8 pgs (including translation).

Decision to Grant dated May 20, 2021, in connection with European Patent Application No. 20194307.3, 4 pgs. (including translation).

Communication pursuant to Article 94(3) EPC dated Feb. 9, 2021, in connection with European Patent Application No. 20194307.3, filed Sep. 3, 2020, 6 pgs. (including translation).

European Search Report dated Jan. 28, 2021, in connection with European Patent Application No. 20194307.3, filed Sep. 3, 2020, 8 pgs. (including translation).

Communication pursuant to Article 94 (3) EPC dated Mar. 11, 2021, in connection with European Patent Application No. 19210080.8, filed Nov. 19, 2019, 8 pgs. (including translation).

Communication pursuant to Article 94 (3) EPC dated Jun. 8, 2020, in connection with European Patent Application No. 19210080.8, filed Nov. 19, 2019, 8 pgs. (including translation).

Communication pursuant to Rule 71(3) EPC dated Apr. 23, 2021, in connection with European Patent Application No. 20194307.3, 15 pgs. (including translation).

Office Action dated Jan. 24, 2023 in connection with U.S. Appl. No. 17/753,430, dated Mar. 2, 2022, 11 pages.

Non-Final Office Action dated Mar. 16, 2023 in connection with U.S. Appl. No. 17/753,397, filed Mar. 2, 2022, 36 pgs.

* cited by examiner from top

ROTATING GRATE WITH A CLEANING DEVICE FOR A BIOMASS HEATING SYSTEM

CROSS-REFERENCE TO RELATED APPLICATIONS

This application is a national stage of International Patent Application Serial No. PCT/EP2020/074587, filed Sep. 3, 2020, which claims priority to European Patent Application No. 19195118.5, filed Sep. 3, 2019; European Patent Application No. 19210080.8, filed Nov. 19, 2019; and European Patent Application No. 19210444.6, filed Nov. 20, 2019, the disclosures of all are incorporated herein by reference in their entirety.

TECHNICAL FIELD

The invention relates to an improved rotating grate with a cleaning device for a biomass heating system.

In particular, the invention relates to a three-part rotating grate with improved cleaning and improved perforation.

STATE OF THE ART

Biomass heating systems in a power range from 20 to 500 kW are known. Biomass can be considered a cheap, domestic, crisis-proof and environmentally friendly fuel. As combustible biomass there are, for example, wood chips or pellets.

The pellets are usually made of wood chips, sawdust, biomass or other materials that have been compressed into small discs or cylinders with a diameter of approximately 3 to 15 mm and a length of 5 to 30 mm. Wood chips (also referred to as wood shavings, wood chips or wood chips) is wood shredded with cutting tools.

Biomass heating systems for fuel in the form of pellets and wood chips essentially feature a boiler with a combustion chamber (the combustion chamber) and with a heat exchange device connected to it. Due to stricter legal regulations in many countries, some biomass heating systems also feature a fine dust filter. Other various accessories are usually present, such as control devices, probes, safety thermostats, pressure switches, a exhaust gas/flue gas or flue gas recirculation system, and a separate fuel tank.

The combustion chamber regularly includes a device for supplying fuel, a device for supplying air and an ignition device for the fuel. The air supply device, in turn, typically features a high-power, low-pressure blower to advantageously influence thermodynamic factors during combustion in the combustion chamber. A device for feeding fuel can be provided, for example, with a lateral insertion (so-called cross-insertion firing). In this process, the fuel is fed into the combustion chamber from the side via a screw or piston.

The combustion chamber further typically includes a combustion grate on which fuel is continuously fed and burned substantially. This combustion grate stores the fuel for combustion and has openings that allow the passage of a portion of the combustion air as primary air to the fuel. Furthermore, the grate can be unmovable or movable. Movable grates are usually used for easy disposal of combustion residues generated during incineration, for example ash and slag. However, these combustion residues can adhere or cake to the grate and must be cleaned off manually on a regular basis, which is a disadvantage. In addition, the ash and slag can clog the openings in the grate for air supply with the ash or slag, which has a detrimental effect on combustion efficiency. Practical experience has shown that combustion residues can adhere or cake, especially in the openings of the grate, making cleaning of the grate even more difficult.

When the primary air flows through the grate, the grate is also cooled, among other things, which protects the material. Should the openings now become clogged, this cooling effect will also be impaired.

In addition, insufficient air supply on the grate can again lead to increased slag formation. In particular, furnaces that are to be fed with different fuels, with which the present disclosure is particularly concerned, have the inherent problem that the different fuels have different ash melting points, water contents and different combustion behavior. This makes it problematic to provide a heating system that is equally well suited for different fuels and whose grates can be cleaned in a correspondingly improved manner.

The combustion chamber can be further regularly divided into a primary combustion zone (direct combustion of the fuel on the grate) and a secondary combustion zone (post-combustion of the flue gas). Drying, pyrolytic decomposition and gasification of the fuel take place in the combustion chamber. Secondary air can also be introduced to completely burn off the flammable gases produced.

After drying, the combustion of the pellets or wood chips has two main phases. In the first phase, the fuel is pyrolytically decomposed and converted into gas by high temperatures and air, which can be injected into the combustion chamber, and at least partially, In the second phase, combustion of the part converted into gas occurs, as well as combustion of any remaining solids. In this respect, the fuel outgasses and the resulting gas is co-combusted.

Pyrolysis is the thermal decomposition of a solid substance in the absence of oxygen. Pyrolysis can be divided into primary and secondary pyrolysis. The products of primary pyrolysis are pyrolysis coke and pyrolysis gases, and pyrolysis gases can be divided into gases that can be condensed at room temperature and gases that cannot be condensed. Primary pyrolysis takes place at roughly 250-450° C. and secondary pyrolysis at about 450-600° C. The secondary pyrolysis that occurs subsequently is based on the further reaction of the pyrolysis products formed primarily. Drying and pyrolysis take place at least largely without the use of air, since volatile CH compounds escape from the particle and therefore no air reaches the particle surface. Gasification can be seen as part of oxidation; it is the solid, liquid and gaseous products formed during pyrolytic decomposition that are brought into reaction by further application of heat. This is done by adding a gasification agent such as air, oxygen or even steam. The lambda value during gasification is greater than zero and less than one. Gasification takes place at around 300 to 850° C. Above about 850° C., complete oxidation takes place with excess air (lambda greater than 1). The reaction end products are essentially carbon dioxide, water vapor and ash. In all phases, the boundaries are not rigid but fluid. The combustion process can be advantageously controlled by means of a lambda probe provided at the exhaust gas outlet of the boiler.

In general terms, the efficiency of combustion is increased by converting the pellets into gas, because gaseous fuel is better mixed with the combustion air, and a lower emission of pollutants, less unburned particles and ash are produced.

The combustion of biomass produces airborne combustion products whose main components are carbon, hydrogen and oxygen. These can be divided into emissions from complete oxidation, from incomplete oxidation and substances from trace elements or impurities. Emissions from complete oxidation are mainly carbon dioxide ($CO_2$) and water vapor ($H_2O$). The formation of carbon dioxide from the carbon of the biomass is the goal of combustion, as this allows the energy released to be used. The release of carbon dioxide ($CO_2$) is largely proportional to the carbon content of the amount of fuel burned; thus, the carbon dioxide is also dependent on the useful energy to be provided. A reduction can essentially only be achieved by improving efficiency. Likewise, combustion residues are produced in any case, such as ash and slag, which can adhere correspondingly firmly to the grate.

Particularly in biomass heating systems, which are intended to be suitable for different types of biological fuel, the varying quality and consistency of the fuel makes it difficult to maintain consistently high efficiency of the biomass heating system, especially since ash and slag formation on the grate can vary widely. There is considerable need for optimization in this respect.

In addition, the biological fuel may be contaminated. These impurities can increase ash and slag formation and/or cause blockages in the openings of the grate.

Another disadvantage of the conventional biomass heating systems for pellets may be that pellets falling into the combustion chamber may roll or slide out of the grate or grate and enter an area of the combustion chamber where the temperature is lower or where the air supply is poor, or they may even fall into the lowest chamber of the boiler. Pellets that do not remain on the grate or grate burn incompletely, causing poor efficiency, excessive ash and a certain amount of unburned pollutant particles.

Biomass heating systems for pellets or wood chips have the following additional disadvantages and problems.

One problem is that incomplete combustion, as a result of non-uniform distribution of fuel on the grate or grate and as a result of non-optimal mixing of air and fuel, favors the accumulation and falling of unburned ash into the air ducts through the air inlet openings leading directly onto the combustion grate.

This is particularly disruptive and causes frequent interruptions to perform maintenance tasks such as cleaning. For all these reasons, a large excess of air is normally maintained in the combustion chamber, but this decreases the flame temperature and combustion efficiency, and results in high NOx emissions.

Based on the aforementioned problems, it may be an object of the present invention to provide a grate for a biomass heating system, which is preferably provided in hybrid technologies, that allows optimized operation of the biomass heating system.

For example, easy ash removal or cleaning of the grate should be enabled, as well as easy maintenance of the grate of the biomass heating system should be enabled.

In addition, there should be a high level of system availability.

In accordance with the invention and in addition, the following consideration could play a role:

The hybrid technology should allow the use of both pellets and wood chips with water contents between 8 and 35 percent by weight.

In this context, the aforementioned task(s) or potential individual problems can also relate to other sub-aspects of the overall system, for example to the combustion chamber or the air flow through the grate.

This task(s) is/are solved by the objects of the independent claims. Further aspects and advantageous further embodiments are the subject of the dependent claims.

The advantages of this configuration and also of the following aspects will be apparent from the following description of the associated embodiments.

According to a further development of the preceding aspect, a rotating grate for a biomass heating system is provided, further comprising the following: at least one rotating grate element; at least one bearing axle by means of which the rotating grate element is rotatably supported; at least one cleaning device attached to one of the rotating grate elements, the cleaning device comprising a mass element movable relative to the rotating grate element; wherein the cleaning device is arranged such that, upon rotation of the rotating grate element, an acceleration movement of the mass element is initiated so that the cleaning device exerts a knocking effect on the rotating grate element in order to clean the rotating grate element.

According to a further embodiment of any of the preceding aspects, there is provided a rotating grate for a biomass heating system, wherein: the cleaning device is arranged such that, upon rotation of the rotating grate element to initiate the accelerating motion, the mass element is raised to a fall start position/drop start position from which the mass element falls under the influence of the acceleration due to gravity to produce the knocking effect on the rotating grate element.

According to a further embodiment of any of the preceding aspects, a rotating grate for a biomass heating system is provided, wherein: the cleaning device is arranged such that the mass element of the cleaning device strikes a impact face of the rotating grate element during its acceleration or falling movement.

According to a further development of any of the preceding aspects, a rotating grate for a biomass heating system is provided, wherein: the cleaning device is arranged such that the mass element of the cleaning device deflects an impact arm during its acceleration or falling movement, so that the impact arm impacts on an impact face.

According to a further embodiment of any of the preceding aspects, a rotating grate for a biomass heating system is provided, wherein: the cleaning device is arranged such that when the rotating grate element is rotated in a first direction and when the rotating grate element is rotated in a second direction opposite to the first direction, the rotating grate element is respectively struck against an impact face.

According to a further embodiment of any of the preceding aspects, a rotating grate for a biomass heating system is provided, wherein: the cleaning device is provided on the underside of the rotating grate element opposite a combustion area of the rotating grate element.

According to a further embodiment of any of the preceding aspects, a rotating grate for a biomass heating system is provided, wherein: the cleaning device comprises: a suspension attached to the rotating grate element and having a joint; an impact arm having a first end and a second end, the mass element being provided at one of the ends of the impact arm; wherein the impact arm is pivotally connected to the suspension via the hinge about a pivot axis of the hinge.

According to a further embodiment of any of the preceding aspects, a rotating grate for a biomass heating system is provided, wherein: the bearing axle of the rotating grate element is provided at least approximately parallel to the axis of rotation of the joint of the beater arm; and/or the bearing axle is arranged at least approximately horizontally.

According to a further embodiment of any of the preceding aspects, a rotating grate for a biomass heating system is provided, wherein: the beater arm is pivotally arranged between the drop start position and a drop end position through a predefined angle; and/or the cleaning device is exclusively attached to and in communication with the rotating grate element.

According to a further embodiment of any of the preceding aspects, a rotating grate for a biomass heating system is provided, wherein: the cleaning device is arranged with the mass element such that the mass element has a flat impact face that is aligned at least approximately parallel to the impact face during impact.

According to a further development of any of the preceding aspects, a rotating grate for a biomass heating system is provided, wherein: at least one impact face is provided on the underside of the rotating grate element and/or on the bearing axle and/or on the cleaning device.

According to a further development of any of the preceding aspects, there is provided a rotating grate for a biomass heating system, wherein: said rotating grate elements form a combustion area for said fuel; said rotating grate elements have openings for said air for combustion, said openings being elongated in the form of a slot, a longitudinal axis of said openings being provided at an angle of 30 to 60 degrees to a fuel insertion direction.

According to a further embodiment of any of the preceding aspects, a rotating grate for a biomass heating system is provided, wherein: the rotating grate comprises a first rotating grate element, a second rotating grate element, and a third rotating grate element, each of which is rotatably arranged about a respective bearing axle by at least 90 degrees.

According to a further aspect of any of the preceding aspects, a rotating grate for a biomass heating system is provided, wherein: the rotating grate further comprises a rotating grate mechanism configured to rotate the third rotating grate element independently of the first rotating grate element and the second rotating grate element, and to rotate the first rotating grate element and the second rotating grate element in unison with each other and independently of the third rotating grate element.

According to a further aspect of any of the preceding aspects, a rotating grate for a biomass heating system is provided, wherein: the rotating grate comprises a perforation; and wherein the perforation comprises a plurality of slot-shaped openings arranged in a top view of the rotating grate such that: a first number of the slot-shaped openings are arranged at a first angle and not parallel to an insertion direction of the fuel onto the rotating grate.

According to a further aspect of any of the preceding aspects, a rotating grate for a biomass heating system is provided, wherein: a second number of the slot-shaped openings are arranged at a second angle and not parallel to an insertion direction of the fuel onto the rotating grate.

According to a further embodiment of any of the preceding aspects, a rotating grate for a biomass heating system is provided, wherein: the first angle is greater than 30 degrees and less than 60 degrees; and the second angle is greater than 30 degrees and less than 60 degrees.

According to a further aspect of any of the preceding aspects, a rotating grate for a biomass heating system is provided, wherein: a combustion area of the rotating grate configures a substantially oval or elliptical combustion area; and a fuel insertion direction is equal to a longer central axis of the oval combustion area of the rotating grate.

According to a further development of any of the preceding aspects, there is provided a method for cleaning a rotating grate of a biomass heating system, the rotating grate comprising: at least one rotating grate element; at least one bearing axle by means of which the rotating grate element is rotatably supported; at least one cleaning device attached to one of the rotating grate elements, the cleaning device comprising a mass element movable relative to the rotating grate element; the method comprising the steps of:

Rotating the rotating grate element in a first direction and thus moving the mass element of the cleaning device; initiating an acceleration movement of the mass element; striking the mass element with knocking effect on a striking surface/impact face of either the rotating grate element or the cleaning device for cleaning the rotating grate element.

According to a further embodiment of any of the preceding aspects, there is provided a method for cleaning a rotating grate of a biomass heating system, wherein upon rotation of the rotating grate element to initiate the acceleration motion, the mass element is raised to a drop start position from which the mass element falls under the influence of the acceleration due to gravity to produce the knocking effect on the rotating grate element.

According to a further development of one of the preceding aspects, a method for cleaning a rotating grate of a biomass heating system is provided, wherein upon rotation of the rotating grate element in a first direction and upon rotation of the rotating grate element in a second direction, which is opposite to the first direction, an impact on an impact face is performed, respectively.

The individual effects and advantages of these aspects are apparent from the figure description below and the accompanying drawings.

"Horizontal" in this context may refer to a flat orientation of an axis or a cross-section on the assumption that the boiler is also installed horizontally, whereby the ground level may be the reference, for example. Alternatively, "horizontal" can mean "parallel" to the base plane of the boiler, as this is usually defined. Further alternatively, in particular in the absence of a reference plane, "horizontal" can be understood merely as at least approximately perpendicular to the direction of action of the gravitational force of the earth or acceleration due to gravity.

Although all of the foregoing individual features and details of an aspect of the invention and embodiments of that aspect are described in connection with the biomass heating system, those individual features and details are also disclosed as such independently of the biomass heating system.

BRIEF DESCRIPTION OF THE DRAWINGS

The biomass heating system with the grate according to the invention and the grate according to the invention with the cleaning device(s) are explained in more detail below in embodiment examples and individual aspects based on the figures.

DESCRIPTION OF EXEMPLARY EMBODIMENTS

Figure 1:
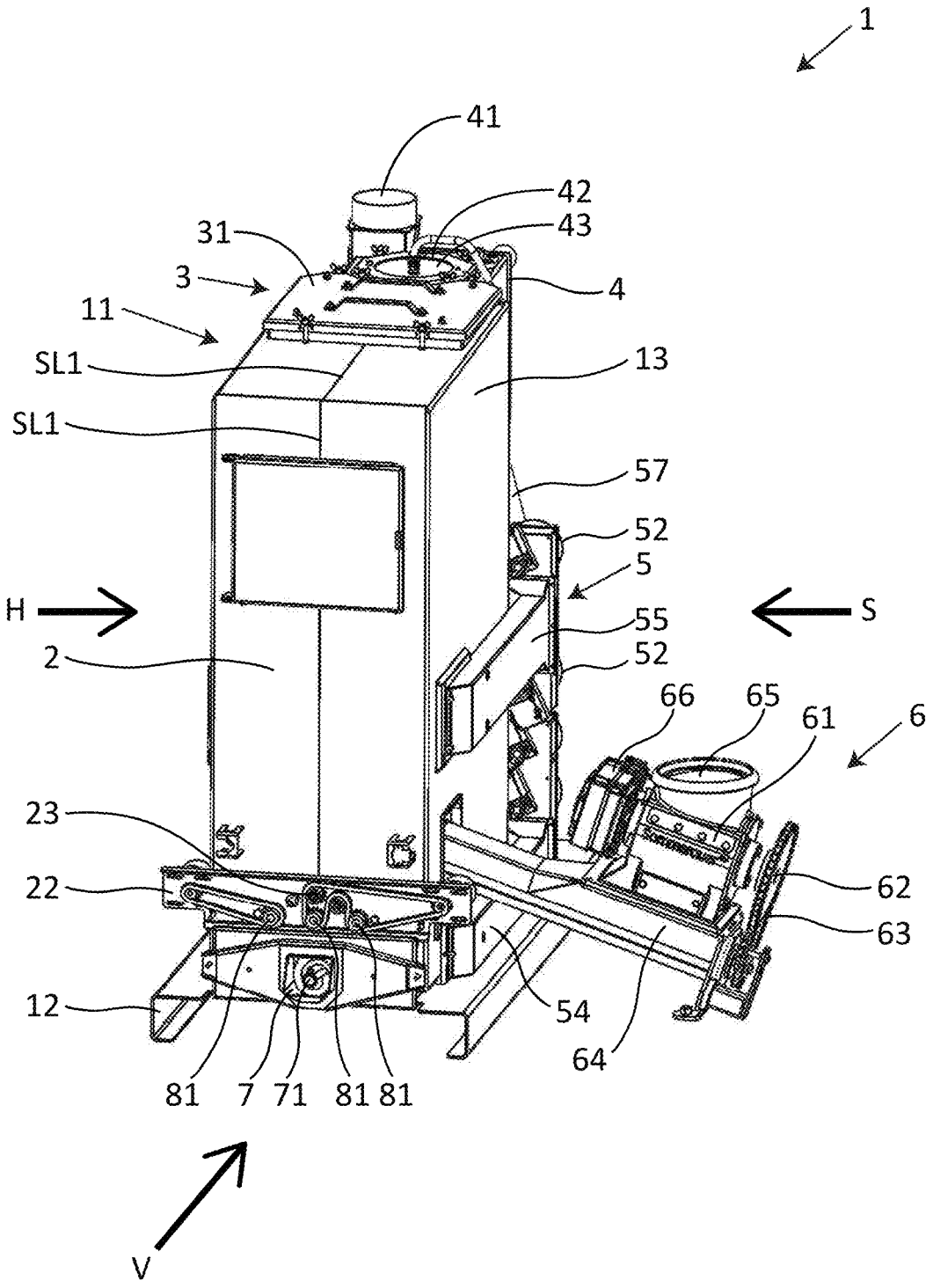
FIG. 1 shows a three-dimensional overview view of a biomass heating system according to one embodiment of the invention.

Various merely exemplary embodiments of the present disclosure are disclosed below with reference to the accompanying drawings. However, embodiments and terms used therein are not intended to limit the present disclosure to particular embodiments and should be construed to include various modifications, equivalents, and/or alternatives in accordance with embodiments of the present disclosure.

Should more general terms be used in the description for features or elements shown in the figures, it is intended that for the person skilled in the art not only the specific feature or element is disclosed in the figures, but also the more general technical teaching.

With reference to the description of the figures the same reference signs may be used in each figure to refer to similar or technically corresponding elements. Furthermore, for the sake of clarity, more elements or features can be shown with reference signs in individual detail or section views than in the overview views. It can be assumed that these elements or features are also disclosed accordingly in the overview presentations, even if they are not explicitly listed there.

It should be understood that a singular form of a noun corresponding to an object may include one or more of the things, unless the context in question clearly indicates otherwise.

In the present disclosure, an expression such as "A or B", "at least one of A or/and B", or "one or more of A or/and B" may include all possible combinations of features listed together. Expressions such as "first," "second," "primary," or "secondary" used herein may represent different elements regardless of their order and/or meaning and do not limit corresponding elements. When it is described that an element (e.g., a first element) is "operably" or "communicatively" coupled or connected to another element (e.g., a second element), the element may be directly connected to the other element or connected to the other element via another element (e.g., a third element).

For example, a term "configured to" (or "set up") used in the present disclosure may be replaced with "suitable for," "adapted to," "made to," "capable of," or "designed to," as technically possible. Alternatively, in a particular situation, an expression "device configured to" or "set up to" may mean that the device can operate in conjunction with another device or component, or perform a corresponding function.

All size specifications, which are given in "mm", are to be understood as a size range of +−1 mm around the specified value, unless another tolerance or other ranges or range limits are explicitly specified.

It should be noted that the present individual aspects, for example, the cleaning device, are disclosed separately from or apart from the biomass heating system herein as individual parts or individual devices. It is thus clear to the person skilled in the art that individual aspects or system parts are also disclosed herein even in isolation. In the present case, the individual aspects or parts of the system are disclosed in particular in the subchapters marked by brackets. It is envisaged that these individual aspects can also be claimed separately.

Further, for the sake of clarity, not all features and elements are individually designated in the figures, especially if they are repeated. Rather, the elements and features are each designated by way of example. Analog or equal elements are then to be understood as such.

(Biomass Heating System)

FIG. 1 shows a three-dimensional overview view of an exemplary biomass heating system 1, which may include the rotating grate 25 according to the invention with a cleaning device 125.

In the figures, the arrow V denotes the front view of the system 1, and the arrow S denotes the side view of the system 1 in the figures.

The biomass heating system 1 has a boiler 11 supported on a boiler base/foot 12. The boiler 11 has a boiler housing 13, for example made of sheet steel.

In the front part of the boiler 11 there is a combustion device 2 (not shown), which can be reached via a first maintenance opening with a shutter 21. A rotary mechanism mount/bracket 22 for a rotating grate 25 (not shown) supports a rotary mechanism 23, which can be used to transmit drive forces to bearing axles 81 of the rotating grate 25.

In the central part of the boiler 11 there is a heat exchanger 3 (not shown), which can be reached from above via a second maintenance opening with a shutter 31.

In the rear of the boiler 11 is an optional filter device 4 (not shown) with an electrode 44 (not shown) suspended by an insulating electrode support/holder 43, which is energized by an electrode supply line 42. The exhaust gas from the biomass heating system 1 is discharged via an exhaust gas outlet 41, which is arranged downstream (fluidically) of the filter device 4. A fan may be provided here.

A recirculation device 5 is provided downstream of boiler 11 to recirculate a portion of the flue or exhaust gas through recirculation ducts 54 and 55 and air valves 52 for reuse in the combustion process. This recirculation device 5 will be explained in detail later with reference to FIGS. 12 to 17.

Further, the biomass heating system 1 has a fuel supply 6 by which the fuel is conveyed in a controlled manner to the combustion device 2 in the primary combustion zone 26 from the side onto the rotating grate 25. The fuel supply 6 has a rotary valve 61 with a fuel supply opening/port 65, the rotary valve 61 having a drive motor 66 with control electronics. An axle 62 driven by the drive motor 66 drives a translation mechanism 63, which can drive a fuel feed screw 67 (not shown) so that fuel is fed to the combustion device 2 in a fuel feed duct 64.

An ash discharge device 7 is provided in the lower part of the biomass heating system 1, which has an ash discharge screw 71/ash removal screw 71 with a transition screw 73 in an ash discharge duct, which is operated by a motor 72.

Figure 2:
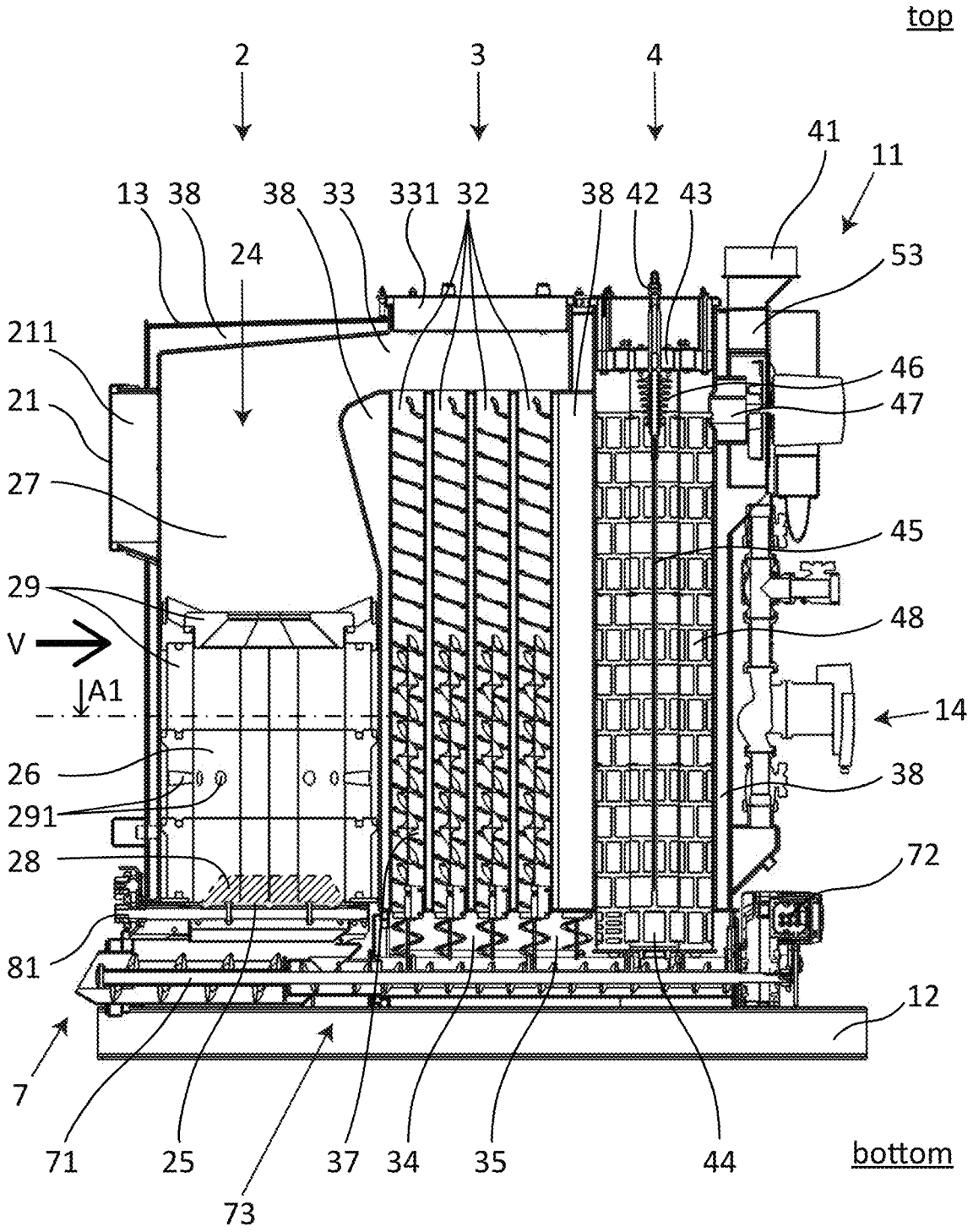
FIG. 2 shows a cross-sectional view through the biomass heating system of FIG. 1, which was made along a section line SL1 and which is shown as viewed from the side view S.

FIG. 2 now shows a cross-sectional view through the biomass heating system 1 of FIG. 1, which has been made along a section line SL1 and which is shown as viewed from the side view S. In the corresponding FIG. 3, which shows the same section as FIG. 2, the flows of the flue gas and fluidic cross-sections are shown schematically for clarity. With regard to FIG. 3, it should be noted that individual areas are shown dimmed in comparison to FIG. 2. This is only for clarity of FIG. 3 and visibility of flow arrows S5, S6 and S7.

From left to right, FIG. 2 shows the combustion device 2, the heat exchanger 3 and an (optional) filter device 4 of the boiler 11. The boiler 11 is supported on the boiler base/foot 12, and has a multi-walled boiler housing 13 in which water or other fluid heat exchange medium can circulate. A water circulation device 14 with pump, valves, pipes, tubes, etc. is provided for supplying and discharging the heat exchange medium.

The combustion device 2 has a combustion chamber 24 in which the combustion process of the fuel takes place in the core. The combustion chamber 24 has a multi-piece rotating grate 25, explained in more detail later, on which the fuel bed 28 rests. The multi-part rotating grate 25 is rotatably mounted by means of a plurality of bearing axles 81.

Figure 3:
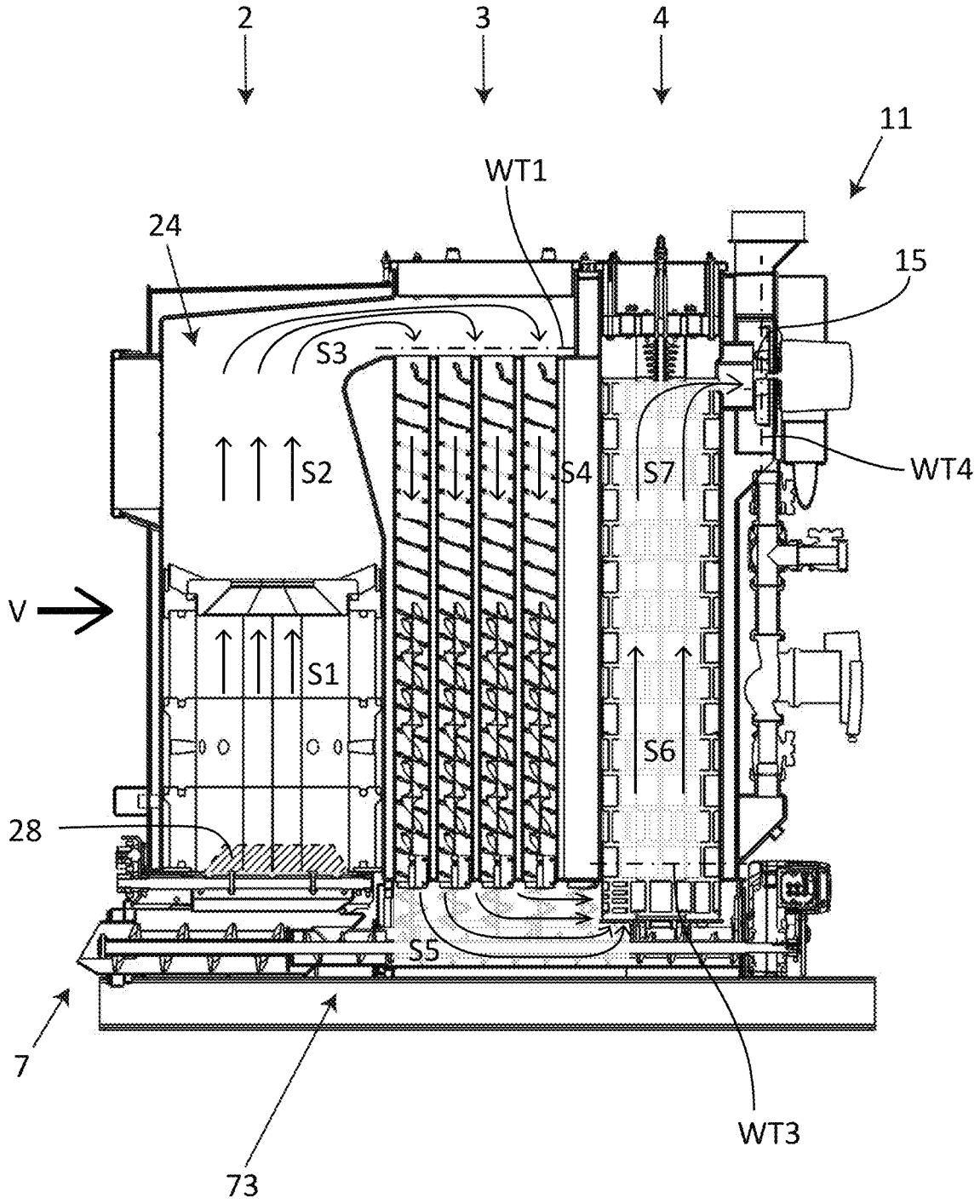
FIG. 3 also shows a cross-sectional view through the biomass heating system of FIG. 1 with a representation of the flow course, the cross-sectional view having been made along a section line SL1 and being shown as viewed from the side view S.

Further referring to FIG. 2, the primary combustion zone 26 of the combustion chamber 24 is enclosed by (a plurality of) combustion chamber brick(s) 29, whereby the combustion chamber bricks 29 define the geometry of the primary combustion zone 26. The cross-section of the primary combustion zone 26 (for example) along the horizontal section line A1 is substantially oval (for example 380 mm+−60 mm×320 mm+−60 mm; it should be noted that some of the above size combinations may also result in a circular cross-section). The arrows S1 of the corresponding FIG. 3 schematically show the primary flow in the primary combustion zone 26, this primary flow also (not shown in more detail) having a swirl to improve the mixing of the flue gas. The combustion chamber bricks 29 form the inner lining of the primary combustion zone 26, store heat and are directly exposed to the fire. Thus, the combustion chamber bricks 29 also protect the other material of the combustion chamber 24, such as cast iron, from direct flame exposure in the combustion chamber 24. The combustion chamber bricks 29 are preferably adapted to the shape of the grate 25. The combustion chamber bricks 29 further include secondary air or recirculation nozzles 291 that recirculate the flue gas into the primary combustion zone 26 for renewed participation in the combustion process. In this regard, the secondary air nozzles or recirculation nozzles 291 are not oriented toward the center of the primary combustion zone 26, but are oriented off-center to create a swirl of flow in the primary combustion zone 26 (i.e., a vortex flow). The combustion chamber bricks 29 will be discussed in more detail later. Insulation 311 is provided at the boiler tube inlet. The oval cross-sectional shape of the primary combustion zone 26 (and the nozzle) advantageously promote the formation of a vortex flow.

A secondary combustion zone 27 adjoins the primary combustion zone 26 of the combustion chamber 24 and defines the radiant portion of the combustion chamber 24. In the radiation section/convection part, the flue gas produced during combustion gives off its thermal energy mainly by thermal radiation, in particular to the heat exchange medium, which is located in the two left chambers for the heat exchange medium 38. The corresponding flue gas flow is indicated by arrows S2 and S3 in FIG. 3. The first maintenance opening 21 is insulated with an insulation material, for example Vermiculite™. The present secondary combustion zone 27 is arranged to ensure burnout of the flue gas. The specific geometric design of the secondary combustion zone 27 will be discussed in more detail later. It should be noted that, from a fluidic point of view, the secondary combustion zone 27 only begins at the level of the corresponding air nozzles. However, in the present case, the secondary combustion zone 27 can also be considered structurally as the entire flowable space above the primary combustion zone 26.

After the secondary combustion zone 27, the flue gas flows via its inlet 33 into the heat exchanger 3, which has a bundle of boiler tubes 32 provided parallel to each other. The flue gas now flows downward in the boiler tubes 32, as indicated by arrows S4 in FIG. 3. This part of the flow can also be referred to as the convection part, since the heat dissipation of the flue gas essentially occurs at the boiler tube walls via forced convection. Due to the temperature gradients caused in the boiler 11 in the heat exchange medium, for example in the water, a natural convection of the water is established, which favors a mixing of the boiler water.

Spring turbulators 36 and spiral or band turbulators 37 are arranged in the boiler tubes 32 to improve the efficiency of the heat exchange device 4.

The outlet of the boiler tubes 32 opens via the reversing/turning chamber inlet 34 resp.

inlet into the turning chamber 35. In this case, the turning chamber 35 is sealed from the combustion chamber 24 in such a way that no flue gas can flow from the turning chamber 35 directly back into the combustion chamber 24. However, a common (discharge) transport path is still provided for the combustion residues that may be generated throughout the flow area of the boiler 11. If the filter device 4 is not provided, the flue gas is discharged upwards again in the boiler 11. The other case of the optional filter device 4 is shown in FIGS. 2 and 3. After the turning chamber 35, the flue gas is fed back upwards into the filter device 4 (see arrows S5), which in this example is an electrostatic filter device 4. Flow baffles can be provided at the inlet 44 of the filter device 4 to homogenize the flue gas flow.

Electrostatic dust collectors, or electrostatic precipitators, are devices for separating particles from gases based on the electrostatic principle. These filter devices are used in particular for the electrical cleaning of exhaust gases. In electrostatic precipitators, dust particles are electrically charged by a corona discharge and drawn to the oppositely charged electrode. The corona discharge takes place on a charged high-voltage electrode suitable for this purpose inside the electrostatic precipitator. The electrode is preferably designed with protruding tips and possibly sharp edges, because the density of the field lines and thus also the electric field strength is greatest there and thus corona discharge is favored. The opposed electrode usually consists of a grounded flue gas or exhaust gas pipe section supported around the electrode. The separation efficiency of an electrostatic precipitator depends in particular on the residence time of the exhaust gases in the filter system and the voltage between the spray electrode and the separation electrode. The rectified high voltage required for this is provided by a high-voltage generation device (not shown). The high-voltage generation system and the holder for the electrode must be protected from dust and contamination to prevent unwanted leakage currents and to extend the service life of system 1.

As shown in FIG. 2, a rod-shaped electrode 45 (which is preferably shaped like an elongated, plate-shaped steel spring) is supported approximately centrally in an approximately chimney-shaped interior of the filter device 4. The electrode 45 is at least substantially made of a high quality spring steel or chromium steel and is supported by an electrode support/holder 43 via a high voltage insulator, i.e., an electrode insulation 46.

The electrode 45 hangs vibrationally downward into the interior of the filter device 4. For example, the electrode 45 may oscillate back and forth transverse to the longitudinal axis of the electrode 45.

A cage 48 serves simultaneously as a counter electrode and a cleaning mechanism for the filter device 4. The cage 48 is connected to the ground or earth potential. The prevailing potential difference filters the flue gas or exhaust gas flowing in the filter device 4, cf. arrows S6, as explained above. In the case of cleaning the filter device 4, the electrode 45 is de-energized. The cage 48 preferably has an octagonal regular cross-sectional profile. The cage 48 can preferably be laser cut during manufacture.

After leaving the heat exchanger 3 (from its outlet), the flue gas flows through the turning chamber 34 into the inlet 44 of the filter device 4.

Here, the (optional) filter device 4 is optionally provided fully integrated in the boiler 11, whereby the wall surface facing the heat exchanger 3 and flushed by the heat exchange medium is also used for heat exchange from the direction of the filter device 4, thus further improving the efficiency of the system 1. This allows at least part of the wall to flush the filter device 4 with the heat exchange medium.

At filter outlet 47, the cleaned exhaust gas flows out of filter device 4 as indicated by arrows S7. After exiting the filter, a portion of the exhaust gas is returned to the primary combustion zone 26 via the recirculation device 5. This will also be explained in more detail later. This exhaust gas or flue gas intended for recirculation can also be referred to as "rezi" or "rezi gas" for short. The remaining part of the exhaust gas is led out of the boiler 11 via the exhaust gas outlet 41.

An ash removal 7/ash discharge 7 is arranged in the lower part of the boiler 11. Via an ash discharge screw 71, the ash falling out of, for example, the combustion chamber 24, the boiler tubes 32 and the filter device 4 is discharged laterally from the boiler 11.

The boiler 11 of this embodiment was calculated using CFD simulations. Further, field experiments were conducted to confirm the CFD simulations. The starting point for the considerations were calculations for a 100 kW boiler, but a power range from 20 to 500 kW was taken into account.

A CFD simulation (CFD=Computational Fluid Dynamics) is the spatially and temporally resolved simulation of flow and heat conduction processes. The flow processes may be laminar and/or turbulent, may occur accompanied by chemical reactions, or may be a multiphase system. CFD simulations are thus well suited as a design and optimization tool. In the present invention, CDF simulations have been used to optimize the fluidic parameters in such a way that the above tasks of the invention are solved. In particular, as a result, the mechanical design and dimensioning of the boiler 11 were largely defined by the CFD simulation and also by associated practical experiments. The simulation results are based on a flow simulation with consideration of heat transfer.

The above components of the biomass heating system 1 and boiler 11 that are the result of the CFD simulations are described in more detail below.

(Combustion Chamber)

The following explanations on the design of the combustion chamber shape describe by way of example where the grate according to the invention can be used. The combustion chamber shape or geometry should achieve the best possible turbulent mixing and homogenization of the flow over the cross-section of the flue gas duct, a minimization of the firing volume, a reduction of the excess air and the recirculation ratio (efficiency, operating costs), a reduction of CO emissions and NOx emissions, a reduction of temperature peaks (fouling and slagging), and a reduction of flue gas velocity peaks (material stress and erosion).

Figure 4:
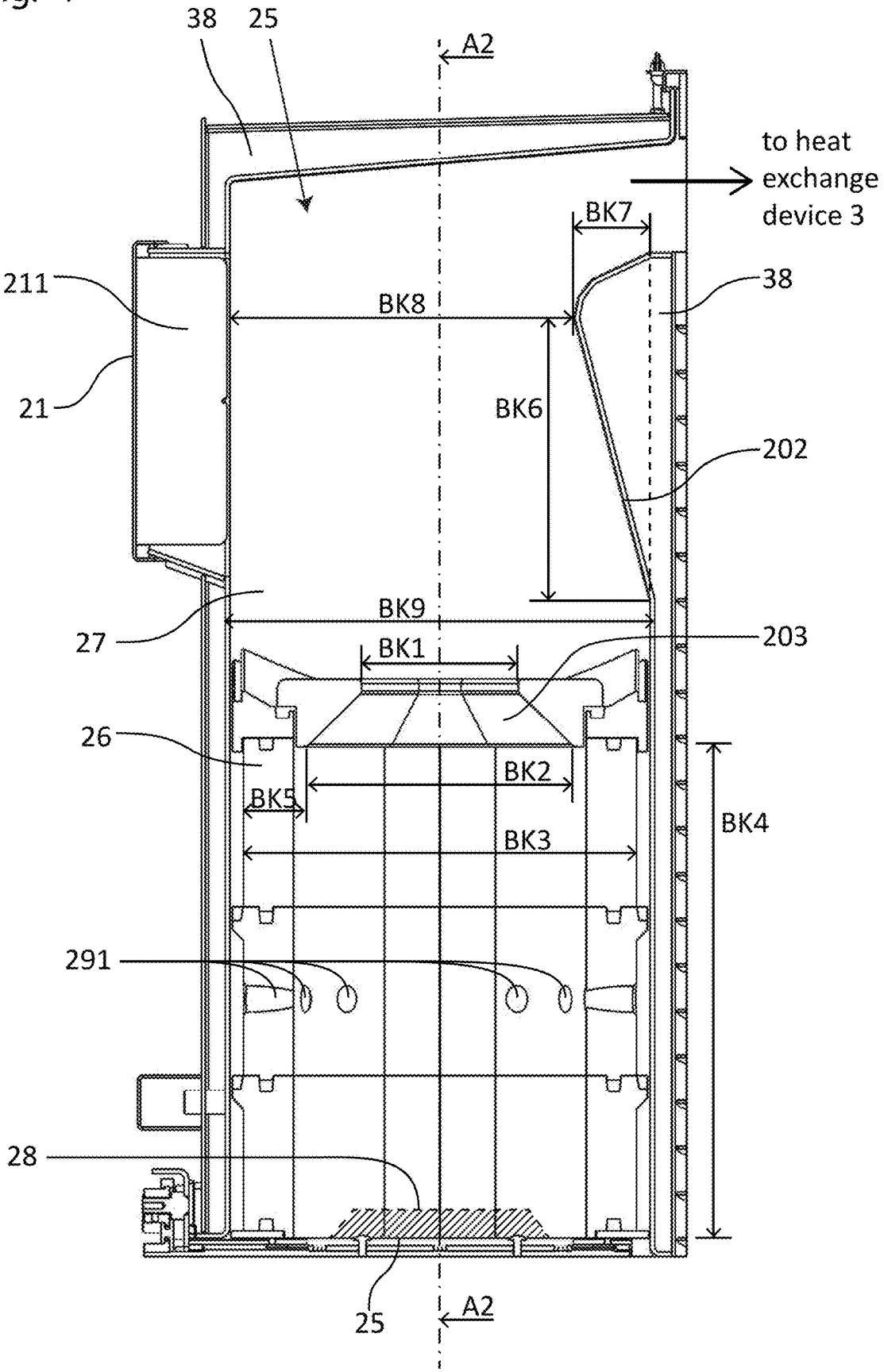
FIG. 4 shows a partial view of FIG. 2, depicting a combustion chamber geometry of the boiler of FIG. 2 and FIG. 3.
Figure 5:
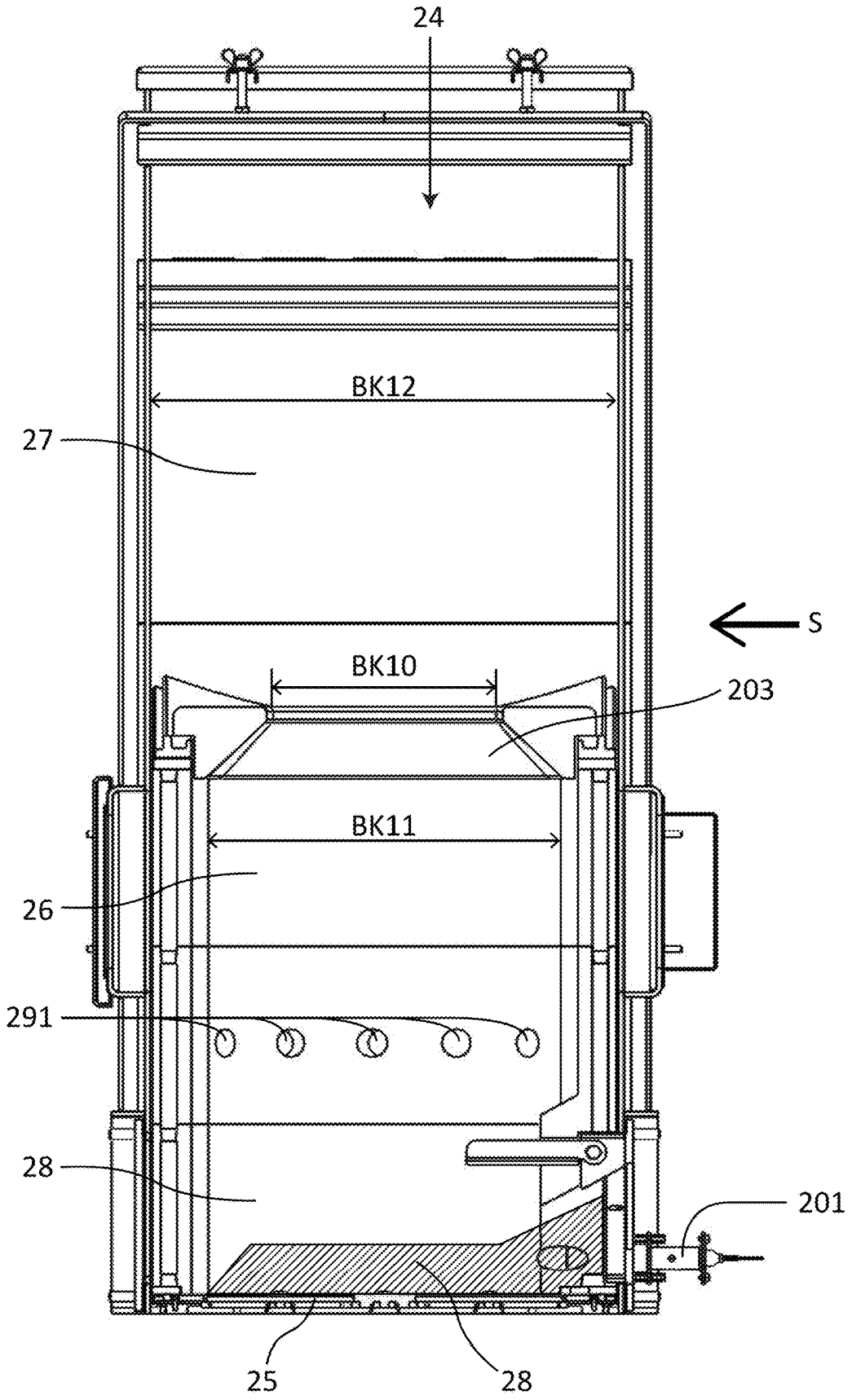
FIG. 5 shows a sectional view through the boiler or the combustion chamber of the boiler along the vertical section line A2 of FIG. 4.

FIG. 4, which is a partial view of FIG. 2, and FIG. 5, which is a sectional view through boiler 11 along vertical section line A2, depict a combustion chamber geometry that meets the aforementioned requirements for biomass heating systems over a wide power range of, for example, 20 to 500 kW.

The details of the dimensions given in FIGS. 3 and 4 and determined via CFD calculations and field experiments are as follows:

BK1=172 mm+−40 mm, preferably +−17 mm;

BK2=300 mm+−50 mm, preferably +−30 mm;

BK3=430 mm+−80 mm, preferably +−40 mm;

BK4=538 mm+−80 mm, preferably +−50 mm;

BK5=(BK3−BK2)/2=e.g. 65 mm+−30 mm, preferably +−20 mm;

BK6=307 mm+−50 mm, preferably +−20 mm;
BK7=82 mm+−20 mm, preferably +−20 mm;
BK8=379 mm+−40 mm, preferably +−20 mm;
BK9=470 mm+−50 mm, preferably +−20 mm;
BK10=232 mm+−40 mm, preferably +−20 mm;
BK11=380 mm+−60 mm, preferably +−30 mm;
BK12=460 mm+−80 mm, preferably +−30 mm.

However, these dimensions are merely exemplary, and serve to clarify the present technical teaching.

With these values, both the geometries of the primary combustion zone 26 and the secondary combustion zone 27 of the combustion chamber 24 can be optimized for a 100 kW boiler 11. The specified size ranges are ranges with which the requirements are just as (approximately) fulfilled as with the specified exact values.

Preferably, a chamber geometry of the primary combustion zone 26 of the combustion chamber 24 (or an internal volume of the primary combustion zone 26 of the combustion chamber 24) may be defined based on the following basic parameters:

A volume having an oval horizontal base with dimensions of 380 mm+−60 mm (preferably +−30 mm)×320 mm+−60 mm (preferably +−30 mm), and a height of 538 mm+−80 mm (preferably +−50 mm).

As an extension of this, the volume defined above may have an upper opening in the form of a combustion chamber nozzle 203 opening into the secondary combustion zone 27 of the combustion chamber 24, which has a combustion chamber slope 202 projecting into the secondary combustion zone 27, which preferably contains the heat exchange medium 38. The combustion chamber slope 202 reduces the cross-sectional area of the secondary combustion zone 27 by at least 5%, preferably by at least 15%, and even more preferably by at least 19%.

The combustion chamber slope 202 serves to homogenize the flow S3 in the direction of the heat exchanger 3 and thus the flow into the boiler tubes 32.

In the prior art, there are often combustion chambers with rectangular or polygonal combustion chamber and nozzle, but the irregular shape of the combustion chamber and nozzle is another obstacle to uniform air distribution and good mixing of air and fuel, as recognized herein.

Therefore, in the present case, combustion chamber 24 is provided without dead corners or dead edges.

Thus, it was recognized that the geometry of the combustion chamber (and of the entire flow path in the boiler) plays a significant role in the considerations for optimizing the biomass heating system 1. Therefore, the basic oval or round geometry without dead corners described herein was chosen (in a departure from the usual rectangular or polygonal shapes). In addition, this basic geometry of the combustion chamber and its design have also been optimized with the dimensions/dimension ranges given above. These dimensions/dimension ranges are selected in such a way that, in particular, different fuels (wood chips and pellets) with different quality (for example, with different water content) can be burned with very high efficiency. This is what the field tests and CFD simulations have shown.

In particular, the primary combustion zone 26 of the combustion chamber 24 may comprise a volume that preferably has an oval or approximately circular horizontal cross-section in its outer periphery (such a cross-section is exemplified by A1 in FIG. 2). This horizontal cross-section may further preferably represent the footprint of the primary combustion zone 26 of the combustion chamber 24. Over the height indicated by the double arrow BK4, the combustion chamber 24 may have an approximately constant cross-section. In this respect, the primary combustion zone 24 may have an approximately oval-cylindrical volume. Preferably, the side walls and the base surface (grate) of the primary combustion zone 26 may be perpendicular to each other.

The term "approximate" is used above because individual notches, deviations due to design or small asymmetries may of course be present, for example at the transitions of the individual combustion chamber bricks 29 to one another. However, these minor deviations play only a minor role in terms of flow.

The horizontal cross-section of the combustion chamber 24 and, in particular, of the primary combustion zone 26 of the combustion chamber 24 may likewise preferably be of regular design. Further, the horizontal cross-section of the combustion chamber 24 and in particular the primary combustion zone 26 of the combustion chamber 24 may preferably be a regular (and/or symmetrical) ellipse.

In addition, the horizontal cross-section (the outer circumference) of the primary combustion zone 26 can be designed to be constant over a predetermined height, for example 20 cm) thereof.

Thus, in the present case, an oval-cylindrical primary combustion zone 26 of the combustion chamber 24 is provided, which, according to CFD calculations, enables a much more uniform and better air distribution in the combustion chamber 24 than in rectangular combustion chambers of the prior art. The lack of dead spaces also avoids zones in the combustion chamber with poor air flow, which increases efficiency and reduces slag formation.

Similarly, the nozzle 203 between the primary combustion zone 26 and the secondary combustion zone 27 is designed as an oval or approximately circular constriction to likewise optimize the flow conditions. The swirl of the flow in the primary combustion zone 26 explained above leads to an upward helical flow pattern, whereby an equally oval or approximately circular nozzle favors this flow pattern, and does not interfere with it as do conventional rectangular nozzles. This optimized nozzle 203 focuses the air flowing upward and provides a uniform inflow into the secondary combustion zone 27. This improves the combustion process and increases efficiency.

In addition, the flow pattern in the secondary combustion zone 27 and from the secondary combustion zone 27 to the boiler tubes 32 is optimized in the present case, as explained in more detail below.

According to CFD calculations, the combustion chamber slope 202 of FIG. 4, which can also be seen without reference signs in FIGS. 2 and 3 and at which the combustion chamber 25 (or its cross-section) tapers at least approximately linearly from the bottom to the top, ensures a uniformity of the flue gas flow in the direction of the heat exchanger 4, which can improve its efficiency. Here, the horizontal cross-sectional area of the combustion chamber 25 preferably tapers by at least 5% from the beginning to the end of the combustion chamber slope 202. In this case, the combustion chamber slope 202 is provided on the side of the combustion chamber 25 facing the heat exchange device 4, and is provided rounded at the point of maximum taper. In the state of the art, parallel or straight combustion chamber walls without a taper (so as not to obstruct the flow of flue gas) are common.

The redirection of the flue gas flow upstream of the shell-and-tube heat exchanger is designed in such a way that uneven inflow into the tubes is avoided as far as possible, which means that temperature peaks in individual boiler tubes 32 can be kept low. As a result, the efficiency of the heat exchange device 4 is improved.

In detail, the gaseous volume flow of the flue gas is guided through the inclined combustion chamber wall at a uniform velocity (even in the case of different combustion conditions) to the heat exchanger tubes or the boiler tubes 32. This results in uniform heat distribution of the individual boiler tubes 32 heat exchanger surfaces concerned. The exhaust gas temperature is thus lowered and the efficiency increased. The flow distribution, in particular at the indicator line WT1 shown in FIG. 3, is significantly more uniform than in the prior art. The line WT1 represents an inlet surface for the heat exchanger 3. The indicator line WT3 indicates an exemplary cross-sectional line through the filter device 4 in which the flow is set up as homogeneously as possible (due, among other things, to flow baffles at the entrance to the filter device 4 and due to the geometry of the turning chamber 35).

Further, an ignition device 201 is provided in the lower part of the combustion chamber 25 at the fuel bed 28. This can cause initial ignition or re-ignition of the fuel. It can be the ignition device 201 a glow igniter. The ignition device is advantageously stationary and horizontally offset laterally to the place where the fuel is poured in.

Furthermore, a lambda probe (not shown) can (optionally) be provided after the outlet of the flue gas (i.e. after S7) from the filter device. The lambda sensor enables a controller (not shown) to detect the respective heating value. The lambda sensor can thus ensure the ideal mixing ratio between the fuels and the oxygen supply. Despite different fuel qualities, high efficiency and higher efficiency are achieved as a result.

The fuel bed 28 shown in FIG. 5 illustrates an exemplary fuel distribution due to the fuel being fed from the right side of FIG. 5. This fuel bed 28 is flowed from below with a flue gas-fresh air mixture provided by the recirculation device 5. This flue gas/fresh air mixture is advantageously pre-tempered and has the ideal quantity (mass flow) and the ideal mixing ratio, as regulated by a plant control system not shown in more detail on the basis of various measured values detected by sensors and associated air valves 52.

Further shown in FIGS. 4 and 5 is a combustion chamber nozzle 203 that separates the primary combustion zone 26 from the secondary combustion zone 27 and accelerates and focuses the flue gas flow. As a result, the flue gas flow is better mixed and can burn more efficiently in the secondary combustion zone 27. The area ratio of the combustion chamber nozzle 203 is in the range of 25% to 45%, but is preferably 30% to 40%, and is ideally 36%+−1% (ratio of measured input area to measured output area of nozzle 203).

Consequently, the foregoing details concerning the combustion chamber geometry of the primary combustion zone 26, together with the geometry of the nozzle 203, constitute an advantageous further embodiment of the present disclosure.

(Combustion Chamber Bricks)

Figure 6:
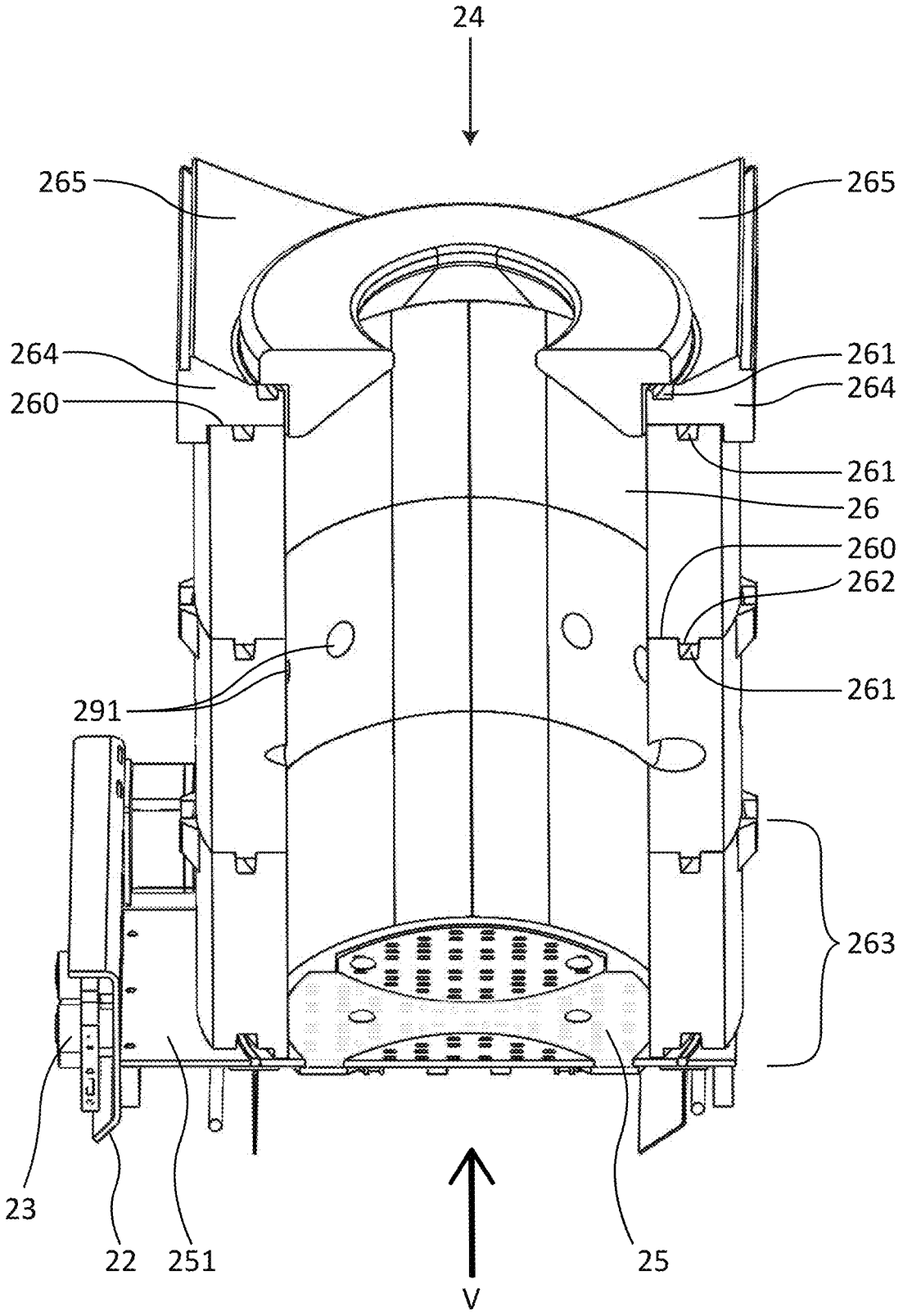
FIG. 6 shows a three-dimensional sectional view of the primary combustion zone of the combustion chamber with the rotating grate of FIG. 4.
Figure 7:
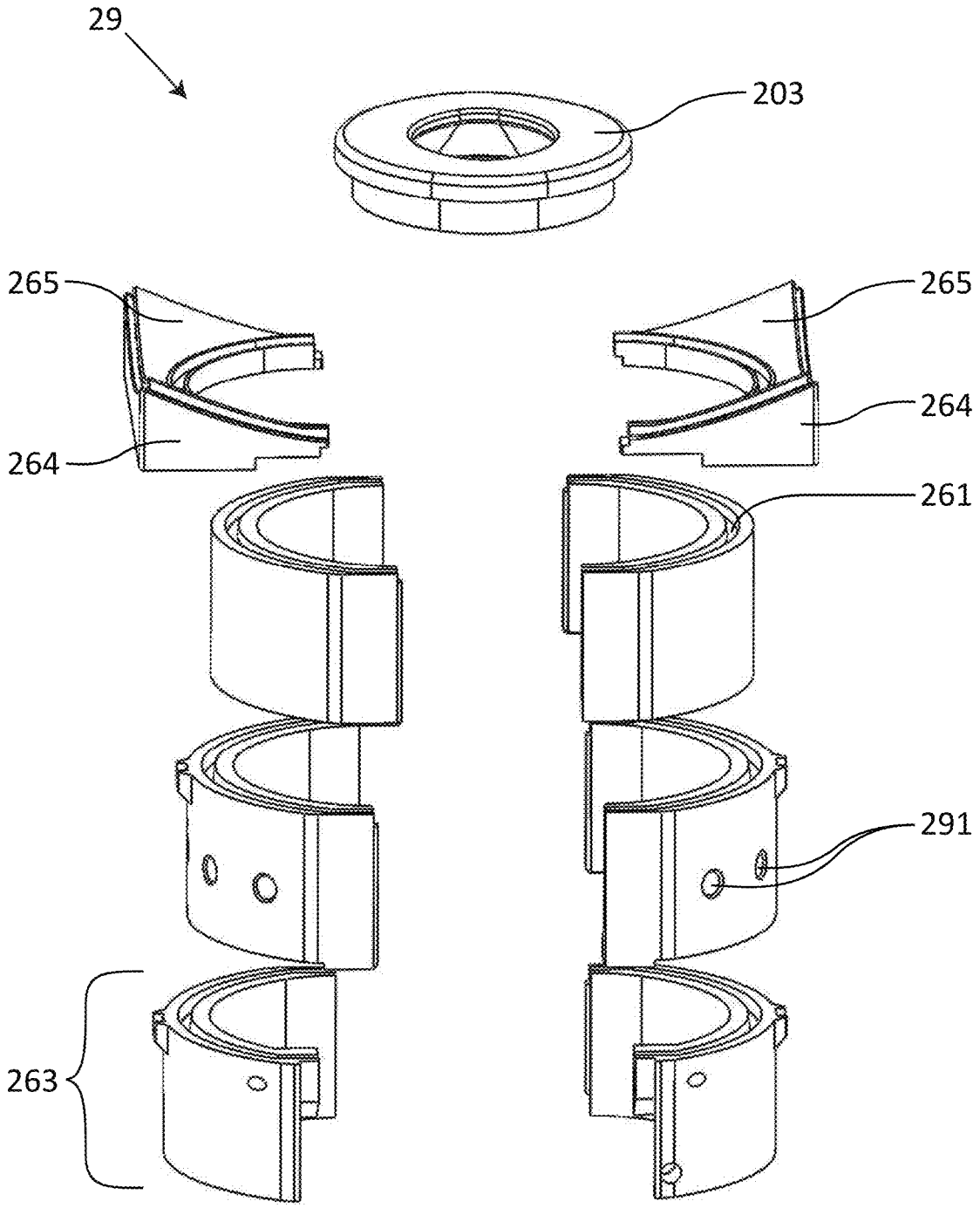
FIG. 7 shows an exploded view of the combustion chamber bricks as in FIG. 6.

FIG. 6 shows a three-dimensional sectional view (from diagonally above) of the primary combustion zone 26 of the combustion chamber 24 with the rotating grate 25, and in particular of the special design of the combustion chamber bricks 29. FIG. 7 shows an exploded view of the combustion chamber bricks 29 corresponding to FIG. 6. The views of FIGS. 6 and 7 can preferably be designed with the dimensions of FIGS. 4 and 5 listed above. However, this is not necessarily the case.

The chamber wall of the primary combustion zone 26 of the combustion chamber 24 is provided with a plurality of combustion chamber bricks 29 in a modular construction, which facilitates, among other things, fabrication and maintenance. Maintenance is facilitated in particular by the possibility of removing individual combustion chamber bricks 29.

Positive-locking grooves 261 and projections 262 (in FIG. 6, to avoid redundancy, only a few of these are designated in each of the figures by way of example) are provided on the bearing surfaces/support surfaces 260 of the combustion chamber bricks 29 to create a mechanical and largely airtight connection, again to prevent the ingress of disruptive foreign air. Preferably, two at least largely symmetrical combustion chamber bricks each (with the possible exception of the openings for the rezi gas) form a complete ring. Further, three rings are preferably stacked on top of each other to form the oval-cylindrical or alternatively at least approximately circular (the latter is not shown) primary combustion zone 26 of the combustion chamber 24.

Three further combustion chamber bricks 29 are provided as the upper end, with the annular nozzle 203 being supported by two retaining bricks 264, which are positively fitted onto the upper ring 263. Grooves 261 are provided on all support surfaces 260 either for suitable projections 262 and/or for insertion of suitable sealing material.

The mounting blocks 264, which are preferably symmetrical, may preferably have an inwardly inclined slope 265 to facilitate sweeping of fly ash onto the rotating grate 25.

The lower ring 263 of the combustion chamber bricks 29 rests on a bottom plate 251 of the rotating grate 25. Ash is increasingly deposited on the inner edge between this lower ring 263 of the combustion chamber bricks 29, which thus advantageously seals this transition independently and advantageously during operation of the biomass heating system 1.

The (optional) openings for the recirculation nozzles 291 are provided in the center ring of the combustion chamber bricks 29.

Presently, three rings of combustion chamber bricks 29 are provided as this is the most efficient way of manufacturing and also maintenance. Alternatively, two, four or five (2, 4 or 5) such rings may be provided.

The combustion chamber bricks 29 are preferably made of high-temperature silicon carbide, which makes them highly wear-resistant.

The combustion chamber bricks 29 are provided as shaped bricks. The combustion chamber bricks 29 are shaped in such a way that the inner volume of the primary combustion zone 26 of the combustion chamber 24 has an oval horizontal cross-section, thus avoiding dead spots or dead spaces through which the primary air does not normally flow optimally, as a result of which the fuel present there is not optimally burned, by means of an ergonomic shape. Due to the present shape of the combustion chamber bricks 29, the flow of primary air and consequently the efficiency of combustion is improved.

The oval horizontal cross-section of the primary combustion zone 26 of the combustion chamber 24 is preferably a point-symmetrical and/or regular oval with the smallest inner diameter BK3 and the largest inner diameter BK11. These dimensions were the result of optimizing the primary combustion zone 26 of the combustion chamber 24 using CFD simulation and practical tests.

(Rotating Grate)

Figure 8:
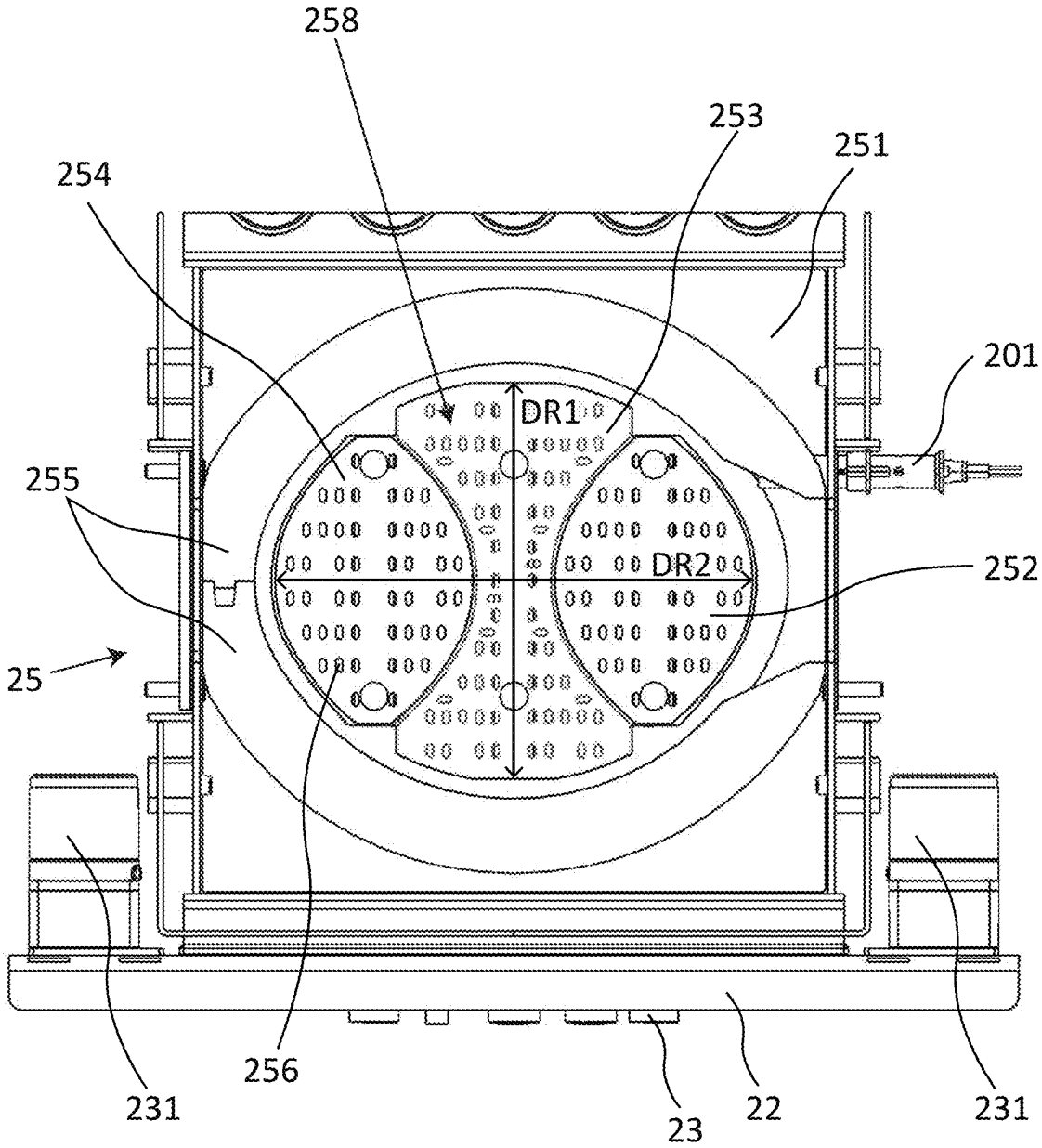
FIG. 8 shows a top view of the rotating grate with rotating grate elements as seen from section line A1 of FIG. 2.

FIG. 8 shows a top view of the rotating grate 25 as seen from the section line A1 of FIG. 2 to illustrate various fundamentally possible operating states of the rotating grate 25.

The top view of FIG. 8 can preferably be designed with the dimensions listed above. However, this is not necessarily the case.

The rotating grate 25 has the bottom plate 251 as a base element. A transition element 255 is provided in a roughly oval-shaped opening of the bottom plate 251 to bridge a gap between a first rotating grate element 252, a second rotating grate element 253, and a third rotating grate element 254, which are rotatably supported. Thus, the rotating grate 25 is provided as a rotating grate with three individual elements, i.e. this can also be referred to as a 3-fold rotating grate. Air holes are provided in the rotating grate elements 252, 253 and 254 for primary air to flow through.

The rotating grate elements 252, 253 and 254 are flat and heat-resistant metal plates, for example made of a metal casting, which have an at least largely flat configured surface on their upper side and are connected on their underside to the bearing axles 81, for example via intermediate support elements. When viewed from above, the rotating grate elements 252, 253, and 254 have curved and complementary sides or outlines.

In particular, the rotating grate elements 252, 253, 254 may have mutually complementary and curved sides, preferably the second rotating grate element 253 having respective sides concave to the adjacent first and third rotating grate elements 252, 254, and preferably the first and third rotating grate elements 252, 254 having respective sides convex to the second rotating grate element 253. This improves the crushing function of the rotating grate elements, since the length of the fracture is increased and the forces acting for crushing (similar to scissors) act in a more targeted manner.

The rotating grate elements 252, 253 and 254 (as well as their enclosure in the form of the transition element 255) have an approximately oval outer shape when viewed together in plan view, which again avoids dead corners or dead spaces here in which less than optimal combustion could take place or ash could accumulate undesirably. The optimum dimensions of this outer shape of the rotating grate elements 252, 253 and 254 are indicated by the double arrows DR1 and DR2 in FIG. 8. Preferably, but not exclusively, DR1 and DR2 are defined as follows:

DR1=288 mm+−40 mm, preferably +−20 mm

DR2=350 mm+−60 mm, preferably +−20 mm

These values turned out to be the optimum values (ranges) during the CFD simulations and the following practical test. These dimensions correspond to those of FIGS. 4 and 5. These dimensions are particularly advantageous for the combustion of different fuels or the fuel types wood chips and pellets (hybrid firing) in a power range from 20 to 200 kW.

In this regard, the rotating grate 25 has an oval combustion area 258 that is more favorable for fuel distribution, fuel air flow, and fuel burnup than a conventional rectangular combustion area. The combustion area 258 is formed in the core by the surfaces of the rotating grate elements 252, 253 and 254 (in the horizontal state). Thus, the combustion area is the upward facing surface of the rotating grate elements 252, 253, and 254. This oval combustion area advantageously corresponds to the fuel support surface when the fuel is applied or pushed onto the side of the rotating grate 25 (cf. the arrow E of FIGS. 9, 10 and 11). In particular, fuel may be supplied from a direction parallel to a longer central axis (major axis) of the oval combustion area of the rotating grate 25.

The first rotating grate element 252 and the third rotating grate element 254 may preferably be identical in their combustion areas 258. Further, the first rotating grate element 252 and the third rotating grate element 254 may be identical or identical in construction to each other. This can be seen, for example, in FIG. 9, where the first rotating grate element 252 and the third rotating grate element 254 have the same shape.

Further, the second rotating grate element 253 is disposed between the first rotating grate element 252 and the third rotating grate element 254.

Preferably, the rotating grate 25 is provided with an approximately point-symmetrical oval combustion area 258.

Similarly, the rotating grate 25 may form an approximately elliptical or oval combustion area 258, where DR2 are the dimensions of its major axis and DR1 are the dimensions of its minor axis.

Further, the rotating grate 25 may have an approximately oval combustion area 258 that is axisymmetric with respect to a central axis of the combustion area 258.

Further, the rotating grate 25 may have an approximately circular combustion area 258, although this entails minor disadvantages in fuel feed and distribution.

Further, two motors or drives 231 of the rotating mechanism 23 are provided to rotate the rotating grate elements 252, 253 and 254 accordingly. More details of the particular function and advantages of the present rotating grate 25 will be described later with reference to FIGS. 9, 10 and 11.

Particularly in the case of pellet heating systems, failures can increasingly occur due to slag formation in the combustion chamber 24, especially on the rotating grate 25. Slag is formed during a combustion process whenever temperatures above the ash melting point are reached in the embers. The ash then softens, sticks together, and after cooling forms solid, dark-colored slag. This process, also known as sintering, is undesirable in the biomass heating system 1 because the accumulation of slag in the combustion chamber 24 can cause it to malfunction: it shuts down. The combustion chamber 24 must usually be opened and the slag must be removed.

The ash melting point depends to a large extent on the fuel used. Spruce wood, for example, has an ash melting point of approx. 1200° C. However, the ash melting point of a fuel can also be subject to strong fluctuations. Depending on the amount and composition of the minerals contained in the wood, the behavior of the ash in the combustion process changes.

Another factor that can influence the formation of slag is the transport and storage of the wood pellets or chips. These should namely enter the combustion chamber 24 as undamaged as possible. If the wood pellets are already crumbled when they enter the combustion process, this increases the density of the glow bed. Greater slag formation is the result. In particular, the transport from the storage room to the combustion chamber 24 is of importance here. Especially long ways, as well as bends and angles, cause damage to the wood pellets. Thus, one problem is that slag formation cannot be completely avoided due to the multitude of influencing factors described above.

Another factor concerns the management of the combustion process. Until now, the aim has been to keep temperatures rather high in order to achieve the highest possible burnout and low emissions. By optimizing the combustion chamber geometry and the geometry of the combustion zone 258 of the rotating grate 25, it is possible to keep the combustion temperature lower, thus reducing slag formation.

In addition, resulting slag (and also ash) can be advantageously removed due to the particular shape and functionality of the present rotating grate 25. This will now be explained in more detail with reference to FIGS. 9, 10 and 11.

Figure 9:
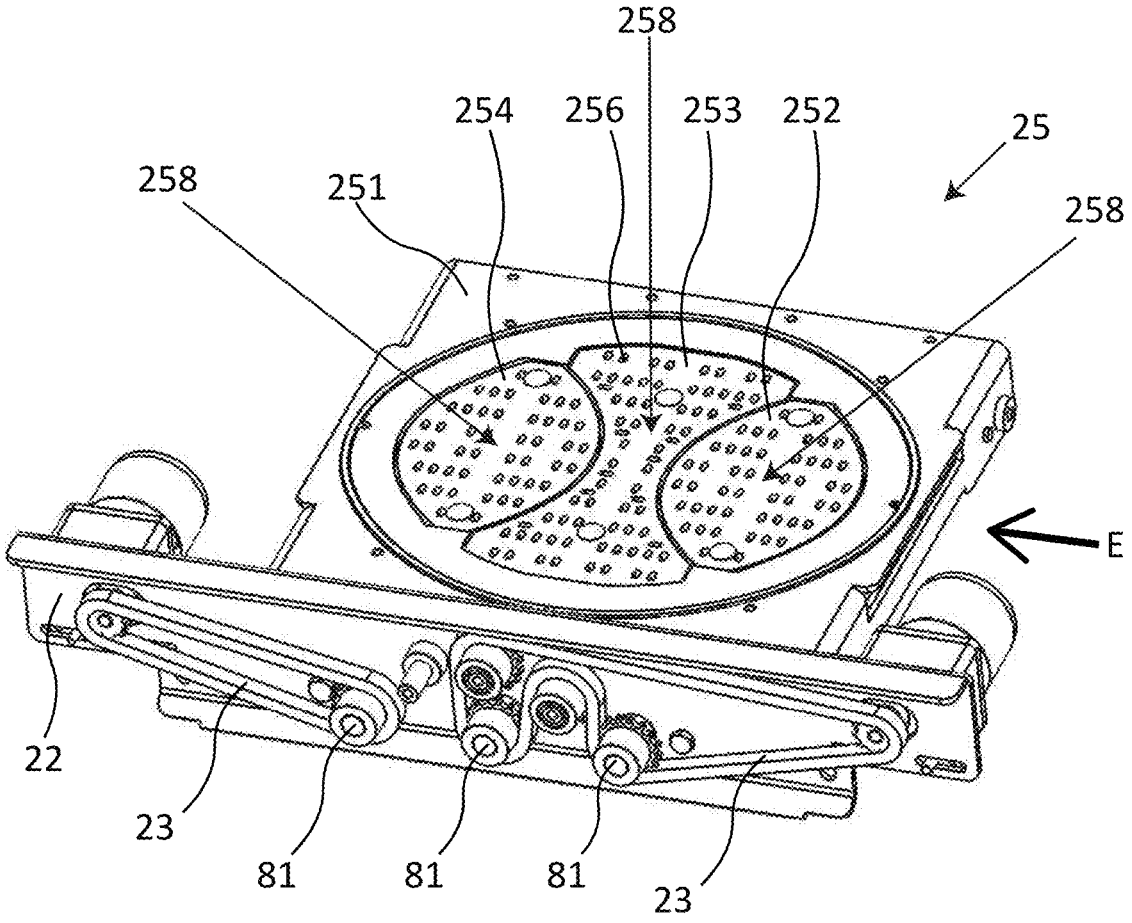
FIG. 9 shows the rotating grate of FIG. 2 in closed position, with all rotating grate elements horizontally aligned or closed.
Figure 10:
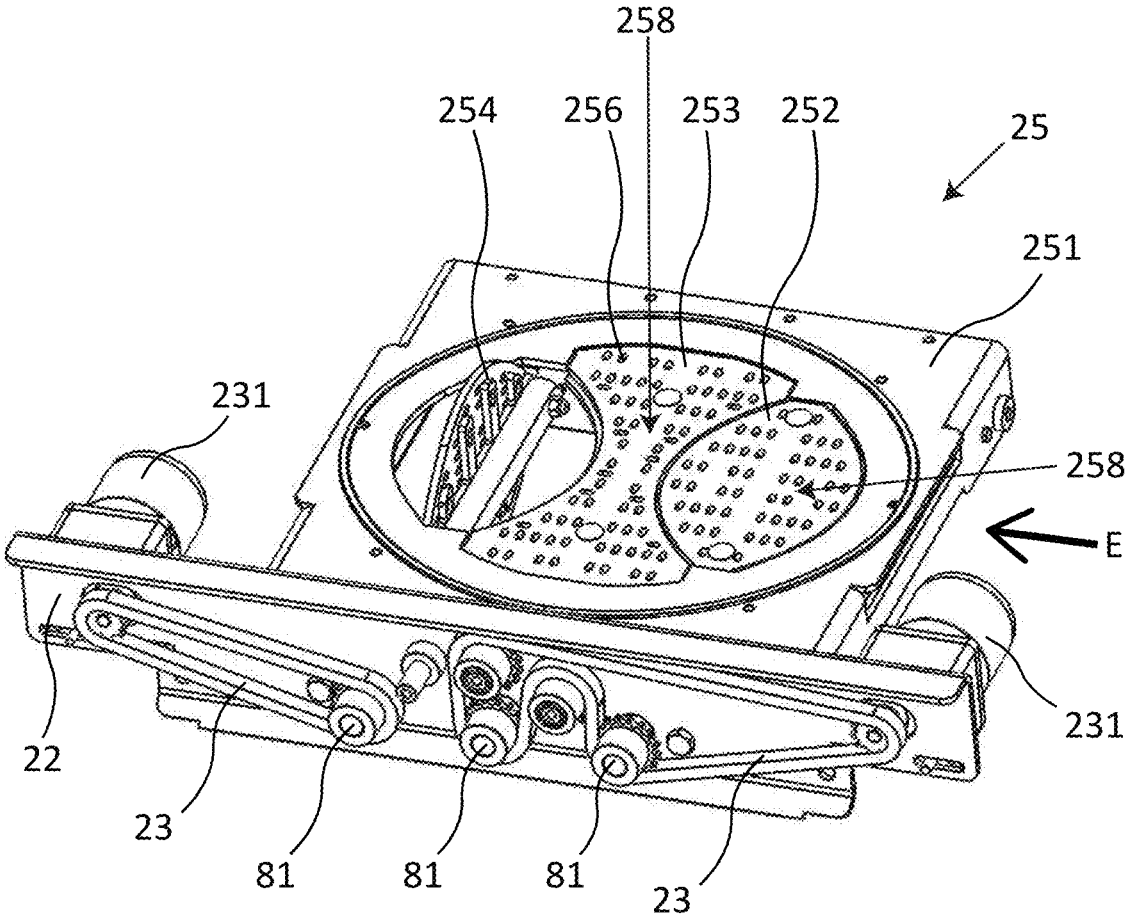
FIG. 10 shows the rotating grate of FIG. 9 in the state of partial cleaning of the rotating grate in glow maintenance mode.
Figure 11:
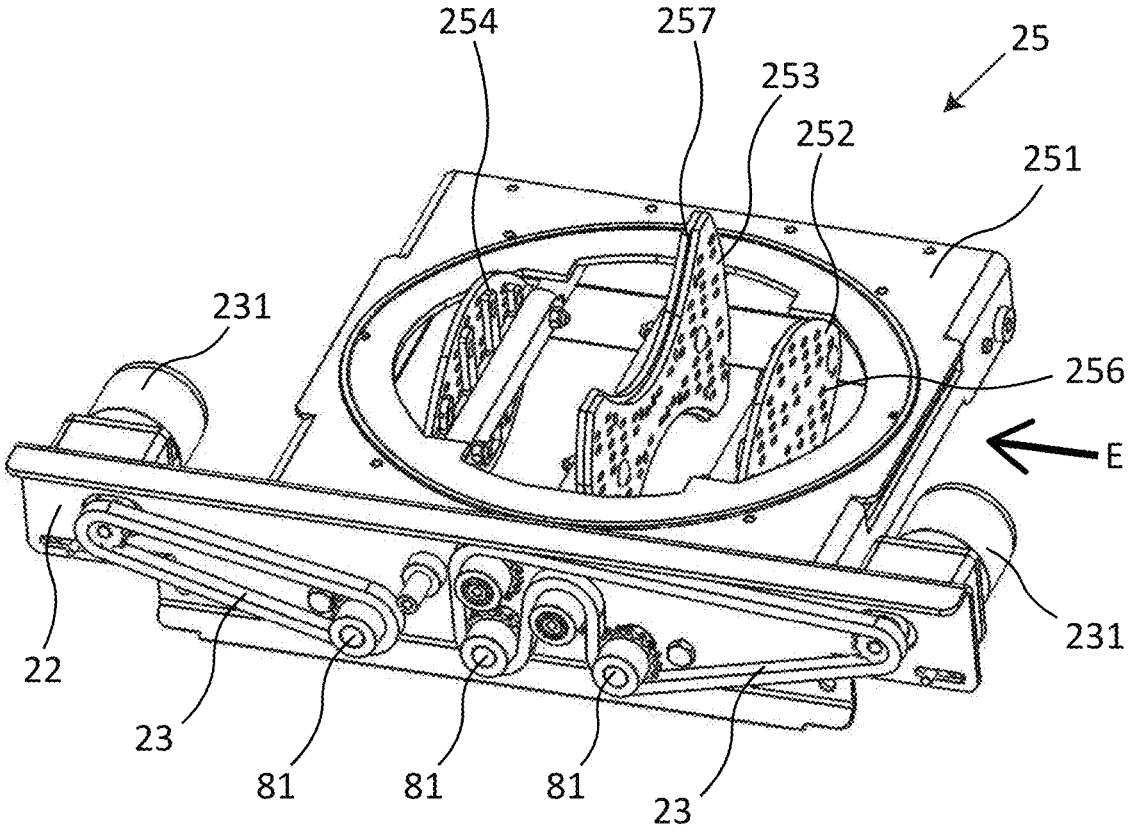
FIG. 11 shows the rotating grate of FIG. 9 in the state of universal cleaning, which is preferably carried out during a system shutdown.

FIGS. 9, 10, and 11 show a three-dimensional view of the rotating grate 25 including the bottom plate 251, the first rotating grate element 252, the second rotating grate element 253, and the third rotating grate element 254. The views of FIGS. 9, 10 and 11 can preferably correspond to the dimensions given above. However, this is not necessarily the case.

This view shows the rotating grate 25 as an exposed slide-in component with rotating grate mechanism 23 and drive(s) 231. The rotating grate 25 is mechanically provided in such a way that it can be individually prefabricated in the manner of a modular system, and can be inserted and installed as a slide-in part in a provided elongated opening of the boiler 11. This also facilitates the maintenance of this wear-prone part. In this way, the rotating grate 25 can preferably be of modular design, whereby it can be quickly and efficiently removed and reinserted as a complete part with rotating grate mechanism 23 and drive 231. The modularized rotating grate 25 can thus also be assembled and disassembled by means of quick-release fasteners. In contrast, state of the art rotating grates are regularly fixed, and thus difficult to maintain or install.

The drive 231 may include two separately controllable electric motors. These are preferably provided on the side of the rotating grate mechanism 23. The electric motors can have reduction gears. Further, end stop switches may be provided to provide end stops respectively for the end positions of the rotating grate elements 252, 253 and 254.

The individual components of the rotating grate mechanism 23 are designed to be interchangeable. For example, the gears are designed to be attachable. This facilitates maintenance and also a side change of the mechanics during assembly, if necessary.

The aforementioned openings 256 are provided in the rotating grate elements 252, 253 and 254 of the rotating grate 25. The rotating grate elements 252, 253 and 254 can be rotated about the respective bearing or rotation axles 81 by at least 90 degrees, preferably by at least 120 degrees, even more preferably by 170 degrees, via their respective bearing axes 81, which are driven via the rotary mechanism 23 by the drive 231, presently the two motors 231. Here, the maximum angle of rotation may be 180 degrees or slightly less than 180 degrees, as permitted by the grate lips 257. Likewise, free rotation through 360 degrees is conceivable if no rotation-limiting grate lips are provided. In this regard, the rotating mechanism 23 is arranged such that the third rotating grate element 254 can be rotated individually and independently of the first rotating grate element 252 and the second rotating grate element 243, and such that the first rotating grate element 252 and the second rotating grate element 243 can be rotated together and independently of the third rotating grate element 254. The rotating mechanism 23 may be provided accordingly, for example, by means of impellers, toothed or drive belts, and/or gears.

The rotating grate elements 252, 253 and 254 can preferably be manufactured as a cast grate with a laser cut to ensure accurate shape retention. This is particularly to define the airflow through the fuel bed 28 as precisely as possible, and to avoid disruptive airflows, for example air strands at the edges of the rotating grate elements 252, 253 and 254.

The openings 256 in the rotating grate elements 252, 253, and 254 are arranged to be small enough for the usual pellet material and/or wood chips not to fall through, and large enough for the fuel to flow well with air.

FIG. 9 now shows the rotating grate 25 in a closed position or in a working position, with all rotating grate elements 252, 253 and 254 horizontally aligned or closed. This is the position in control mode. The uniform arrangement of the plurality of openings 256 ensures a uniform flow of fuel through the fuel bed 28 (which is not shown in FIG. 9) on the rotating grate 25. In this respect, the optimum combustion condition can be produced here. The fuel is applied to the rotating grate 25 from the direction of arrow E; in this respect, the fuel is pushed up onto the rotating grate 25 from the right side of FIG. 9.

During operation, ash and or slag accumulates on the rotating grate 25 and in particular on the rotating grate elements 252, 253 and 254. With the present rotating grate 25, efficient cleaning of the rotating grate 25 (for ash removal 7 explained later) can be performed.

FIG. 10 shows the rotating grate in the state of a partial cleaning of the rotating grate 25 in the ember maintenance mode. For this purpose, only the third rotating grate element 254 is rotated. By rotating only one of the three rotating grate elements, the embers are maintained on the first and second rotating grate elements 252, 253, while at the same time the ash and slag are allowed to fall downwardly out of the combustion chamber 24. As a result, no external ignition is required to resume operation (this saves up to 90% ignition energy). Another consequence is a reduction in wear of the ignition device (for example, of an ignition rod) and a saving in electricity. Further, ash cleaning can advantageously be performed during operation of the biomass heating system 1.

FIG. 10 also shows a condition of annealing during (often already sufficient) partial cleaning. Thus, the operation of the system 1 can advantageously be more continuous, which means that, in contrast to the usual full cleaning of a conventional grate, there is no need for a lengthy full ignition, which can take several tens of minutes.

In addition, a potential slag on the two outer edges of the third rotating grate element 254 is (broken up) during the rotation thereof, wherein, due to the curved outer edges of the third rotating grate element 254, the shearing not only occurs over a greater overall length than conventional rectangular elements of the prior art, but also occurs with an uneven distribution of movement with respect to the outer edge (greater movement occurs in the center than at the lower and upper edges). Thus, the crushing function of the rotating grate 25 is significantly enhanced.

In FIG. 10, grate lips 257 (on both sides) of the second rotating grate element 253 are visible. These grate lips 257 are arranged in such a way that the first rotating grate element 252 and the third rotating grate element 254 rest on the upper side of the grate lips 257 in the closed state thereof, and thus the rotating grate elements 252, 253 and 254 are provided without a gap to one another and are thus provided in a sealing manner. This prevents air strands and unwanted primary air flows through the glow bed. Advantageously, this improves the efficiency of combustion.

FIG. 11 shows the rotating grate 25 in the state of universal cleaning or in an open state, which is preferably carried out during a plant shutdown. In this case, all three rotating grate elements 252, 253 and 254 are rotated, with the first and second rotating grate elements 252, 253 preferably being rotated in the opposite direction to the third rotating grate element 254. On the one hand, this realizes a complete emptying of the rotating grate 25, and on the other hand, the slag is now broken up at four odd outer edges. In other words, an advantageous 4-fold crushing function is realized. What has been explained above with regard to FIG. 9 concerning the geometry of the outer edges also applies with regard to FIG. 10.

In summary, the present rotating grate 25 advantageously realizes two different types of cleaning (cf. FIGS. 10 and 11) in addition to normal operation (cf. FIG. 9), with partial cleaning allowing cleaning during operation of the system 1.

In comparison, commercially available rotating grate systems are not ergonomic and, due to their rectangular geometry, have disadvantageous dead corners in which the primary air cannot optimally flow through the fuel. Slagging occurs at these corners in a clustered manner. This makes for poorer combustion with poorer efficiency.

The present simple mechanical design of the rotating grate 25 makes it robust, reliable and durable.

(Rotating Grate with a Cleaning Device)

With reference to FIGS. 12*a* to 12*d*, a first general example of the principle of a cleaning device 125 for a rotating grate 25 according to the invention is explained below.

Figure 12A:
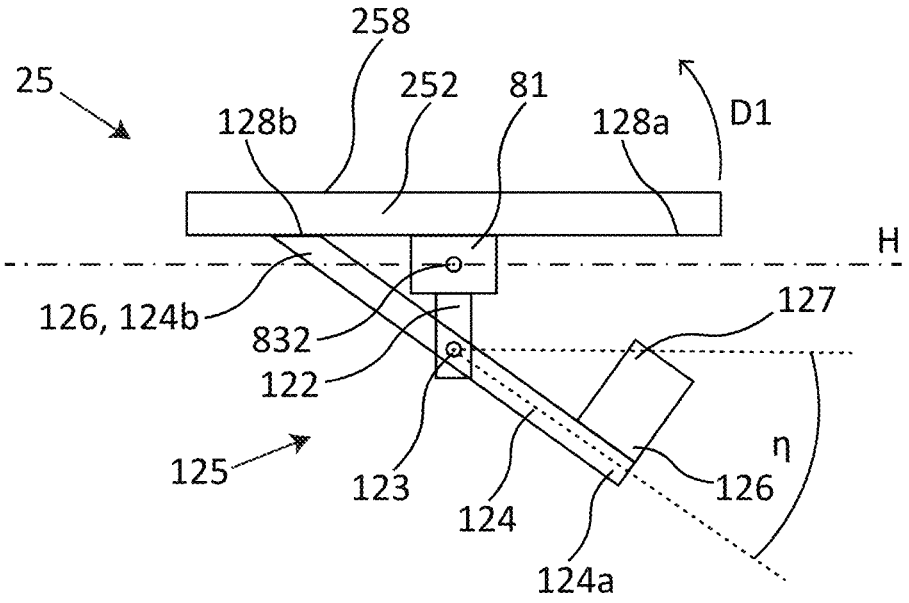
FIGS. 12*a* to 12*d* show a schematic diagram of the rotating grate according to the invention with a cleaning device.

In FIG. 12*a*, a rotating grate 25 is shown with a rotating grate element 252 in a first state. In this first condition, which may correspond to the closed position or working position of FIG. 9, the combustion area 258 is oriented approximately horizontally. In the first condition, the fuel may be located on the combustion area 258 for combustion.

The dash-dot line of FIG. 12*a* indicates an exemplary horizontal line H. This is at least approximately perpendicular to the direction of the acceleration due to gravity. The working position of the rotating grate 25 or of the rotating grate element 252 can be oriented to this horizontal H, with the combustion area 258 being aligned at least approximately parallel to the horizontal H.

The rotating grate element 252 is rotatably mounted by means of a bearing shaft 81, present with a rectangular cross-section shown as an example. One of the directions of rotation is indicated by the arrow D1. The axis of rotation of the bearing shaft 81 is indicated in FIG. 12*a* by a circle with a dot inside the bearing shaft 81. The bearing shaft 81 supports the rotating grate element 252, and the rotating grate element 252 may be fixed to the bearing shaft 81. Alternatively (not shown), the bearing shaft may be provided on the side of the rotating grate element 252, or (not shown) the bearing shaft 81 may be an integral part of the rotating grate element 252.

The bearing shaft 81 is again provided rotatably mounted relative to the biomass heating system 1. The rotation of the bearing shaft 81 and thus of the rotating grate element 252 is effected via a drive device (not shown in FIGS. 12*a* to 12*d* for simplicity), for example via an electric motor 231.

Preferably, the coupling between the drive device and the bearing shaft 81 can be provided flexibly and not rigidly. For example, the coupling can be made by means of a flexible toothed belt. Also, the coupling can be made by means of a gear transmission with backlash.

The cleaning device 125 is attached to the bearing shaft 81 of the rotating grate element 252. Alternatively (not shown), the cleaning device 125 may be attached directly to the rotating grate element 252. The bearing shaft 81 has a (geometric) axis of rotation 832 about which the rotating grate element 252 is rotated.

The cleaning device 125 is provided on the underside of the rotating grate element 252. In this case, the cleaning device 125 can hang freely from the rotating grate element 252 without touching other parts of the biomass heating system 1.

The cleaning device 125 has a suspension 122 with a joint 123. The suspension 112 extends away from the rotating grate element 252 and spaces the joint 123 from the bearing shaft 81.

The joint 123 provides an axis of rotation for an impact arm 124, which is rotatably supported by the joint 123 approximately centrally with respect to the longitudinal extent of the impact arm 124. The impact arm 124 is elongated and has, for example, the shape of a rod or shaft. In this regard, the impact arm 124 has a first end 124*a* and a second end 124*b*. The second end 124*b* may provide a impact arm head 126 for striking an impact face 128*b*.

A mass element 127 is attached to the first end 124*a* of the impact arm 124. The mass element 127 is preferably made of a metal and can serve as a weight and also as an impact element in the sense of a hammer head. In this respect, the mass element 127 may equally represent a impact arm head 126.

The mass element 127 itself may be provided in a single piece or in multiple pieces. For example, the mass element 127 may be a single cast element, or it may comprise multiple metal parts that are welded or bolted together. Also, the mass element 127 may be provided integrally or multi-partially with the impact arm 124. For example, the mass element 127 may be manufactured with the impact arm 124 as a single casting.

The impact arm 124 with the mass element 127 of FIGS. 12*a* to 12*d* may be collectively referred to as a drop hammer.

A chamfer is provided at the second end 124*b* of the impact arm 124 to provide a impact arm head 126 having a surface that, in the first state, is in flat contact with the underside of the rotating grate element 252 or with a impact face 128*b* of the rotating grate element 252.

This limits the maximum deflection of the impact arm 123 with the mass element 127 in one direction. In other words, the mass element 127, which is attached to the impact arm 124, is maximally spaced from the rotating grate element 252. Due to the weight of the mass element 127, the impact arm 124 remains stable in its initial position in the first state as shown in FIG. 12*a*.

The angle η shown in FIG. 12*a* with its dashed drawn legs indicates the range of motion of the impact arm 124. In other words, the cleaning device 215 is configured such that the impact arm 124 can move freely in this angular range η. However, no separate drive is provided for this purpose. Rather, the drive for rotating the rotating grate element 252 is also indirectly shared for the function of the cleaning device 125 and thus the tapping of the rotating grate 25. In this case, the rotating grate 25 is tapped due to the position of the impact arm and the defined angular range r' exactly when the rotating grate 25 is rotated to clean combustion residues. In other words, the drop start point of the drop hammer configuration may be mechanically set up to tap the rotating grate 25 when the combustion area 258 overhangs downward.

For example, in the first condition, combustion of the fuel may occur on the combustion area 258 of the rotating grate element 252. In the process, combustion residues, including ash and slag, remain on the grate. These combustion residues can also adhere or cake to the rotating grate element 252, and in particular can also clog openings 256 (not shown in FIG. 12*a*) of the rotating grate element 252, which worsens combustion.

Figure 12B:
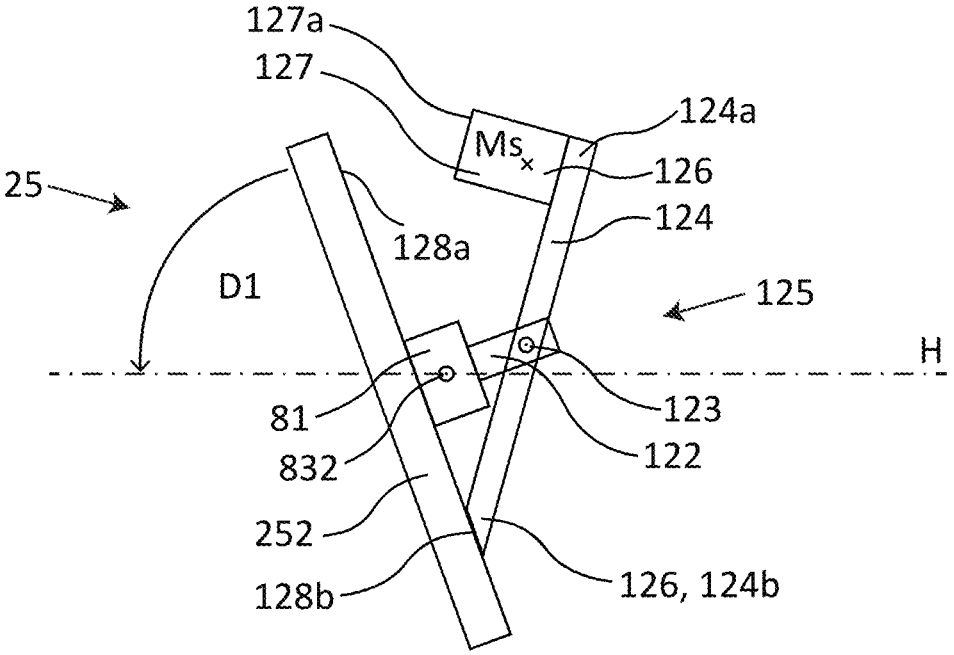

FIG. 12*b* shows the rotating grate 25 in a second state, in which the rotating grate 25 with the rotating grate element 252 and the cleaning device 125 have been further rotated together with respect to FIG. 12*a* in the direction of the arrow D1.

In the course of rotation in the direction of arrow D1 from the first state to the second state, the cleaning device 125 is moved integrally with the rotating grate element 252. During this movement, the impact arm 124 is lifted along with the mass element 127; the potential energy of the mass element 127 is increased.

Thereby, the impact arm 124 remains in its initial angular position in the second state. The impact arm 124 has not yet moved relative to the rotating grate element 252 with the mass element 127.

Figure 12C:
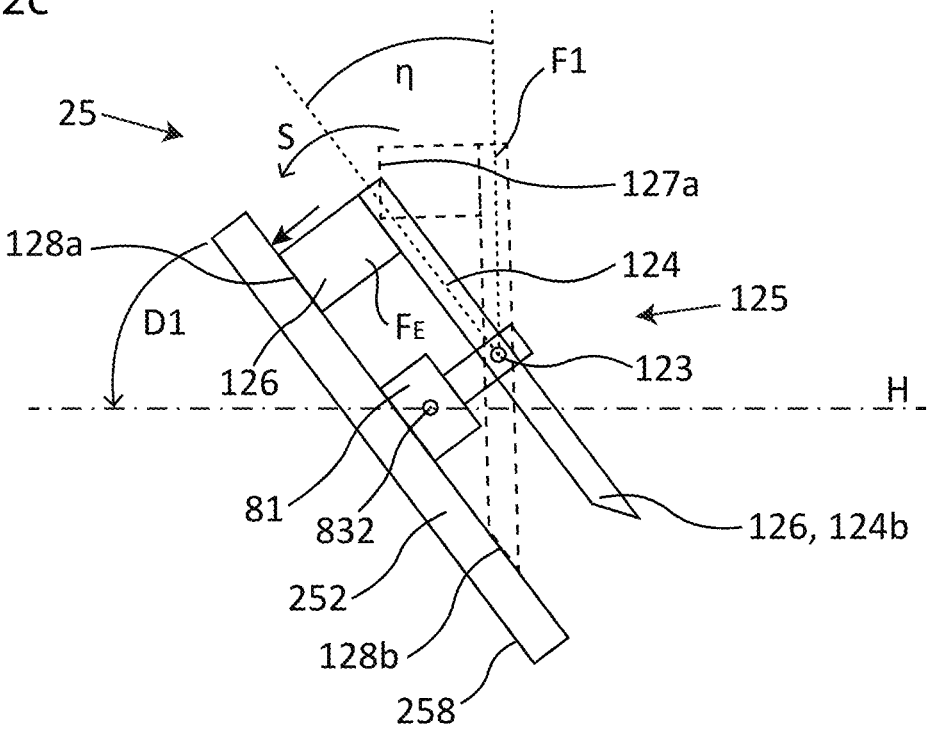

If the striking arm 124 is rotated further beyond this second state in the direction of the arrow D1, which is shown in FIG. 12*c*, into a third state, the striking arm 124 with the mass element 127 exceeds the drop start position F1, from which the striking arm 124 with the mass element 127 falls under the influence of the acceleration due to gravity onto a impact face 128*a* of the rotating grate element 252, or from which the striking arm 124 with the mass element 127 leaves its initial angular position relative to the rotating grate element 252. In other words, the impact arm 124 with the mass element 127 flips over in the third state, sweeps over the angular range η, and reaches a drop end position Fe or a final angular position at which the mass element 127 strikes the rotating grate element 252.

Thus, continued rotation of the rotating grate element 252 about the drop start position F1 initiates an acceleration motion of the mass element 127 in which the positional energy or potential energy of the mass element 127 is converted to kinetic energy.

The drop start position F1 results from the usual laws of mechanics, taking into account the direction of action of the acceleration due to gravity. The drop start position F1 can be defined, for example, by the relative position of the center of mass Ms (which is drawn in FIG. 12*b* purely schematically for illustration purposes) to the position of the bearing 124 with its axis of rotation.

In FIG. 12*c*, in detail, a start of the (downward) falling motion of the impact arm 124 from a fall start position F1/drop start position with the mass element 127 is shown in dashed lines, and an end of the falling motion of the impact arm 124 with the mass element 127 is shown in solid lines. At the end of the falling movement of the impact arm 124 with the mass element 127, the mass element 127 strikes the impact face 128*a* of the rotating grate element 252. The drop start position generally represents a position of the mass element 127 and/or the impact arm 124 upon rotation of the rotating grate 25, from which the drop motion begins.

The falling motion of the impact arm 124 with the mass element 127 is basically a rotary motion. In terms of momentum physics, the momentum of the impact arm 124 with the mass element 127 when striking the impact face 128*a* is equal to the momentum sum of the distributed mass Σ mi*vi of the drop hammer, where the velocity vi of the individual mass increments mi of the drop hammer depends on the radius of the rotational motion of the individual mass increments.

With this impulse, a bump or knock occurs on or against the rotating grate element 252.

This impact or knocking causes vibration of the rotating grate element 252 and, particularly in the case of a flexible coupling between the drive device and the bearing shaft 81, a rapid reciprocating movement of the rotating grate element 252 about its axis of rotation. This knocks off and also shakes off combustion residues on the rotating grate element 252.

In summary, the impact or tapping of the mass element 127 on the impact face 128*a* of the rotating grate element 252 results in a knocking effect that can be used to clean the rotating grate element 252 of combustion residue, such as ash or slag.

Figure 12D:
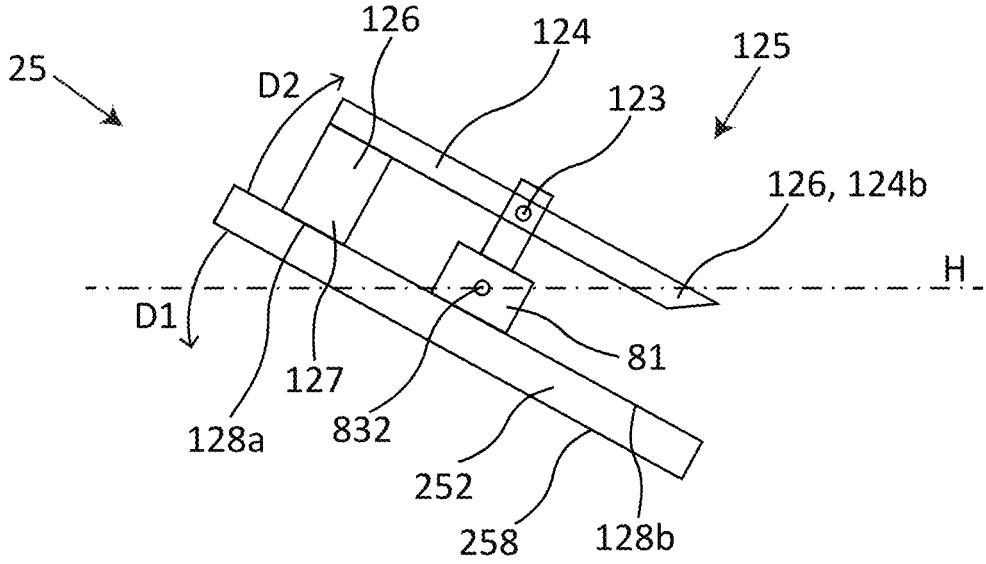

In FIG. 12*d*, a fourth condition is shown in which the rotating grate element 252 has rotated further in the direction of arrow D1. Here, the mass element 127 rests on the first impact face 128*a*, and the second end 124*b* of the impact arm 124 does not rest on the impact face 128.

The rotary movement in the direction of arrow D1 can now either stop at a predefined position and then be continued in the opposite direction of arrow D2, or the rotary movement can be continued further in the direction of arrow D1 until a 360 degree rotation has been made. In this case, the rotational movement in the direction of the arrow D2 can be continued in particular in such a way that the rotating grate element 252 is moved back to its working position of FIG. 12*a*.

In both aforementioned cases of continuation of the rotational movement (further in the direction of arrow D1 or in the direction of arrow D2), a further drop start position can again be reached, in which the impact arm 124 will move back to the starting position of FIG. 12*a* or to its initial angular position. Here, the mass element 127 falls back, whereby the second end of the impact arm 124*b* now strikes the impact face 128*b* with the impact arm head 126 there. The advantageous leverage law applies here.

Thus, with the mechanism explained above, when the rotating grate element 252 (optionally) returns to its original position, a second bump or knock can be applied to or against the rotating grate element 252, which improves the cleaning of the rotating grate element 252.

Experiments with an experimental unit have shown that the cleaning device 125 with the configuration explained above leads to a very efficient cleaning of the grate 25.

This efficient cleaning has the following reasons in particular:

The knock or impulse on the rotating grate element 252 is from the underside of the rotating grate element opposite the contaminated or slagged combustion area 258. This knocks most of the contamination or slagging off the combustion area 258 from the ideal direction, i.e., the combustion residues are knocked off the grate 25.

Moreover, the tapping on the rotating grate element 252 occurs directly on the rotating grate element 252 itself during the first tapping.

The mass element 127 may further have a substantial weight compared to the mass of the rotating grate element 252, such as 100 to 1000 grams. Due to the above-mentioned falling distance and the acceleration due to gravity, the resulting impulse is comparatively large, which means that, in addition to the loose ash, more strongly adhering impurities or slagging can also be removed.

When the rotating grate element 252 is rotated back and forth or completely around, it is struck or knocked twice, thus creating the knocking effect twice.

In addition, there are the other advantages:

The acceleration movement is initiated by the rotation of the rotating grate element 252, i.e. intrinsically at the time when the grate is tilted for cleaning, but without the need for a dedicated drive or a dedicated controlled triggering device. As a result, the knocking effect is automatically effected at the right time due to the design.

In this regard, the drop start position may advantageously be set such that the combustion area 258 faces downward during knocking, thereby allowing the combustion residues removed during knocking or impact to fall directly into the ash container or chamber of the biomass heating system 1.

Figure 13A:
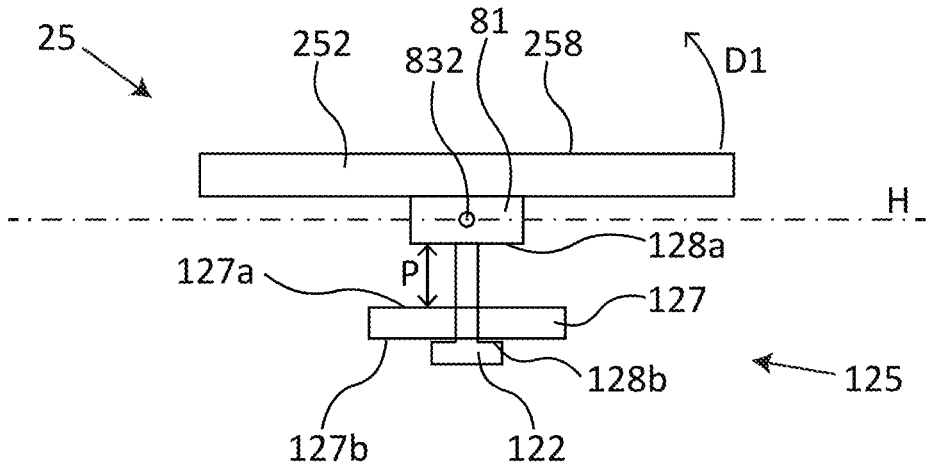
FIGS. 13*a* and 13*b* show a schematic diagram of the rotating grate according to the invention with an alternative cleaning device.
Figure 13B:
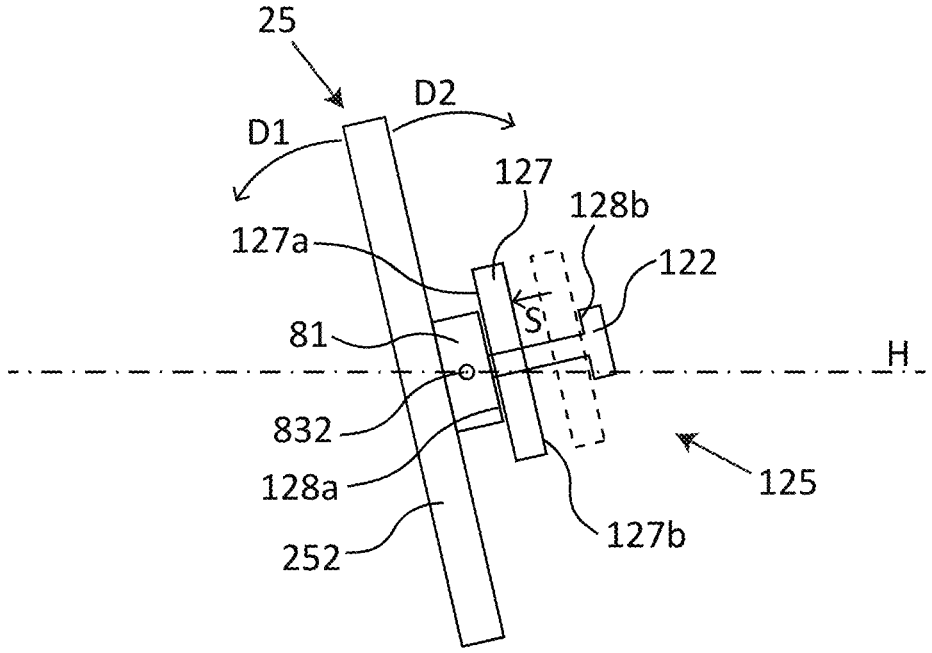

With reference to FIGS. 13*a* and 13*b*, a second general example of the principle of a cleaning device 125 for a rotating grate 25 according to the invention is explained below.

Initiation of an acceleration motion of the mass element 127 can also be accomplished without the drop hammer configuration shown in FIGS. 12*a* through 12*d*, as explained below:

FIG. 13*a* shows a rotating grate element 252 of a rotating grate 25 with a bearing axle 81 in a working position of the rotating grate element 252, as also shown in FIG. 12*a*.

Instead of the drop hammer configuration of FIG. 12*a*, a suspension 122 can now serve as a guide for a mass element 127. For example, the suspension 122 may be provided in pin or rod form with an end stop having a impact face 128*b*. The mass element 127 may be movably provided on the suspension 122 such that it can move back and forth in the longitudinal direction of the suspension 122 (cf. the double arrow P of FIG. 13*a*).

For example, the mass element 127 may be configured as a perforated disc through whose central hole the suspension 122 is passed. The mass element has a first surface 127*a* and a second surface 127*b* on its two sides. In the position shown in FIG. 12*a*, the second surface 127*b* of the mass element 127 rests on the end stop or (second) impact face 128*b* of the suspension 122.

If the rotating grate element 252 is now rotated in the direction of the arrow D1, as shown in FIG. 13, the mass element 127 will slide or fall downwards on the suspension 122 when it reaches a drop start position (cf. the arrow S of FIG. 13*b*), and strike with its first surface 127*a* on the (first) impact face 128*b*. This can be used to create a tapping effect, as is also described with reference to FIGS. 12*a* to 12*d*.

If the rotating grate element 252 is subsequently rotated further either in the direction of the arrow D1 or in the direction of the arrow D2, then again a further drop start position can be reached from which the mass element 127 slides back or falls, and hits the second impact face 128*b* with its second surface 127*b*.

In this respect, also with this second example of a cleaning device 125 of FIGS. 13*a* and 13*b*, approximately the same advantages and effects can be achieved as with the first example of FIGS. 12*a* to 12*d*.

(rotating grate 25 with rotating grate elements 252, 253, 254 and with cleaning devices 125)

Figure 14A:
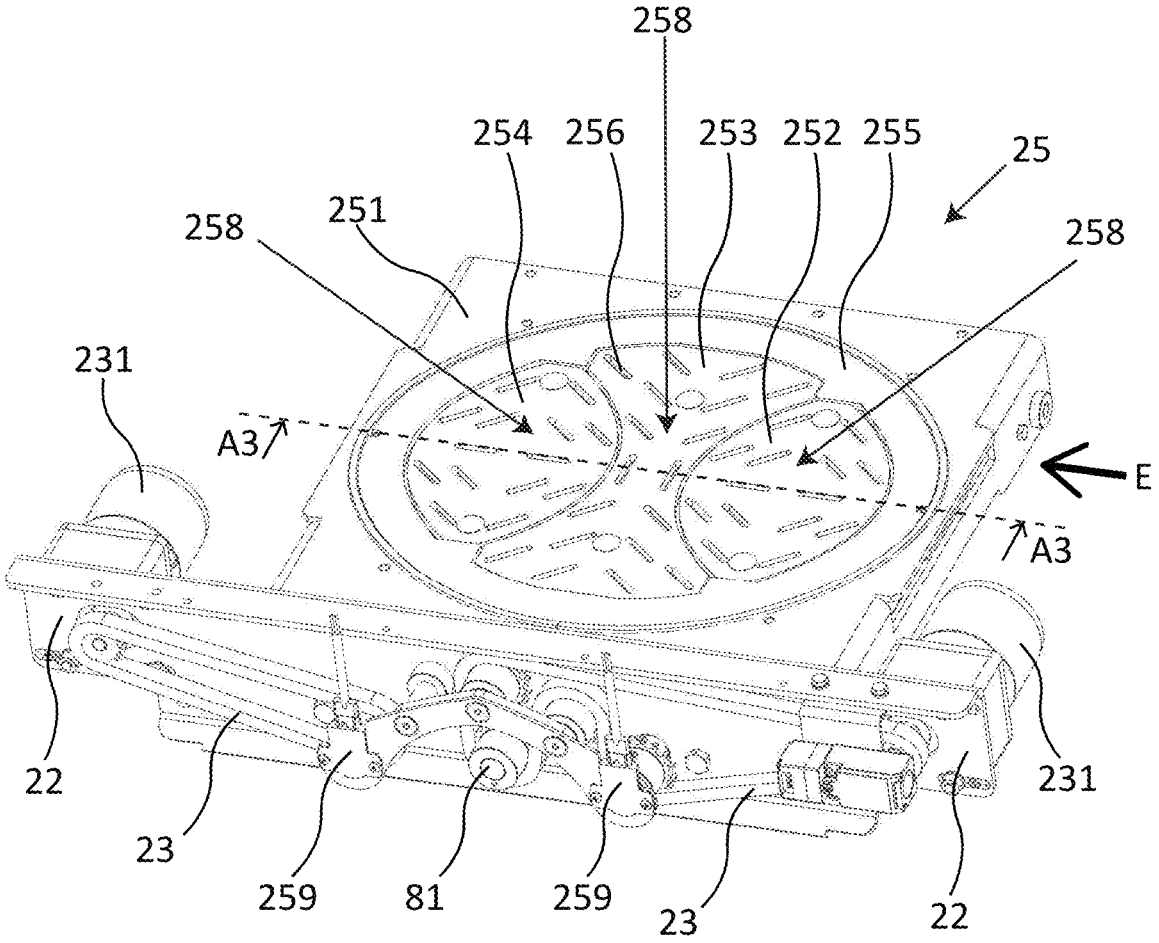
FIGS. 14*a* to 14*b* show views of a rotating grate according to the invention with cleaning devices.

FIG. 14*a* shows a rotating grate 25 with three rotating grate elements 252, 253, 254 and with respective cleaning devices 125 from an oblique top view of the rotating grate 25.

Figure 14B:
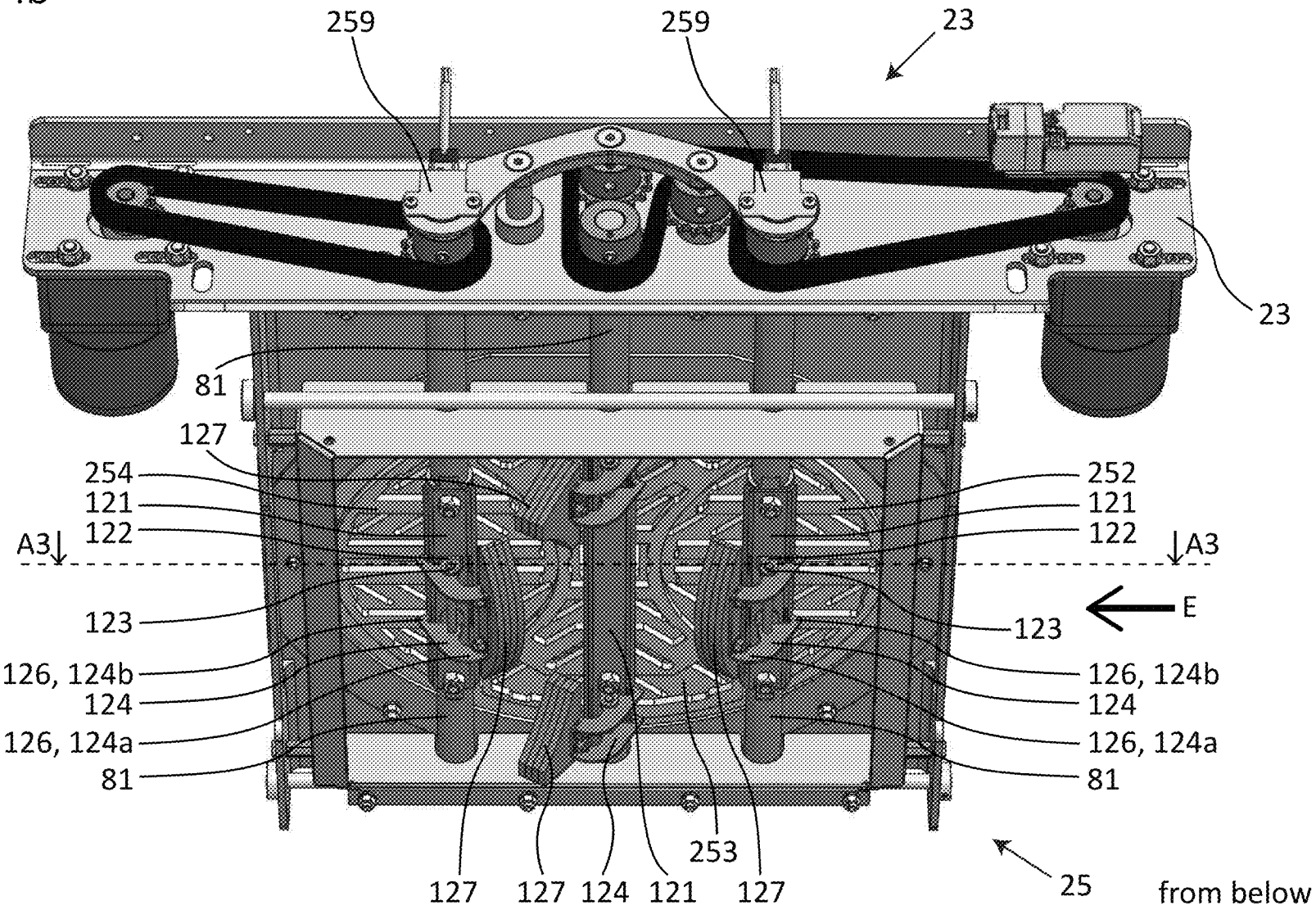

FIG. 14*b* shows the rotating grate 25 of FIG. 14 a with three rotating grate elements 252, 253, 254 and with respective cleaning devices 125 from an oblique bottom view of the rotating grate 25.

The rotating grate 25 with the three rotating grate elements 252, 253, 254 has been described in more detail above with reference to FIGS. 8 and 9, and therefore mainly the cleaning device 125 is explained below to avoid repetition.

FIGS. 14*a* and 14*b* show the rotating grate 25 in a closed position and in a working position, respectively, with all rotating grate elements 252, 253 and 254 horizontally aligned and closed, respectively. This is the position in control mode. The uniform arrangement of the plurality of apertures/openings 256 ensures uniform flow of the fuel bed 28 (which is not shown in FIGS. 14*a* and 14*b*) over the combustion area 285 of the rotating grate 25. The openings 256, which differed in form and function from those of FIG. 9, are described in more detail later with reference to FIG. 26. The direction or axis of insertion of the fuel onto the rotating grate 25 is indicated by the arrow E.

The motors 31 may drive the bearing axles 81 of the three rotating grate elements 252, 253, 254 to rotate them via a rotating mechanism 23. The rotating mechanism 23 couples the bearing axle 81 to the motors 31 via a toothed belt and gears, wherein the first and second rotating grate elements 252, 253 are rotated together, and the third rotating grate element 254 can be rotated independently of the first and second rotating grate elements 252, 253. Alternatively (not shown), however, all three rotating grate elements 252, 253, 254 may be rotated independently of each other if, for example, three motors 31 are provided.

Two rotational position sensors 259 are provided in FIGS. 14*a* and 14*b*, which can detect the rotational position of the bearing axles 81. These rotational position sensors 259 may be, for example, magnetic inductive sensors. This is used to control the rotational position of the three rotating grate elements 252, 253, 254.

In FIG. 14*b*, which shows the rotating grate 25 from diagonally below, four cleaning devices 125 are further shown. The first and third rotating grate elements 252, 254 each include one cleaning device 125, while the second rotating grate element 253 includes two cleaning devices 125. Alternatively (not shown), however, only one cleaning device 125 may be provided per rotating grate element, for example, or only one cleaning device 125 may be provided for the rotating grate 25 as a whole, for example.

Providing two cleaning devices 125 for the center rotating grate element 253 improves the knocking effect on the rotating grate element 253 and thus the cleaning thereof. The waisting of the central rotating grate element 253 results in two main surfaces thereof, on each of which a cleaning device 125 is also provided accordingly. This exemplifies that the present concept of a cleaning device 125 can be very flexibly adapted to different and/or even complex grate shapes. In this regard, the cleaning device 125 can also be used at the exact location or surface of the grate 25 where the greatest accumulation of contaminants can be expected. In other words, the cleaning device can advantageously be configured such that the knocking effect is generated directly at the points of the grate 25 to be cleaned.

The four cleaning devices 125 are provided on the underside of the rotating grate elements 252, 253, 254. The cleaning devices 125 include a mounting 121, a suspension 122 having a bearing 123, and a rotatably mounted impact arm 124 having a mass element 127 attached thereto.

In FIG. 14*b*, the cleaning device 125 is attached, for example bolted, to the bearing axles 81 by means of the attachment 121. Suspension 122 is provided on attachment 121, projecting downward in the working position of FIGS. 14*a* and 14*b*. The attachment 121 and the suspension 122 may be provided as one metal molded part, for example, or may be provided as separate parts and bolted together. A bearing 123 is provided in the suspension 122 as a pivot for the impact arm 124. By means of the suspension, the bearing 123 and thus the axis of rotation of the impact arm 124 is spaced from the rotating grate element 252, 253, 254.

For stability reasons, the impact arm 124 has two impact arm elements of identical shape, each of which is rotatably arranged around the bearing 123. However, the impact arm 124 may have only one or even three impact arm elements.

The impact arm elements are connected to each other at their first end by means of a sheet or metal piece. The mass element 127 is attached to this, in this example screwed. However, the mass element 127 may also be connected to the impact arm in a different manner, such as by welding.

Here, too, the lever law applies with regard to the impact arm 124 with the bearing 123 as the center of rotation. The impact arm head 126 at the second end of the impact arm 124*a*, which strikes the impact face 128*b*, is on the side of the shorter lever. The mass element 127 is located on the longer side of the lever. Preferably, the impact arm 124 on the shorter side from the second end 124*b* to the bearing 123 has less than 50% of the length of the impact arm 124 on the longer side from the first end 124*a* to the bearing 123. This significantly increases the (second) knocking effect.

The four mass elements 127 of FIG. 14*b* are adapted in their shape to the shape of the respective rotating grate elements 252, 253, 254 in such a way that the respective mass elements 127 can rest with their entire impact face on the corresponding rotating grate element 252, 253, 254, and in this respect the mass elements 127 do not project beyond the surface of the respective rotating grate element 252, 253, 254 when resting on the rotating grate element.

In FIG. 14*b*, the impact arms 124 hang with the mass elements 127 downward in their initial position, and the mass elements 127 are protested by the rotating grate elements 252, 253, 254. Upon rotation of one or more rotating grate elements 252, 253, 254, the rotating grate elements 252, 253, 254 are cleaned by the respective cleaning device 125, as explained in principle with reference to FIGS. 12*a* to 12*d*, and as explained in detail below with reference to the following figures.

FIGS. 15*a* through 25*b* show the grate 25 of FIGS. 14*a* and 14*b* sequentially performing an exemplary stepwise and complete cleaning process or procedure.

Figure 15A:
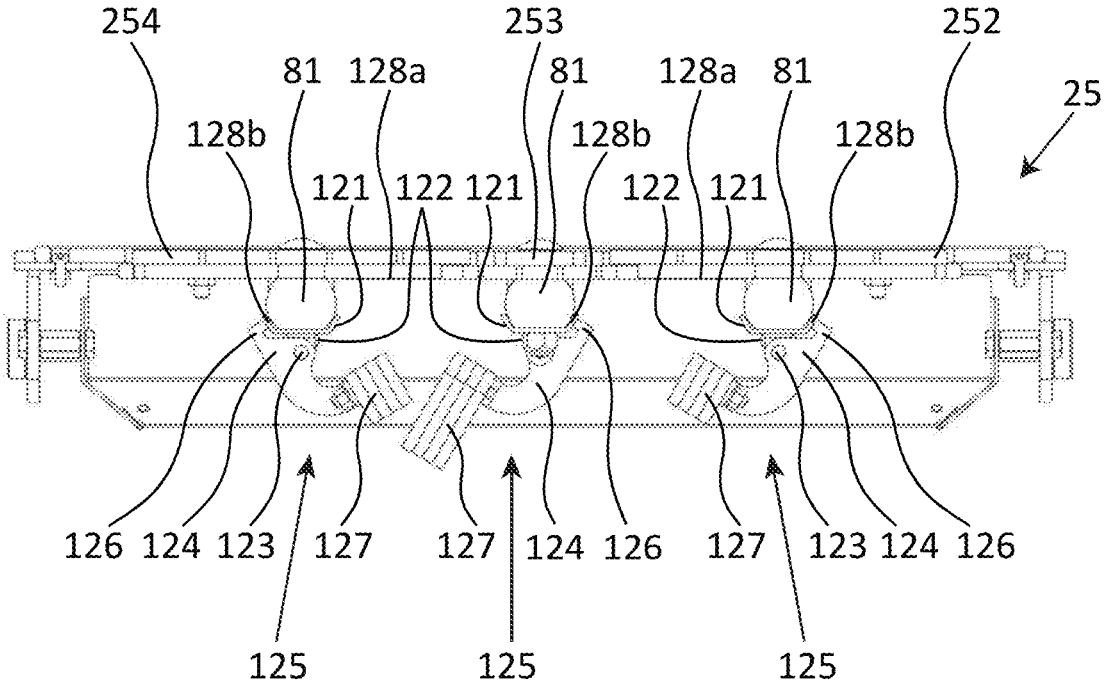
FIGS. 15*a* and 15*b* show vertical cross-sectional view and a three-dimensional sectional view of the grate of FIG. 14*a* in a first condition.
Figure 15B:
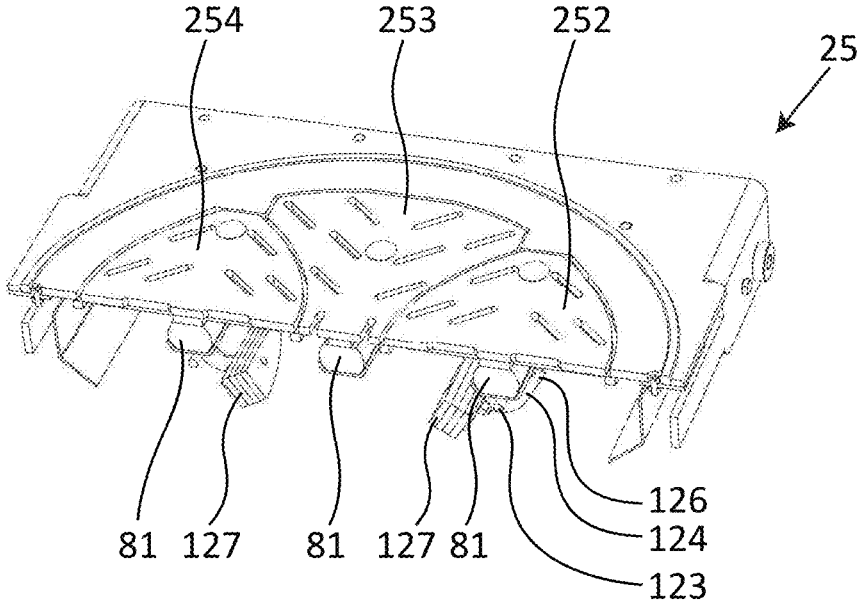

To avoid repetition, reference is made to the explanations of FIGS. 14*a* and 14*b* regarding the features and function of the cleaning devices 25. Similarly, for clarity, not all reference signs of FIGS. 15*a* and 15*b* are shown repeatedly in FIGS. 16*a* to 25*b*. However, the corresponding characteristics are identical. Further, in FIG. 15*b*, and analogously in the following figures, only one of two cleaning devices 25 of the second rotating grate element 253 is shown due to the sectional position.

However, of the process steps shown in FIGS. 15*a* to 25*b*, only individual sections can be carried out. For example, only partial cleaning of a single rotating grate element 252, 253, 254 can be performed, corresponding to FIGS. 15*a* to 18*b*. Generally, each rotating grate element 252, 253, 254 can be rotated individually and thus cleaned individually. Also, for example, all of the rotating grate elements 252, 253, 254 could be rotated simultaneously if, for example, there were no rotating grate lips or no mutual rotation limits. In addition, a full rotation of a rotating grate element 252, 253, 254 may be 360 degrees, or a back and forth rotation of a rotating grate element 252, 253, 254 may be, for example, only up to 180 degrees. Also, the grate 25 may alternatively have only one rotating grate element or only two rotating grate elements.

FIGS. 15*a* and 15*b* show a vertical cross-sectional view and a three-dimensional sectional view of the grate 25 of FIG. 14*a* in a first condition. This is the working condition of the grate 25 where fuel rests on the combustion area 258, is burned, and combustion residues are produced. These combustion residues, for example ash or slag, rest on the grate 25 and may also adhere more firmly to the grate 25. In addition, combustion residues can also enter the perforations or openings 256 of the grate and adhere in these openings 256, in which case the flow through the fuel bed 28 is degraded.

For example, after a predetermined burn time has elapsed and/or after an ember bed height sensor (not shown) has detected a predetermined ash height (and thus amount), a system controller (not shown) determines that partial or full cleaning of the grate 25 should occur. In the present case, the plant control system determines that a gradual full cleaning of the grate 25 is to take place.

Figure 16A:
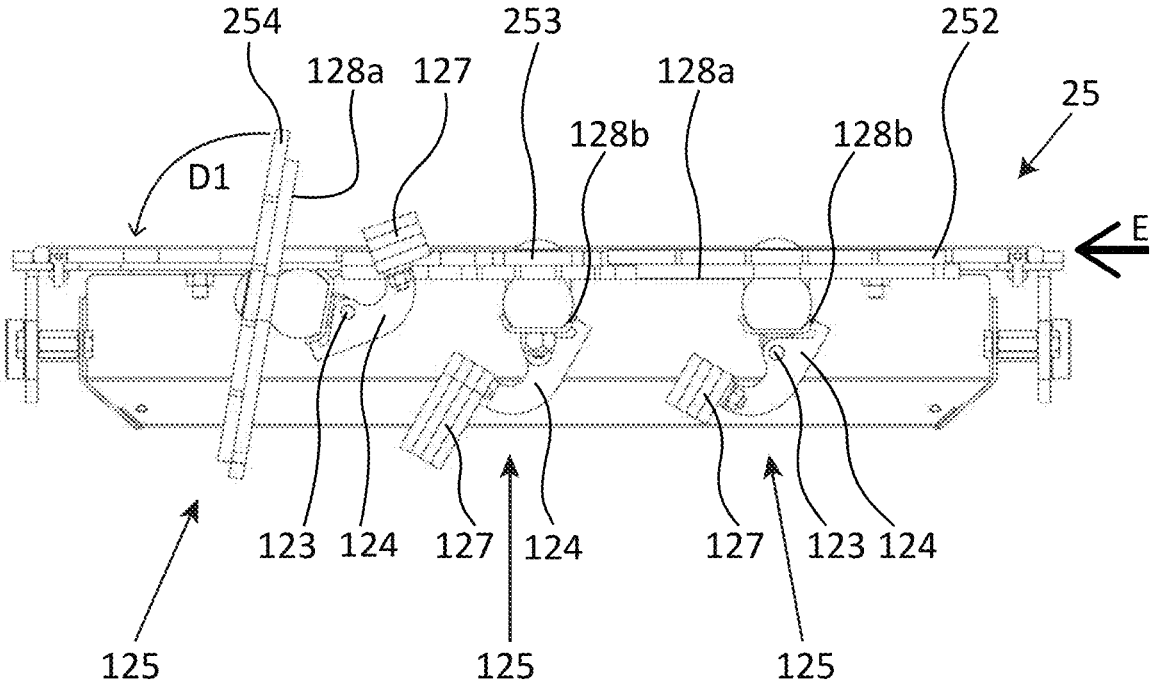
FIGS. 16*a* and 16*b* show vertical cross-sectional view and a three-dimensional sectional view of the grate of FIG. 14*a* in a second condition.
Figure 16B:
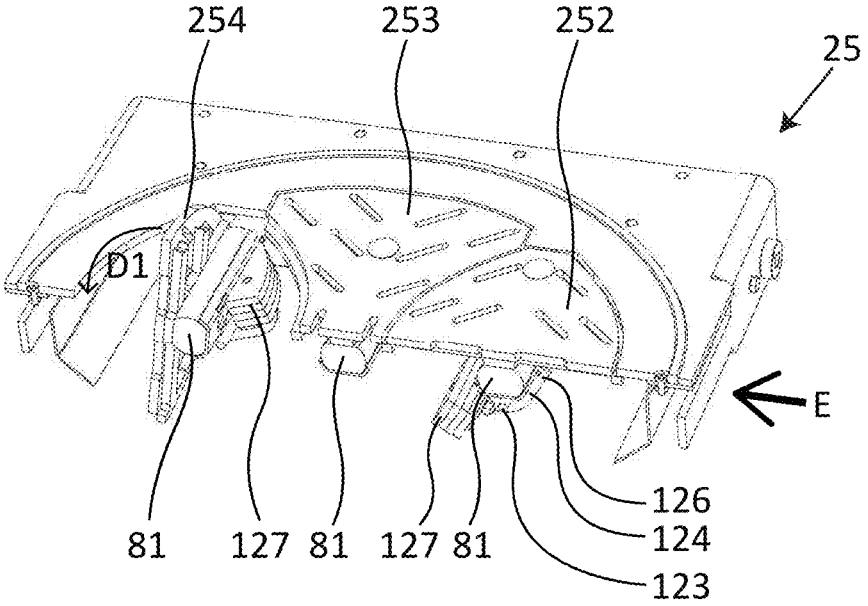

FIGS. 16*a* and 16*b* show a vertical cross-sectional view and a three-dimensional sectional view of the grate 25 of FIG. 14*a* in a second condition.

In this second state, the third rotating grate element 254 has been rotated in the direction of the arrow D1. Thereby, the mass element 127 of the cleaning device 125 of the third rotating grate element 254 is lifted by the force of one of the motors 231 of the rotating mechanism 23, increasing its potential energy. The other rotating grate elements 252, 253 remain in their initial position. This means that the rotating grate element which is furthest away from the fuel insertion E is rotated first. In this condition, the loose ash falls from the third rotating grate element 254 downward to the ash discharge. However, ash or slag may still adhere to the third rotating grate element 254.

Figure 17A:
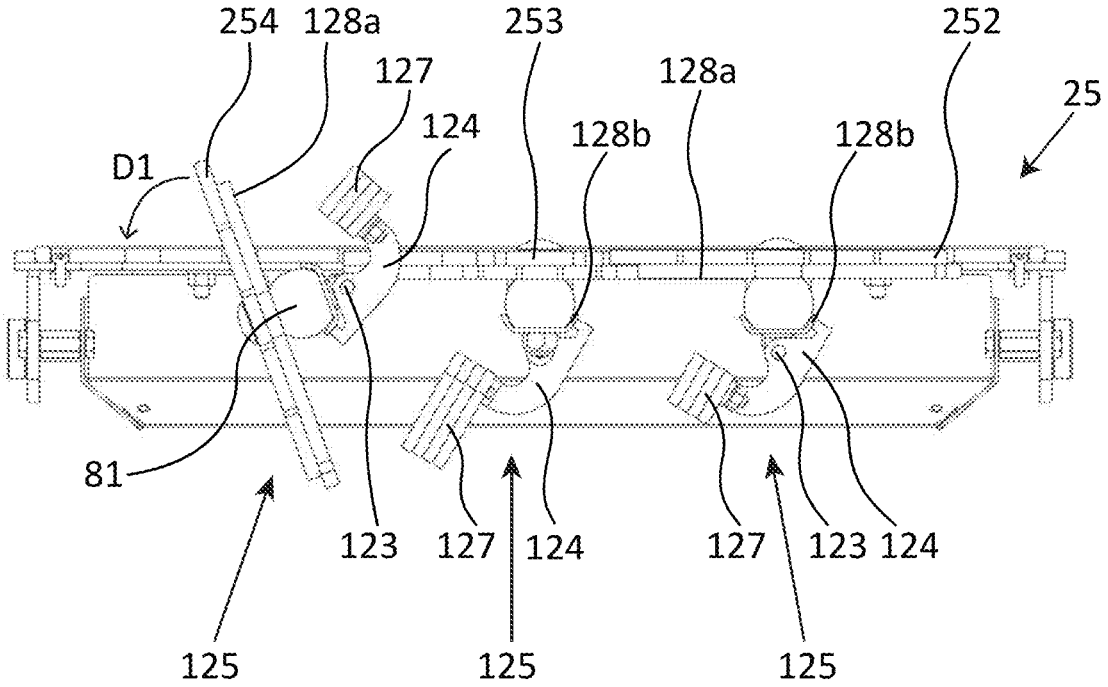
FIGS. 17*a* and 17*b* show a vertical cross-sectional view and a three-dimensional sectional view of the grate of FIG. 14*a* in a third condition.
Figure 17B:
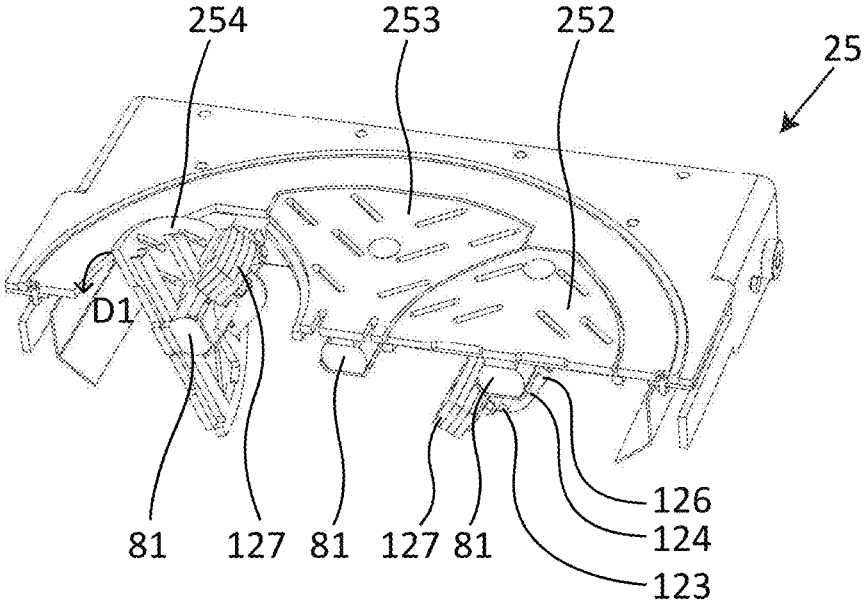

FIGS. 17*a* and 17*b* show a vertical cross-sectional view and a three-dimensional sectional view of the grate 25 of FIG. 14*a* in a third condition.

In this third state, the third rotating grate element 254 has been rotated even further in the direction of the arrow D1. The combustion area 258 of the third rotating grate element 254 now overhangs, allowing the loose ash to fall even more easily from the rotating grate element 254. However, ash or slag may still adhere to the third rotating grate element 254. The purpose of the cleaning device 125 according to the invention is to remove precisely these combustion residues, which are more difficult to remove, from the grate 25.

Figure 18A:
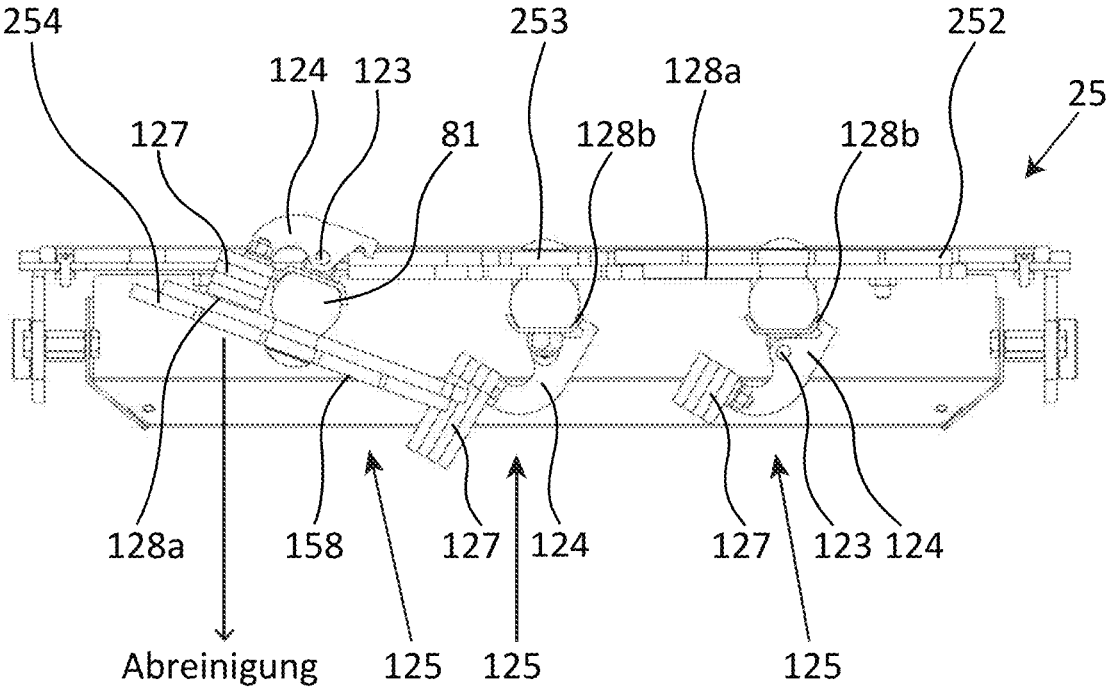
FIGS. 18*a* and 18*b* show vertical cross-sectional view and three-dimensional sectional view of the grate of FIG. 14*a* in a fourth condition.
Figure 18B:
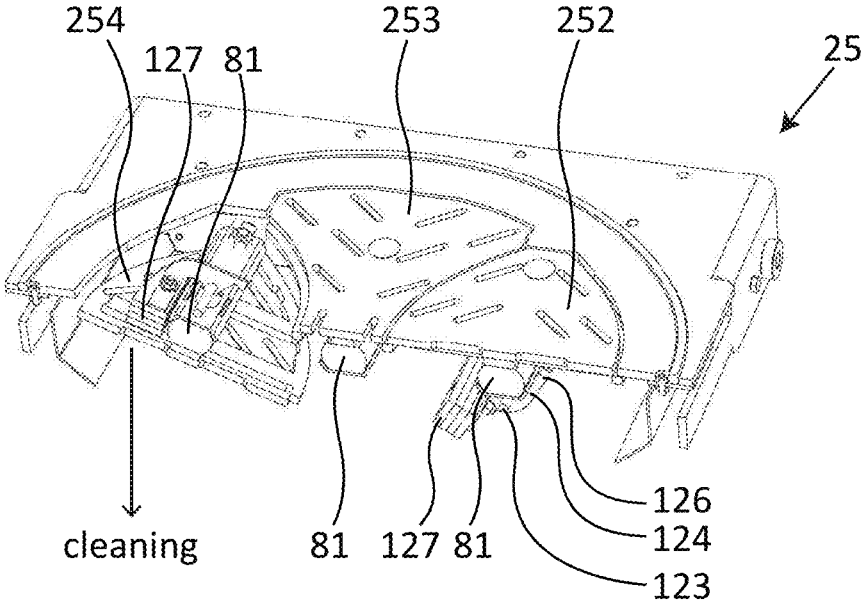

FIGS. 18*a* and 18*b* show a vertical cross-sectional view and a three-dimensional sectional view of the grate 25 of FIG. 14*a* in a fourth condition.

In this fourth state, the third rotating grate element 254 has been rotated even further in the direction of the arrow D1. In this case, the impact arm 124 with the mass element 127 has passed the drop start position, and the mass element 127 has struck the impact face 128*a* of the third rotating grate element 254. Thus, as explained with reference to FIGS. 12*a* to 12*d*, a knocking effect is produced on the third rotating grate element 254, and more firmly adhered ash or slag is also advantageously tapped off. Advantageously, the combustion area 258 points largely downward, allowing this ash or slag to fall directly to the ash discharge and not re-settle in other locations (for example, dead corners or other surfaces in the combustion chamber 24).

Figure 19A:
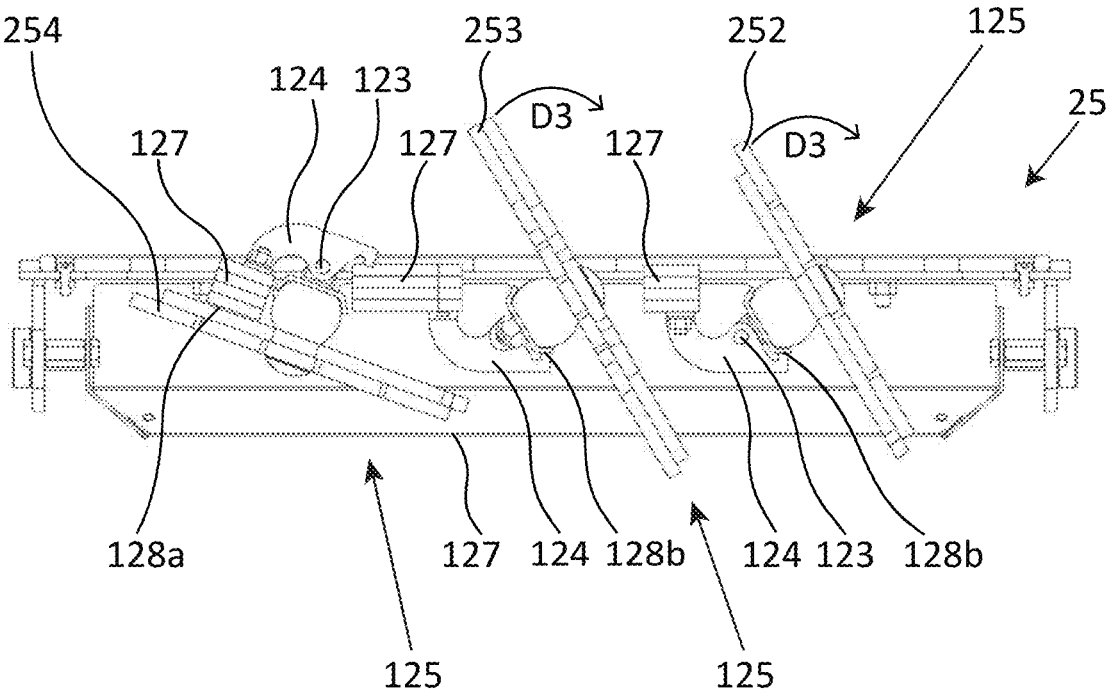
FIGS. 19*a* and 19*b* show vertical cross-sectional view and a three-dimensional sectional view of the grate of FIG. 14*a* in a fifth condition.
Figure 19B:
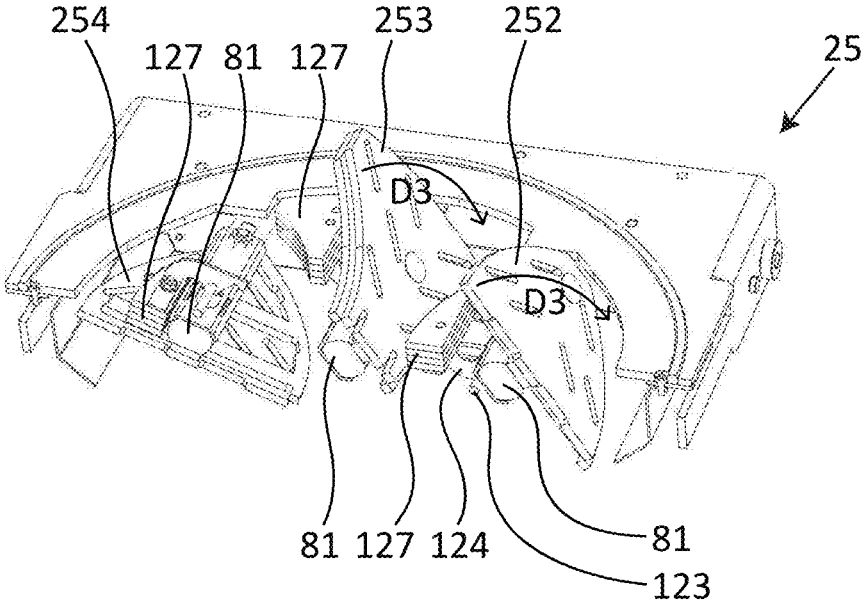

FIGS. 19*a* and 19*b* show a vertical cross-sectional view and a three-dimensional sectional view of the grate 25 of FIG. 14*a* in a fifth condition.

In this fifth state, the first and second rotating grate elements 252, 253 have been rotated together in the direction of arrow D3. The direction of rotation is reversed to the direction of rotation D1. This further raises the mass elements 127 of the cleaning devices 25 of the first and second rotating grate elements 252, 253. The third rotating grate element 254 remains in a stationary rotating position.

Figure 20A:
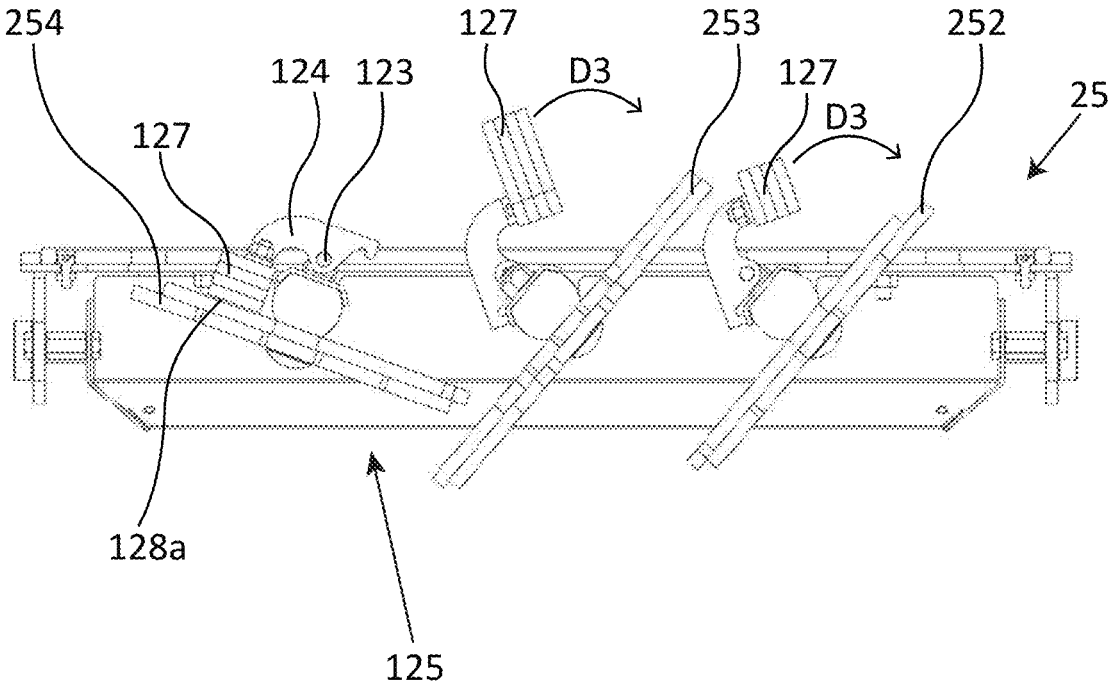
FIGS. 20*a* and 20*b* show a vertical cross-sectional view and a three-dimensional sectional view of the grate of FIG. 14*a* in a sixth condition.
Figure 20B:
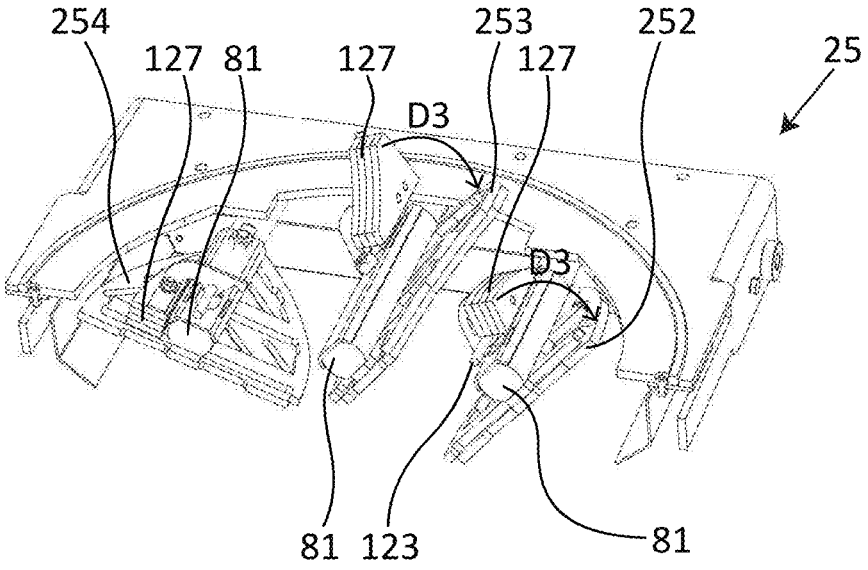

FIGS. 20*a* and 20*b* show a vertical cross-sectional view and a three-dimensional sectional view of the grate 25 of FIG. 14*a* in a sixth condition.

In this sixth state, the first and second rotating grate elements 252, 253 have been further rotated together in the direction of arrow D3. The mass elements 127 are located just before their drop start position. The third rotating grate element 254 remains in a stationary rotating position.

Figure 21A:
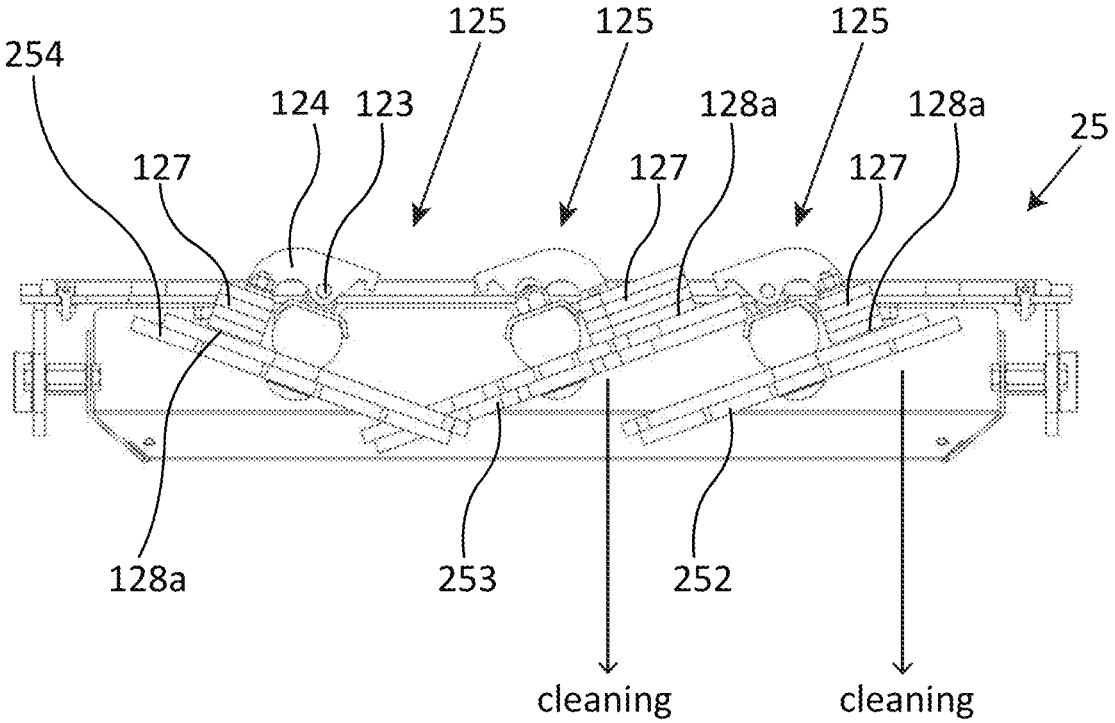
FIGS. 21*a* and 21*b* show vertical cross-sectional view and a three-dimensional sectional view of the grate of FIG. 14*a* in a seventh condition.
Figure 21B:
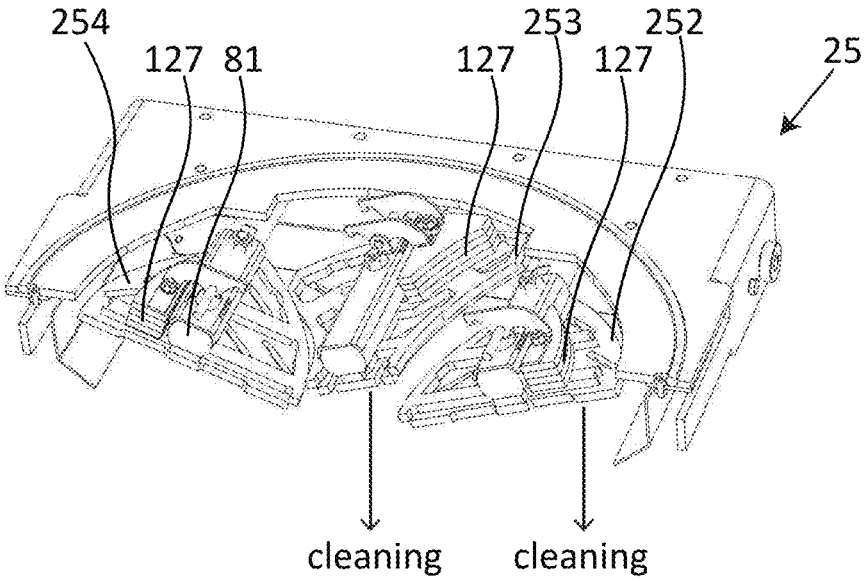

FIGS. 21*a* and 21*b* show a vertical cross-sectional view and a three-dimensional sectional view of the grate 25 of FIG. 14*a* in a seventh condition.

In this seventh state, the first and second rotating grate elements 252, 253 have been further rotated together in the direction of arrow D3. In the process, the mass elements 127 have exceeded their drop start positions, and have respectively fallen onto the impact faces 128*a* of each of the first and second rotating grate elements 252, 253, and have knocked off the rotating grate elements 252, 253. The third rotating grate element 254 remains in a stationary rotating position.

Figure 22A:
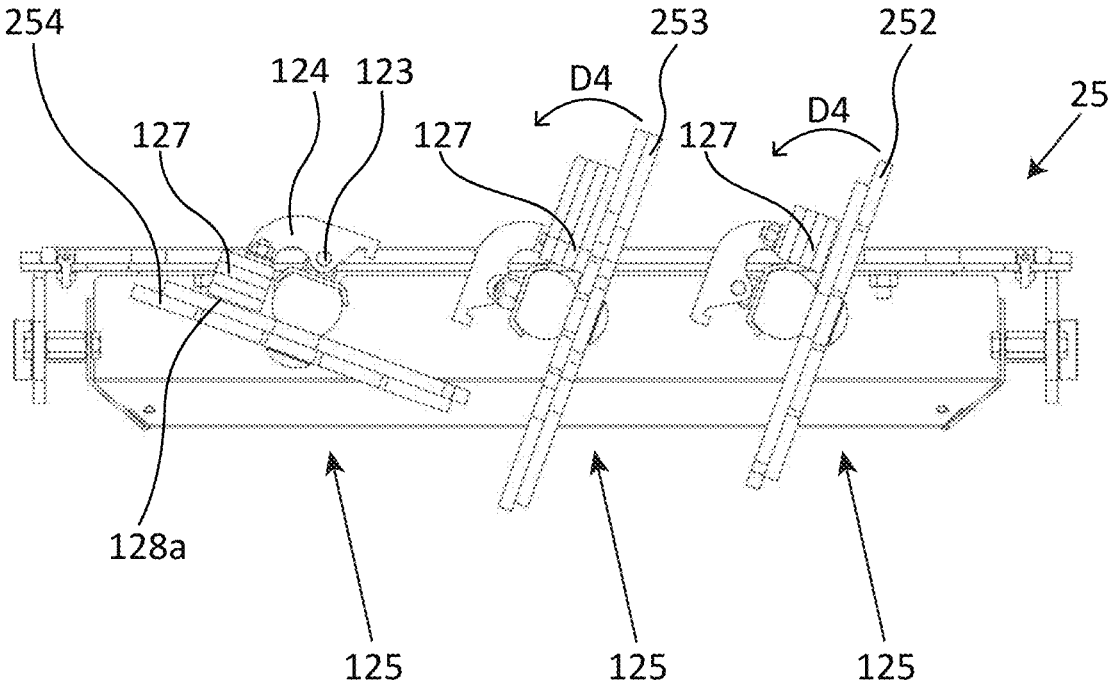
FIGS. 22*a* and 22*b* show vertical cross-sectional view and three-dimensional sectional view of the grate of FIG. 14*a* in an eighth condition.
Figure 22B:
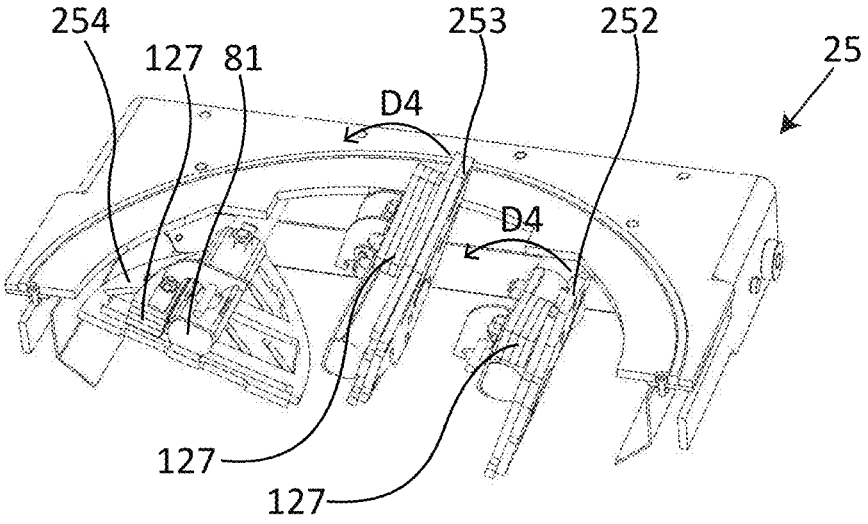

FIGS. 22*a* and 22*b* show a vertical cross-sectional view and a three-dimensional sectional view of the grate 25 of FIG. 14*a* in an eighth condition.

In this eighth state, the first and second rotating grate elements 252, 253 have been rotated back together in the direction of arrow D4 opposite to the direction of rotation D3. In this case, the mass elements 127 rest on the respective rotating grate elements 252, 253 and in turn receive potential energy. The third rotating grate element 254 remains in a stationary rotating position.

Figure 23A:
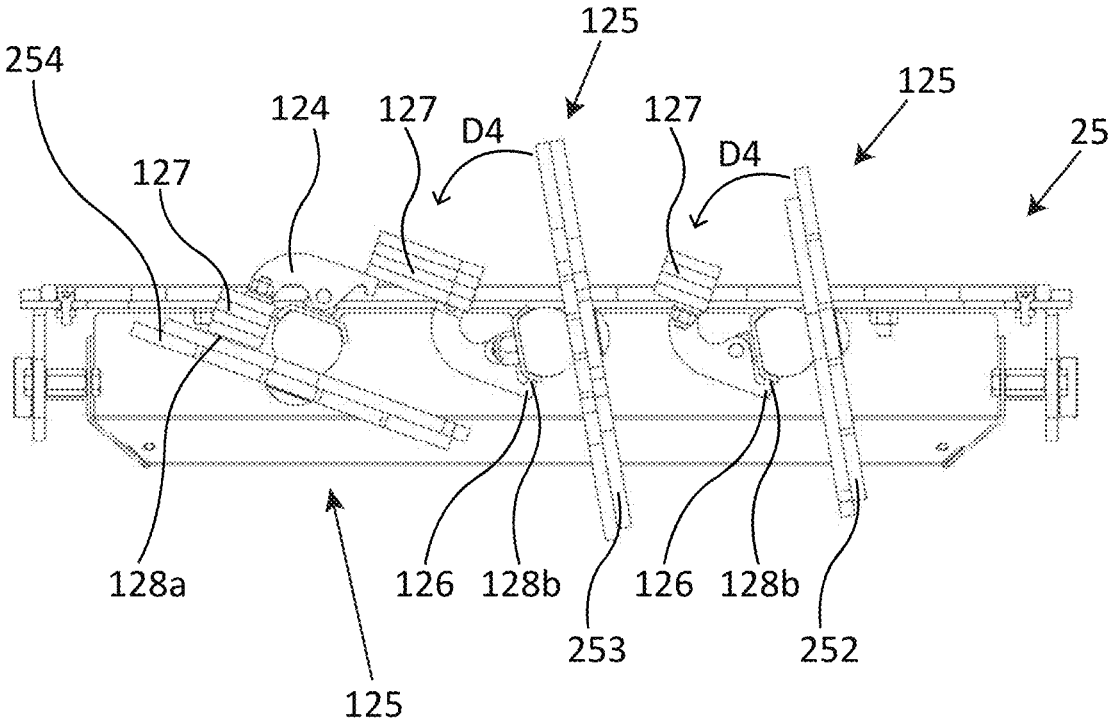
FIGS. 23*a* and 23*b* show a vertical cross-sectional view and a three-dimensional sectional view of the grate of FIG. 14*a* in a ninth condition.
Figure 23B:
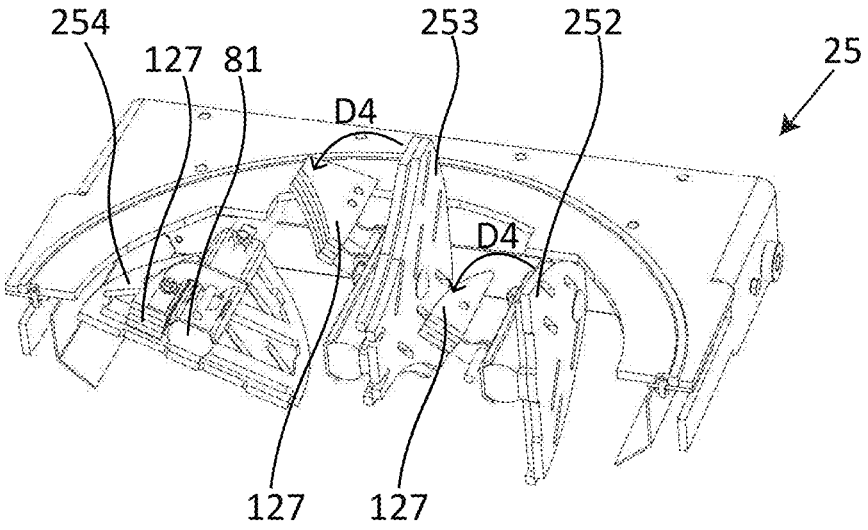

FIGS. 23*a* and 23*b* show a vertical cross-sectional view and a three-dimensional sectional view of the grate 25 of FIG. 14*a* in a ninth condition.

In this ninth state, the first and second rotating grate elements 252, 253 have continued to be rotated back together in the direction of arrow D4. The third rotating grate element 254 remains in a stationary rotating position.

In the process, the mass elements 127 exceeded their respective drop start positions and fell back. In the process, the impact arm heads 126 strike the impact faces 128*b* of the cleaning device and develop the knocking effect already described for cleaning the grate 25. Practical tests have shown that this second tapping effect/knocking effect during reverse rotation is even stronger than the first tapping effect/knocking effect during reverse rotation (D3). This is due, on the one hand, to the location of the impact or knocking, which is located closer to the rotary lug 81, whereby the impact energy can spread more evenly on or in the rotating grate element 252, 253, and, on the other hand, to the impact arm configuration with an asymmetrical lever arrangement. In this case, the impact arm head 126 is on the shorter side of the lever.

Figure 24A:
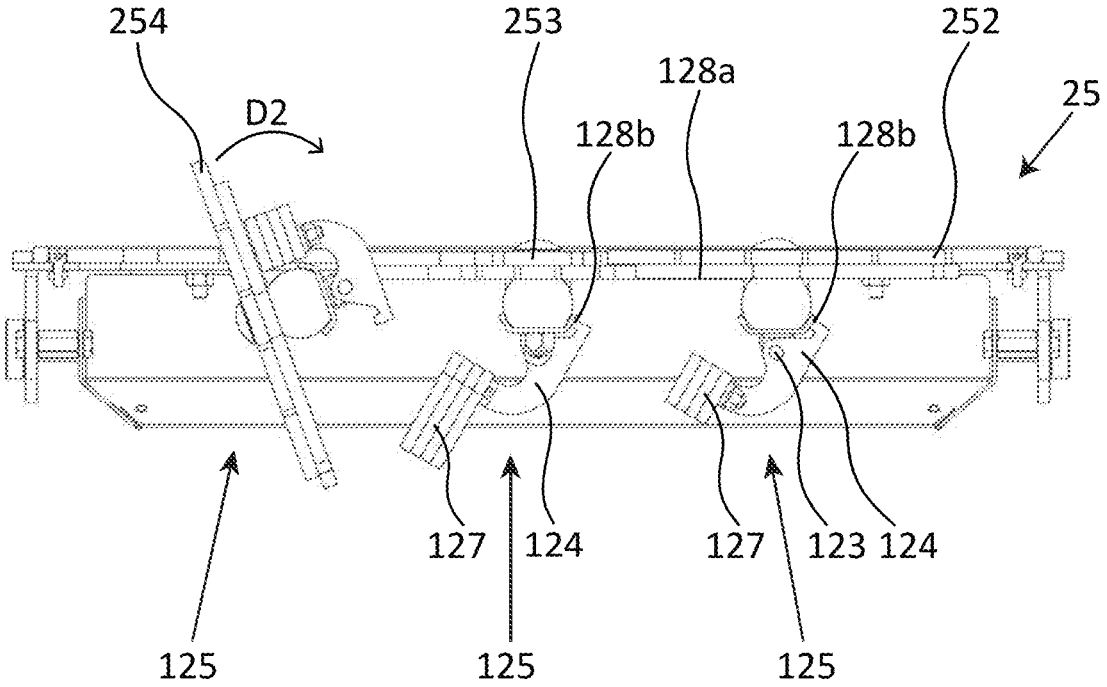
FIGS. 24*a* and 24*b* show vertical cross-sectional view and a three-dimensional sectional view of the grate of FIG. 14*a* in a tenth state.
Figure 24B:
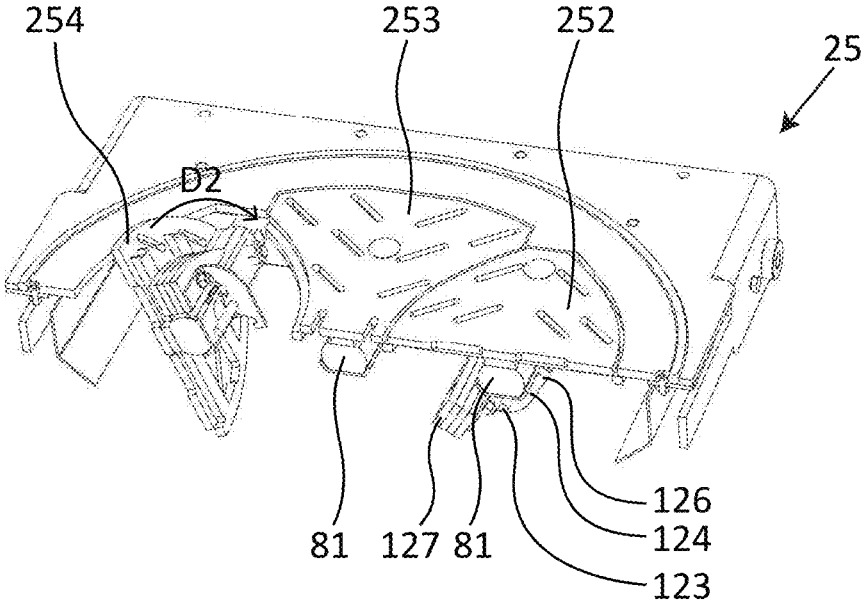

FIGS. 24*a* and 24*b* show a vertical cross-sectional view and a three-dimensional sectional view of the grate 25 of FIG. 14*a* in a tenth state. At this time, the first and second rotating grate elements 252, 253 have returned to their initial positions. The third rotating grate element 254 is now rotated back in the direction of arrow D2. The potential energy of the mass element 127 is increased.

Figure 25A:
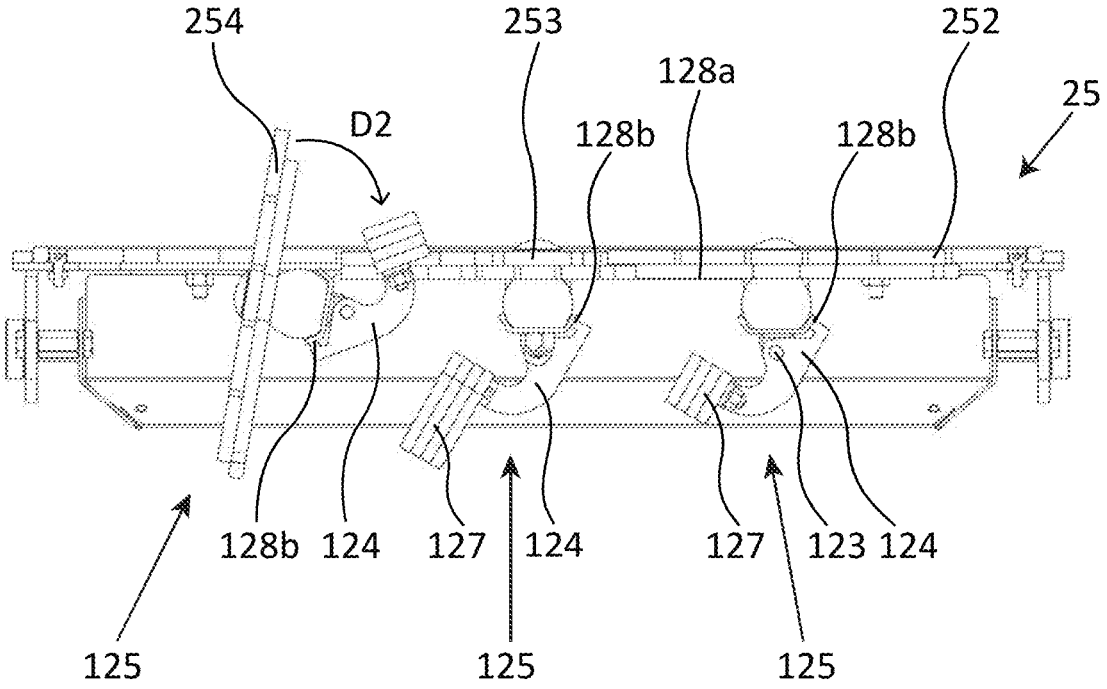
FIGS. 25*a* and 25*b* show vertical cross-sectional view and a three-dimensional sectional view of the grate of FIG. 14*a* in an eleventh condition.
Figure 25B:
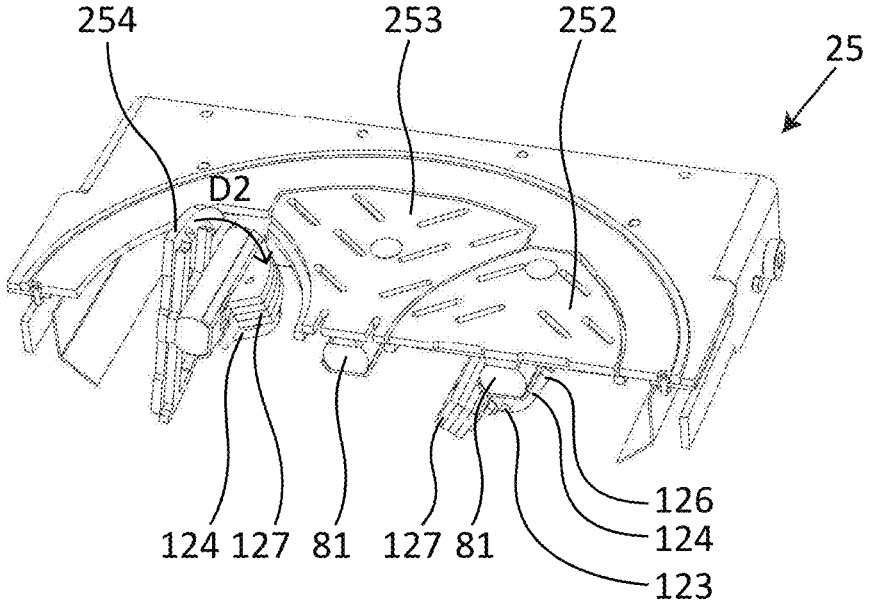

FIGS. 25*a* and 25*b* show a vertical cross-sectional view and a three-dimensional sectional view of the grate of FIG. 14*a* in an eleventh condition.

In the process, the mass element 127 of the cleaning device 125 of the third rotating grate element 254 has exceeded its drop start positions and has fallen down onto the impact face 128*b* of the third rotating grate element 25 and has knocked off the rotating grate elements 252, 253.

After the eleventh condition, the third rotating grate element 254 returns to its initial position. The cleaning process thus returns to the first state.

Figure 26:
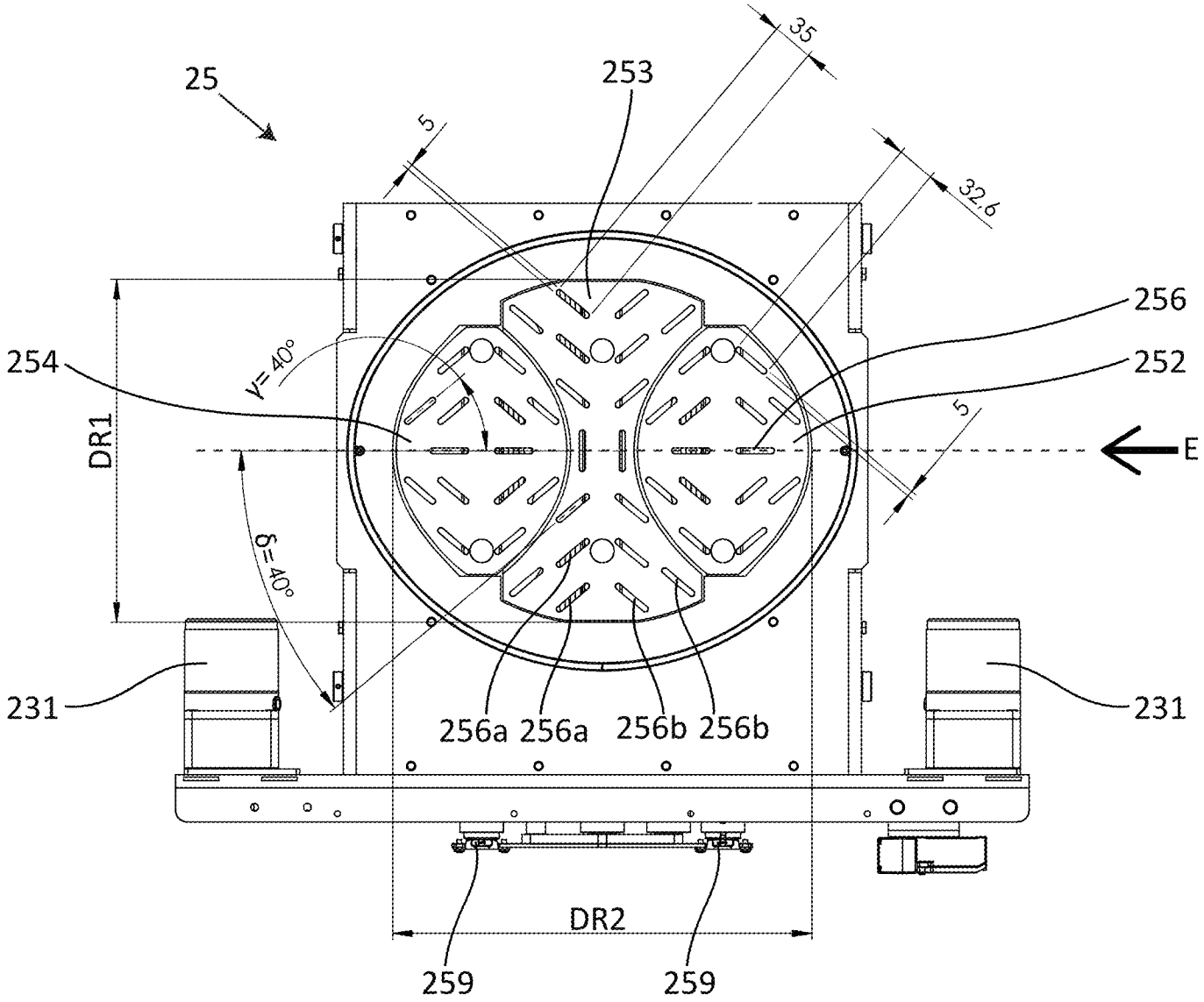
FIG. 26 shows a top view of the grate of FIG. 14 with perforations or slit-shaped openings.

FIG. 26 shows a top view of the rotating grate 25 of FIG. 14 with a perforation according to the invention.

The rotating grate 25 of FIG. 26 has a perforation, the perforation comprising a plurality of slit-shaped openings 256 arranged in a top view of the rotating grate 25 such that a first number of the slit-shaped openings 256*a* are arranged at a first angle λ and not parallel to an (axis of) insertion direction of the fuel onto the rotating grate 25, and a second number of the slit-shaped openings 256*b* are arranged at a second angle δ and not parallel to an insertion direction of the fuel onto the rotating grate 25.

Here, the angles λ and δ can preferably coincide. One leg of the angle λ and one leg of the angle δ extend through the longitudinal central axis of the respective slit-shaped and elongate extending opening 256, respectively (see also the exemplary details for determining the angle λ and the angle δ in FIG. 26). The other leg of the angle λ and the other leg of the angle δ are each formed by a longitudinal axis parallel to the (axis of the) insertion direction. Alternatively or additively, the other leg of the angle λ and the other leg of the angle δ may be formed by the longer central axis (major axis) of the oval combustion area of the rotating grate 25.

This arrangement of slot-shaped openings 256, generally angled with respect to the direction of insertion, prevents the creation of an air barrier when the pellets or wood chips are inserted, as they are much less likely to accumulate on the combustion area 258. For example, with slot-shaped openings provided transverse to the direction of insertion, there is a greater likelihood that the pellets or chips will catch on the edges of the openings and that a uniform flow of fuel cannot take place. Also, in the case of a grate 25, in particular with the complex geometry of the rotating grate elements 252, 253, 254 described above, with the angular arrangement of the slot-shaped openings 256, it is advantageously possible to provide an arrangement of the openings 256 with a distribution of the air flow through the fuel bed that is as uniform as possible.

In addition, elongated or slot-shaped openings 256 have the advantage that they are easy to manufacture and that they have a considerable opening area for the air flow, but without the fuel falling through the grate.

These slot-shaped openings 256 can preferably have a width of 4.6 mm+−0.5 mm (or +0.4 mm and −1 mm) and/or a length of 35 mm+−10 mm. Also, the slot-shaped openings 256 may have a width of 4.5 mm+−0.6 mm and/or a length of 40 mm+−20 mm. These dimensions are determined as shown in FIG. 26.

With regard to the above, tests have shown that these dimensions represent an optimum opening size for the air flow, in particular with regard to pellets of standardized size, that they can be easily tapped by the cleaning device 125 according to the invention, and that the slit-shaped openings are also easy to manufacture.

Further, the first angle (λ) may be greater than 30 degrees and less than 60 degrees, and/or it may be the second angle (δ) greater than 30 degrees and less than 60 degrees. Preferably, the first angle (λ) can be 40 degrees+−10 degrees. Further preferably, the second angle (δ) may be 40 degrees+−10 degrees.

In these angular ranges, the risk of fuel jamming during insertion and likewise the intensity of contamination of the openings 256 is advantageously lower.

For an improvement of the arrangement of the openings 265 in the rotating grate 25, it is incidentally already sufficient if only a part, preferably at least 80%, of the slot-shaped openings 256 are arranged at an angle to the insertion direction. Also, the slit-shaped openings 256 may be provided at only a first angle, and need not necessarily be provided with both angles λ and δ.

A perforation of a grate is intended on the one hand to ensure a sufficient and as uniform as possible flow of air through the fuel bed, but on the other hand the fuel must not fall off the grate unburned. Experiments have shown that purely oval or circular openings slag and clog more quickly, which can severely disrupt the air supply to the fuel bed. The use of at least one type of angled slots ensures adequate air flow, while also reducing the likelihood of fuel falling through the grate 25.

Moreover, the slot-shaped openings described above are more efficient or easier to tap because of this shape, thus creating a synergy between the effective cleaning device 125 and the shape of the openings 256 that is easier to tap with this cleaning device in such a way that the overall cleaning of the rotating grate 25 is improved. In addition, with the present complex geometry of the rotating grate elements 252, 253, 254, the surface of these elements can be more uniformly perforated with angularly arranged slot-shaped openings 256, or the openings 256 can be more uniformly distributed in this manner to ensure the most uniform flow possible through the fuel bed.

Other Embodiments

The invention admits other design principles in addition to the embodiments and aspects explained. Thus, individual features of the various embodiments and aspects can also be combined with each other as desired, as long as this is apparent to the person skilled in the art as being executable.

Although the rotating grate 25 of FIGS. 9 to 11 is shown without the cleaning device 125, it can be combined at any time with any of the cleaning devices 125 shown in the following figures.

Although the cleaning device is not shown in FIGS. 9 to 11, what is explained with respect to FIGS. 12*a* to 26 can also be applied to the rotating grate 25 of FIGS. 9 to 11, whereby improved cleaning of the rotating grate 25 can be achieved, particularly during partial and universal cleaning. Thus, the technical teachings concerning the cleaning device 125 may be combined with the technical teachings concerning FIGS. 9 to 11, as may be convenient to the person skilled in the art.

In the present example, the rotating grate 25 is described with three rotating grate elements 252, 253, 254. However, the rotating grate 25 may have only one rotating grate element 252, or it may have two rotating grate elements 252, 253. In principle, a rotating grate 25 with a plurality of rotating grate elements is conceivable. In this respect, the present disclosure is not limited to a specific number of rotating grate elements 252, 253, 254.

Further, each rotating grate element 252, 253, 254 may include one, two or more cleaning devices 125. Similarly, one or more rotating grate elements out of the total number of rotating grate elements of the rotating grate 25 may not include a cleaning device 125. For example, only one of the rotating grate elements 252, 253, 254 may include a cleaning device 125.

The recirculation device 5 with a primary recirculation and a secondary recirculation is described here. However, in its basic configuration, the recirculation device 5 may also have only primary recirculation and no secondary recirculation. Accordingly, in this basic configuration of the recirculation device, the components required for secondary recirculation can be completely omitted, for example, the recirculation inlet duct divider 532, the secondary recirculation duct 57 and an associated secondary mixing unit 5*b*, which will be explained, and the recirculation nozzles 291 can be omitted.

Again, alternatively, only primary recirculation can be provided in such a way that, although the secondary mixing unit 5*b* and the associated ducts are omitted, and the mixture of the primary recirculation is not only fed under the rotating grate 25, but this is also fed (for example via a further duct) to the recirculation nozzles 291 provided in this variant. This variant is mechanically simpler and thus less expensive, but still features the recirculation nozzles 291 to swirl the flow in the combustion chamber 24.

At the input of the flue gas recirculation device 5, an air flow sensor, a vacuum box, a temperature sensor, an exhaust gas sensor and/or a lambda sensor may be provided.

Further, instead of only three rotating grate elements 252, 253 and 254, two, four or more rotating grate elements may be provided. For example, five rotating grate elements could be arranged with the same symmetry and functionality as the presented three rotating grate elements. In addition, the rotating grate elements can also be shaped or formed differently from one another. More rotating grate elements have the advantage of increasing the crushing function.

It should be noted that other dimensions or combinations of dimensions can also be provided.

Instead of convex sides of the rotating grate elements 252 and 254, concave sides thereof may also be provided, and the sides of the rotating grate element 253 may have a complementary convex shape in sequence. This is functionally approximately equivalent.

Fuels other than wood chips or pellets can be used as fuels for the biomass heating system.

The rotating grate can alternatively be called a tilting grate.

The biomass heating system disclosed herein can also be fired exclusively with one type of a fuel, for example, only with pellets.

The combustion chamber bricks 29 may also be provided without the recirculation nozzles 291. This may apply in particular to the case where secondary recirculation is not provided.

The geometry, in particular of the circumference of the of the rotating grate elements 252, 253, 254, may differ from the geometry shown in FIG. 26. Thus, the teaching concerning the angular arrangement of the slot-shaped openings 256 of FIG. 26 can also be applied to other types and shapes of grates. In addition, for example, tilting or sliding grates can also be provided with the angular arrangement of the slot-shaped openings 256.

The embodiments disclosed herein have been provided for the purpose of describing and understanding the technical matters disclosed and are not intended to limit the scope of the present disclosure. Therefore, this should be construed to mean that the scope of the present disclosure includes any modification or other various embodiments based on the technical spirit of the present disclosure.

LIST OF REFERENCE NUMERALS

1 Biomass heating system
11 Boiler
12 Boiler foot
13 Boiler housing
14 Water circulation device
15 Blower
16 Exterior cladding
125 Cleaning device

121 Mounting with stop
122 Suspension
123 Rotary axis/axle/bearing/joint
124 Impact arm
124*a*, 124*b* first end, second end of impact arm
126 Impact arm head
127 Mass element
127*a*, 127*b* Area of the mass element
128*a*, 128*b* Impact face
2 combustion device
21 first maintenance opening for the combustion device
22 Rotary mechanism holder
23 Rotating mechanism
24 Combustion chamber
25 Rotating grate
26 Primary combustion zone of the combustion chamber
27 Secondary combustion zone or radiation part of the combustion chamber
28 Fuel bed
29 Combustion chamber bricks
A1 first horizontal section line
A2 first vertical section line
201 Ignition device
202 Combustion chamber slope
203 Combustion chamber nozzle
211 Insulation material e.g. vermiculite
231 Drive or motor(s) of the rotating mechanism
251 Bottom plate or Base plate of the rotating grate
252 First rotating grate element
253 Second rotating grate element
254 Third rotating grate element
255 Transition element
256 Openings
257 Grate lips
258 Combustion area
259 Rotational position sensor
260 Support surfaces of the combustion chamber bricks
261 Groove
262 Lead/Ledge
263 Ring
264 Retaining stones/Mounting blocks
265 Slope of the mounting blocks
291 Secondary air or recirculation nozzles
3 Heat exchanger
31 Maintenance opening for heat exchanger
32 Boiler tubes
33 Boiler tube inlet
34 Turning chamber entry/inlet
35 Turning chamber
36 Spring turbulator
37 Belt or spiral turbulator
38 Heat exchange medium
331 Insulation at boiler tube inlet
4 Filter device
41 Exhaust gas outlet
42 Electrode supply line
43 Electrode holder
44 Filter inlet
45 Electrode
46 Electrode insulation
47 Filter outlet
48 Cage
49 Flue gas condenser
411 Flue gas supply line to the flue gas condenser
412 Flue gas outlet from the flue gas condenser
481 Cage mount/bracket
491 First fluid connection
491 Second fluid connection
493 Heat exchanger tube
4931 Pipe/Tube holding element
4932 Tubular floor element
4933 Loops/reversal points
4934 first spaces between heat exchanger tubes relative to each other
4935 second intermediate spaces of the heat exchanger tubes to the Outer wall of the flue gas condenser
4936 Passages
495 Head element
4951 Head element flow guide
496 Condensate discharge
4961 Condensate collection funnel
497 Flange
498 Side surface with maintenance opening
499 Support device for the flue gas condenser
5 Recirculation device
50 Ring duct around combustion chamber bricks
52 Air valve
53 Recirculation inlet
54 Primary mixing duct
55 Secondary mixing duct or secondary tempering duct
56 Primary recirculation duct
57 Secondary recirculation duct
58 Primary air duct
59 Secondary air duct
5*a* Primary mixing unit
5*b* Secondary mixing unit
521 Valve actuator
522 Valve actuating axes
523 Valve leaf
524 Valve body
525 Valve antechamber
526 Valve aperture
527 Valve body
528 Valve area
531 Recirculation inlet duct
532 Recirculation inlet duct divider
541 Primary passage
542 Primary mixing chamber
543 Primary mixing chamber outlet
544 Primary receive valve insertion
545 Primary air valve inlet
546 Primary mixing chamber housing
551 Secondary passage
552 Secondary mixing chamber
553 Secondary mixing chamber outlet
554 Secondary recurrent valve insertion
555 Secondary air valve inlet
556 Secondary mixing chamber housing
581 Primary air inlet
582 Primary air sensor
591 Secondary air inlet
592 Secondary air sensor
6 Fuel supply
61 Cell wheel lock
62 Fuel supply axis
63 Translation mechanics/mechanism
64 Fuel supply duct
65 Fuel supply opening/port
66 Drive motor
67 Fuel screw conveyor
7 Ash removal/Ash discharge
71 Ash discharge screw conveyor
711 Screw axis
712 Centering disk

713 Heat exchanger section
714 Burner section
72 Ash removal motor with mechanics
73 Transition screw
731 right subsection—scroll rising to the left
732 left subsection—right rising scroll
74 Ash container
75 Transition screw housing
751 Opening of the transition screw housing
752 Boundary plate
753 Main body section of housing
754 Fastening and separating element
755 Funnel element
81 Bearing axles
82 Rotation axis of the fuel level flap
83 Fuel level flap
831 Main area
832 Center axis of the rotary axis or bearing shaft 81
833 Surface parallel
834 Openings
84 Bearing notch/Support notch
85 Sensor flange
86 Glow bed height measuring mechanism
9 Cleaning device
91 Cleaning drive
92 Cleaning shafts
93 Shaft holder
94 Projection
95 Turbulator holders/brackets
951 Pivot bearing mounting
952 Projections
953 Culverts/Passages
954 Recesses
955 Pivot bearing linkage
96 two-arm hammer/striker
97 Stop head
E Direction of fuel insertion
S* Flow arrows
F1 Drop start position
D1 first direction of rotation
D2 second direction of rotation
H Horizontal
FS Impact
Ms Center of mass
S Direction of fall
Le Longitudinal axis of the slots

The invention claimed is:

1. A rotating grate for a biomass heating system, the rotating grate comprising:
at least one rotating grate element;
at least one bearing axle, by means of which the rotating grate element is rotatably mounted;
at least one cleaning device attached to one of the rotating grate elements, the cleaning device comprising a mass element movable relative to the rotating grate element;
wherein the cleaning device is arranged such that upon rotation of the rotating grate element an acceleration movement of the mass element is initiated so that the cleaning device exerts a knocking effect on the rotating grate element to clean the rotating grate element.

2. The rotating grate for a biomass heating system according to claim 1, wherein
the cleaning device is configured such that
the mass element is raised to a drop start position (F1) upon rotation of the rotating grate element to initiate the acceleration motion movement, from which the mass element drops under the influence of the acceleration due to gravity to produce the knocking effect on the rotating grate element.

3. The rotating grate for a biomass heating system according to claim 1, wherein
the cleaning device is configured such that
the mass element of the cleaning device strikes an impact face of the rotating grate element during its acceleration or falling movement.

4. The rotating grate for a biomass heating system according to claim 1, wherein
the cleaning device is configured such that
the mass element of the cleaning device deflects an impact arm during its acceleration or falling movement, so that the latter impacts against an impact face.

5. The rotating grate for a biomass heating system according to claim 1, wherein
the cleaning device is configured such that
when the rotating grate element is rotated in a first direction (D1) and when the rotating grate element is rotated in a second direction (D2), which is opposite to the first direction, the rotating grate element is struck against an impact face in each case.

6. The rotating grate for a biomass heating system according to any claim 1, wherein
the cleaning device is attached to the underside of the rotating grate element opposite a combustion area of the rotating grate element.

7. The rotating grate for a biomass heating system according to claim 1, wherein
the cleaning device comprises the following:
a suspension attached to the rotating grate element and having a joint;
an impact arm having a first end and a second end, the mass element being provided at one of the ends of the impact arm;
wherein the impact arm is pivotally connected to the suspension via the joint about an axis of rotation of the joint.

8. The rotating grate for a biomass heating system according to any claim 7, wherein
the bearing axle the rotating grate element is provided at least approximately parallel to the axis of rotation of the joint of the impact arm; and/or
the bearing axle is arranged at least approximately horizontally.

9. The rotating grate for a biomass heating system according to claim 7, wherein
the impact arm is pivotally arranged by a predefined angle (μ) between the drop start position (F1) and a drop end position (Fe); and/or
the cleaning device is attached exclusively to the rotating grate element and is in communication therewith.

10. The rotating grate for a biomass heating system according to claim 1, wherein
the cleaning device with the mass element is configured such that the mass element has a flat impact face which is aligned at least approximately parallel to the impact face during impact.

11. The rotating grate for a biomass heating system according to claim 1, wherein at least one impact face is provided on the underside of the rotating grate element and/or on the bearing axle and/or on the cleaning device.

12. The rotating grate for a biomass heating system according to claim 1,
wherein the rotating grate elements form a combustion area for the fuel;

wherein the rotating grate elements have openings for air for combustion, wherein the openings are elongated in the form of a slot, wherein a longitudinal axis (Le) of the openings is provided at an angle of 30 to 60 degrees to a fuel insertion direction (E).

13. The rotating grate for a biomass heating system according to claim 1, wherein the rotating grate has a first rotating grate element, a second rotating grate element and a third rotating grate element, which are each arranged rotatably by at least 90 degrees about the respective bearing axle.

14. The rotating grate for a biomass heating system according to claim 13, wherein the rotating grate further comprises a rotating grate mechanism configured to rotate the third rotating grate element independently of the first rotating grate element and the second rotating grate element, and to rotate the first rotating grate element and the second rotating grate element together with each other and independently of the third rotating grate element.

15. The rotating grate for a biomass heating system according to claim 1, wherein the rotating grate has a perforation; and wherein the perforation consists of a plurality of slot-shaped openings arranged in a top view of the rotating grate such that:

a first number of the slot-shaped openings is arranged at a first angle (λ) and not parallel to a direction of insertion of the fuel onto the rotating grate.

16. The rotating grate for a biomass heating system according to claim 15, wherein a second number of the slot-shaped openings is arranged at a second angle (δ) and not parallel to a direction of insertion of the fuel onto the rotating grate.

17. The rotating grate for a biomass heating system according to claim 15, wherein the first angle (λ) is greater than 30 degrees and less than 60 degrees; and the second angle (δ) is greater than 30 degrees and less than 60 degrees.

18. The rotating grate for a biomass heating system according to claim 15, wherein a combustion area of the rotating grate configures a substantially oval or elliptical combustion area; and the direction of insertion (E) of the fuel is equal to a longer central axis of the oval combustion area of the rotating grate (25).

19. A method of cleaning a rotating grate of a biomass heating system, wherein the rotating grate comprises the following:

at least one rotating grate element;

at least one bearing axle, by means of which the rotating grate element is rotatably mounted;

at least one cleaning device attached to one of the rotating grate elements, the cleaning device comprising a mass element movable relative to the rotating grate element;

the method comprising the steps of:

Rotating the rotating grate element in a first direction (D1) and moving the mass element of the cleaning device as a result;

Initiating an acceleration movement of the mass element;

Impacting the mass element with a knocking effect on an impact face of either the rotating grate element or the cleaning device for cleaning the rotating grate element.

20. The method for cleaning a rotating grate of a biomass heating system, according to claim 19, wherein the mass element is raised to a drop start position (F1, F2) upon rotation of the rotating grate element to initiate the acceleration movement, from which the mass element drops under the influence of the acceleration due to gravity to produce the knocking effect on the rotating grate element.

21. The method for cleaning a rotating grate of a biomass heating system, according to claim 19, wherein when the rotating grate element is rotated in a first direction (D1, D3) and when the rotating grate element is rotated in a second direction (D2, D4), which is opposite to the first direction, in each case an impact on an impact face takes place.

* * * * *